US006036461A

United States Patent [19]

Bahniuk

[11] Patent Number: 6,036,461

[45] Date of Patent: Mar. 14, 2000

[54] EXPANSIBLE CHAMBER DEVICE HAVING ROTATING PISTON BRAKING AND ROTATING PISTON SYNCHRONIZING SYSTEMS

[75] Inventor: Eugene Bahniuk, Gates Mills, Ohio

[73] Assignee: Bahniuk, Inc., Gates Mills, Ohio

[21] Appl. No.: 09/108,076

[22] Filed: Jun. 30, 1998

Related U.S. Application Data

[60] Provisional application No. 60/051,647, Jul. 3, 1997.

[51] Int. Cl.[7] ..... F01C 1/00

[52] U.S. Cl. ..... 418/35; 418/33; 123/245

[58] Field of Search ..... 123/245; 418/35, 418/33

[56] References Cited

U.S. PATENT DOCUMENTS

| | | | |
|---|---|---|---|
| 4,373,879 | 2/1983 | Picavet | 418/35 |
| 4,390,327 | 6/1983 | Picavet | 418/35 |
| 4,744,736 | 5/1988 | Stauffer | 418/35 |
| 4,890,591 | 1/1990 | Stauffer | 123/213 |
| 5,069,604 | 12/1991 | Al-Szbih | 418/36 |
| 5,083,539 | 1/1992 | Cornelio | 123/210 |
| 5,433,179 | 7/1995 | Wittry | 123/245 |
| 5,727,518 | 3/1998 | Blanco Palacios et al. | 123/245 |

*Primary Examiner*—Noah P. Kamen
*Assistant Examiner*—Hai Huynh
*Attorney, Agent, or Firm*—Fay, Sharpe, Fagan, Minnich & McKee, LLP

[57] ABSTRACT

An expansible chamber device includes a rotating piston braking system and a rotating piston synchronizing system. The rotating piston braking system controls the motion of the expansible chamber device piston assemblies to cause intermittent rotation of the piston assemblies in the same direction during recurrent periods of rotation, with each of the piston assemblies being stopped between the periods of rotation. The braking system includes a set of cam surfaces on the piston assemblies and a set of movable members adapted to alternately engage the first and second set of cam surfaces to stop the rotation of first piston assembly while permitting second piston assembly to rotate freely. A pair of elongate pivotable members engage the piston assemblies on one end and engage a slidable member on the other end. The slidable member and the pivotable members alternate between first and second positions in response to engagement with ramp and stop surfaces provided on the piston assemblies. The rotating piston synchronizing system includes a rotatable link member carried on a connection axle extending transversely from an elongate output shaft. The link member includes a pair of pins that are slidably engagable with opposed piston assembly pairs to permit relative rotation between the piston assembly pairs within a predetermined range. The rotating piston synchronizing system is totally contained within the housing of the expansible chamber device to save space.

38 Claims, 60 Drawing Sheets

EXPANSIBLE CHAMBER DEVICE HAVING ROTATING PISTON BRAKING AND ROTATING PISTON SYNCHRONIZING SYSTEMS

CROSS-REFERENCE TO RELATED APPLICATIONS

This application claims the benefit of U.S. provisional application Ser. No. 60/051,647, filed Jul. 3, 1997.

BACKGROUND OF THE INVENTION

The present invention is directed to expansible chamber devices and, in particular, to expansible chamber devices in which working members comprise alternately approaching and receiving elements. The invention finds particular application in devices such as internal combustion engines, pumps, and fluid motors. The invention also relates to braking systems for controlling the motion of the working members in expansible chamber devices, including devices for controlling the intermittent rotation of the alternately approaching and receding elements used to define one or more expansible chambers. The invention further relates to rotating piston synchronizing systems for controlling the maximum extent of relative rotational motion between pairs of alternately approaching and receding elements of the expansible chamber device.

Expansible chamber devices generally operate by changing the volume defined between working members in order to compress a working fluid or gas. One form of known expansible chamber devices, for example, is that disclosed in U.S. Pat. No. 4,279,577. There, the device incorporates a pair of opposed rotating members comprising one or more radially extending veins or abutments to define, in part, an expansible chamber. Each of these members undergoes intermittent and alternating motion throughout the cyclic operation of the engine or pump. In devices of this type, the movement of the rotating members must be carefully controlled and synchronized. In the past, this control has been accomplished using control mechanisms which are complex in design and operation and which may be unreliable at higher operating speeds.

In U.S. Pat. No. 4,605,361, an oscillating vane rotary pump or motor uses a drive pin adapted to engage helical slots defined in coaxial rotor shafts and cam rollers to provide for oscillating the rotors and vanes with respect to each other as the rotors rotate with respect to the rotary pump or motor cylinder. In that system, a stationary cam is needed to permit the two pistons to rotate continuously as the output, or input in a pump, shaft rotates. Accordingly, that device is of little use in expansible chamber devices of the type including rotating pistons that intermittently rotate in the same direction during recurrent periods of rotation with each of the piston assemblies being stopped between the periods of rotation.

Sets of non-circular gears are used to control the relative positions of the rotating pistons in U.S. Pat. No. 5,381,766. The gears in that system, however, are difficult and expensive to manufacture and, further, do not provide a uniform perk output on the shaft.

It would, therefore, be desirable to provide a device for controlling the motion of the working members in an efficient and simple fashion which solves the problems recognized in the prior art. It would further be desirable to provide a device for controlling the relative angular position between the working members to be within a predetermined range for purposes of synchronizing them at start up when the expansible chamber device is used as an engine. The aforementioned problems are addressed by the present invention described in detail in this specification.

SUMMARY OF THE INVENTION

The subject invention provides improvements to expansible chamber devices of the type described which controls the motion of the working members for intermittent motion of alternately approaching and receding elements and which synchronizes the working members so that the maximum extent of relative rotational movement is constrained to within a predetermined extent. In addition, the invention provides other improvements resulting in significant operating efficiencies and also enabling the expansible chamber device to be used in a wide variety of applications.

In accordance with the subject invention, there is provided an internal combustion engine that includes a housing defining a cylindrical working chamber and first and second interdigitated piston assemblies rotatably moveable in the cylindrical working chamber. The housing includes intake and exhaust ports and each piston assembly includes at least one pair of diametrically opposed radial vanes forming pistons in the working chamber. The pistons divide the working chamber into a plurality of pairs of diametrically opposed compartments. A braking mechanism controls the motion of the piston assemblies to cause intermittent rotation of the first and second piston assemblies in the same direction during current periods of rotation with each the first and second piston assemblies being stopped between the periods of rotation. The braking mechanism includes a first and second set of cam surfaces formed on the first and second piston assemblies respectively. A set of moveable members are adapted to alternately engage the first set of cam surfaces to stop the rotation of the first piston assembly while permitting the second piston assembly to rotate freely and then to engage the second set of cam surfaces to stop the rotation of the second piston assembly while permitting the first piston assembly to rotate freely.

In accordance with a further aspect of the invention, the braking mechanism includes first and second elongate pivotable members having first ends adapted to engage the first and second set of cam surfaces, respectively. A slidable member is disposed between second ends of the first and second elongate pivotable members for transmitting motion therebetween. In their preferred form, the first and second set of cam surfaces each include a pair of ramp surfaces and a pair of stop blocks. The first pair of stop blocks are adapted to engage the first pivotable member and stop the rotation of the first piston assembly when the first pivotable member is in a first position. The second pair of stop blocks are adapted to engage the second pivotable member and stop the rotation of the second piston assembly when the second pivotable member is in a first position.

The first and second pair of ramp surfaces on the first and second piston assemblies, respectively, are adapted to engage the first and second pivotable members to alternately urge the pivotable members between first and second positions to enable the first and second piston assemblies to be stopped between periods of rotation.

In one preferred form of the slidable member, first and second rod members are disposed between the pivotable members and the first and second rod members are connected together by an intermediate dampening spring member to permit relative slidable motion between the rod members so that the braking mechanism operates smoothly.

In accordance with yet a further aspect of the subject invention, an internal combustion engine of the type described is provided including an elongate output shaft connected to the first and second piston assembly and defining a set of connection areas arranged on the output shaft to extend in directions transverse to the longitudinal axis of the shaft. A set of link elements are provided for engagement with the set of connection areas. Each link element is simultaneously slidably engagable with both of the first and second piston assemblies to transmit rotational motion from the first and second piston assemblies to the output shaft and to permit relative rotation between the first and second piston assemblies about the longitudinal axis of the output shaft within a predetermined range. Synchronization between the first and second piston assemblies are thereby provided.

In their preferred form, the set of connection areas include a pair of connection axle members extending in substantially diametrically opposite directions from the output shaft substantially perpendicular to the longitudinal axis defined by the shaft. The set of link elements preferably include the first and second link members that are rotatably carried on the pair of connection axle members. The first group of link areas include first and second link pins carried on the first and second connection axle members respectively. The first and second link pins are adapted for slidable movement in arcuate grooves provided in the first piston assembly. Similarly, the second group of link areas include third and fourth link pins carried on the first and second connection axle members respectively. The third and fourth link pins are adapted for slidable movement in an arcuate groove provided in the second piston assembly.

In its preferred form, the synchronizing mechanism permits relative rotation between the first and second piston assemblies about the longitudinal axis of the output shaft within a predetermined range of about 0–70 degrees when each piston assembly carries four radial pistons, about 0–150 degrees when each piston assembly carries two radial pistons, and about 0–330 degrees when each piston assembly carries a single radial piston.

In view of the above, it is a primary object of the invention to provide a braking mechanism for controlling the motion of the piston assemblies in an expansible chamber device to cause intermittent rotation of the piston assemblies in the same direction during recurrent periods of rotation with each of the first and second piston assemblies being stopped between periods of rotation.

A further object of the invention is the provision of a synchronizing mechanism for use in expansible chamber devices of the type described to limit relative rotation between pairs of piston assemblies to within a predetermined range.

Still other advantages and benefits of the invention will become apparent to those skilled in the art upon a reading and understanding of the following detailed description.

BRIEF DESCRIPTION OF THE DRAWINGS

The invention may take physical form in certain parts and arrangement of parts, the preferred embodiments of which will be described in detail in this specification and illustrated in the accompanying drawings which form a part hereof and wherein.

DETAILED DESCRIPTION OF THE PREFERRED EMBODIMENTS

Figure 1:
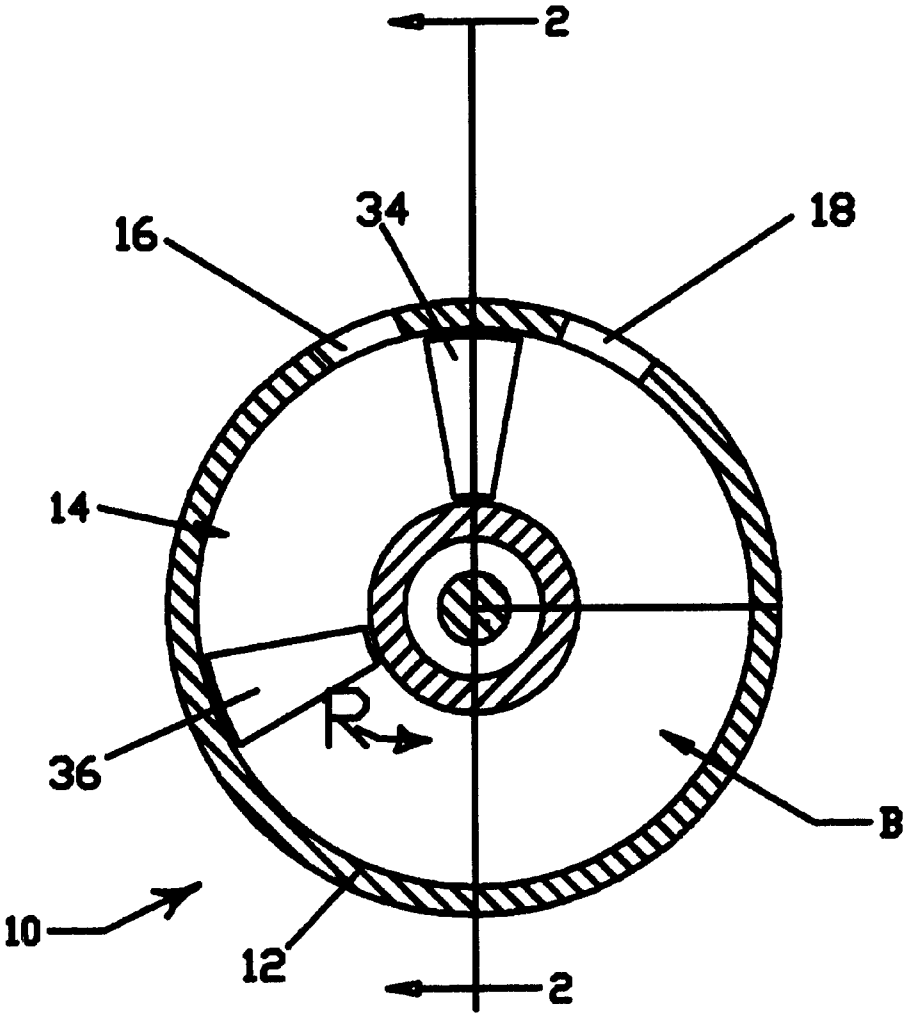
FIG. 1 is an end view taken in partial cross-section showing the overall arrangement of an expansible chamber device of the type to which the invention is directed.
Figure 2:
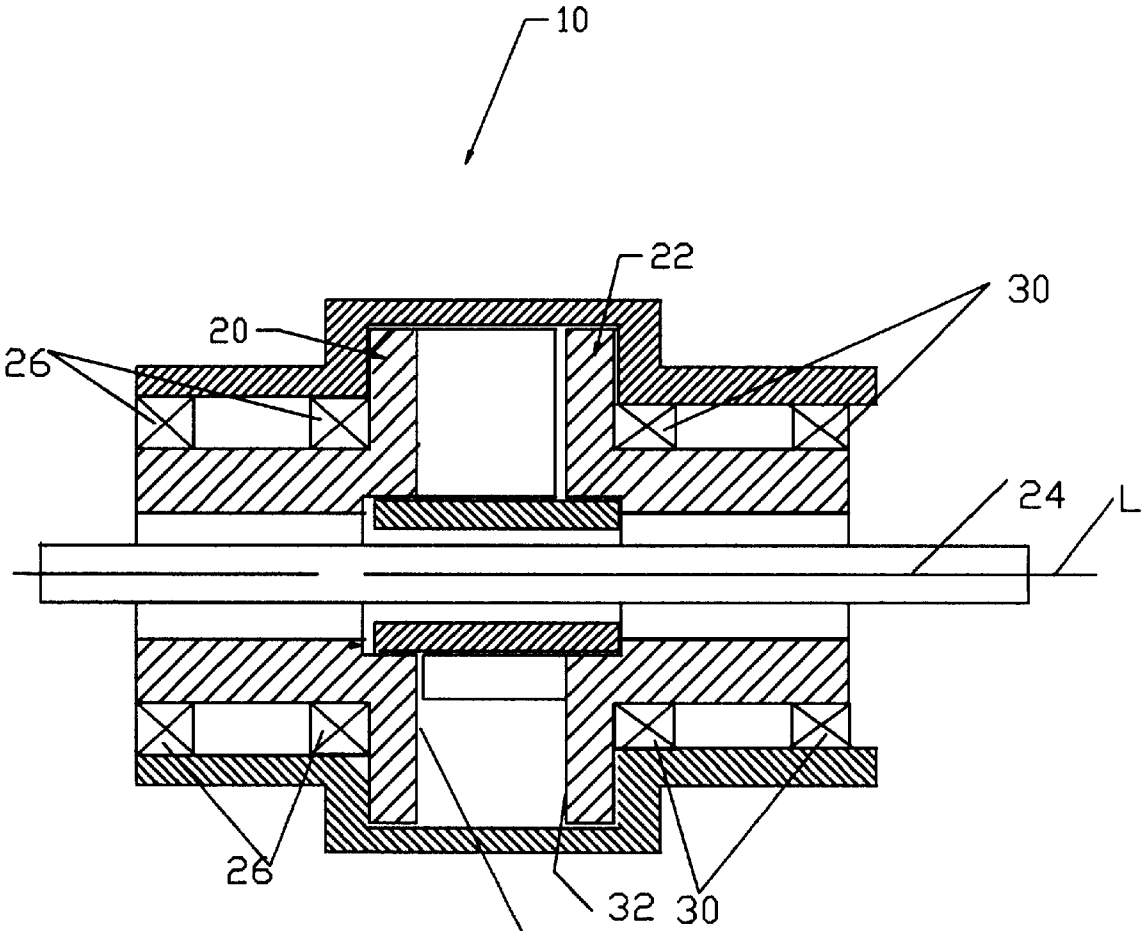
FIG. 2 is a side view taken in partial cross-section along line 2—2 of FIG. 1.

Referring now to the drawings wherein the showings are for the purposes of illustrating the preferred embodiments of the invention only and not for purposes of limiting the same, FIGS. 1 and 2 show the overall arrangement of an expansible chamber device of the type to which the invention is directed. In the system illustrated, the expansible chamber device 10 includes a housing 12 defining a cylindrical working chamber 14 having an inlet port 16 and an outlet port 18. First and second interdigitated piston assemblies 20, 22 are rotatably movable in the cylindrical working chamber 14. As is shown, the first piston assembly is carried on an elongate shaft 24 that is constrained by a set of support bearings 26 to rotate about a longitudinal axis L. Connected to the shaft 24 is a first side plate member 28 which forms one side of the cylindrical working chamber 14. Similarly, the second piston assembly 22 is carried on the shaft so 24 by a second set of support bearings 30 arranged as shown. A second side plate 32 forms the other side of the cylindrical working chamber 14.

Each of the first and second piston assemblies 20, 22 include at least one radially extended vane 34, 36, respectively, forming pistons in the working chamber and dividing the working chamber into pairs diametrically opposed compartments or volumes A, B, respectively. The housing member 12 forms the outer circular extent of the volumes A, B and the piston assemblies carry a centerpiece 38 which forms the inner wall of the volume A, B.

In operation, the first and second piston assemblies 20, 22 both rotate about the same longitudinal axis L. The two groups of piston assemblies rotate with relative velocities with respect to one another. When the rotational velocities of the first and second piston assemblies are different, the volumes A, B change in size in a manner such that when one volume is increasing in size, the diametrically opposed volume of the pair is, necessarily, decreasing in size. In most expansible chamber devices of the type described, the piston assemblies rotate in the same direction during recurrent periods of rotation with each of the piston assemblies being stopped between periods of rotation. Although the piston assemblies can move either in a clockwise or counter clockwise direction in a given application, they are constrained to rotate in one direction.

With continued reference to FIGS. 1 and 2, but with particular attention to FIG. 1, the volumes A, B expand and contract as the pistons 34, 36 alternately rotate. When the first piston 34 is stationary and the second position 36 is rotating in the counter clockwise direction as indicated by the arrow labeled R in the figure, the first volume A increases in size while the second volume B decreases in size. The second piston 36 moves away from the first piston 34 to draw fluid into the increasing volume A through the inlet port 16. The second piston 36 is also moving toward the first piston 34 as to the second volume B to expel fluid through the outlet port 18. Accordingly, the expansible chamber device 10 illustrated in the figures are capable of performing the basic functions of simultaneous increasing and decreasing volumes.

A braking mechanism for controlling the motion of the piston assemblies to cause intermittent rotation of the first and second pistons in the same direction during recurrent periods of rotation will be described below. Another important aspect to realize the above functionality and not shown in the basic drawings of FIGS. 1 and 2 is a mechanism or device which prevents rotation in the opposite direction of the piston assemblies. In FIG. 1, such device would prevent rotation of the piston assemblies in the clockwise direction. One such mechanism that could be used to perform this function is a "sprag" clutch. Sprag clutches in other anit-rotation mechanisms or devices are not needed in pumps but are necessary in motors and internal combustion engines.

With yet continued reference to FIGS. 1 and 2, as the second rotating piston 36 rotates about the longitudinal axis L, it approaches the stationary piston 34. The braking mechanism described in detail below provides for a release of the stationary piston 34 at the appropriate time, and further, provides for the braking of the motion of the moving piston 36 at the appropriate time and position. During the next period of operation, the second piston 36 is stopped in the position previously occupied by the first piston 34. The first piston then moves about the longitudinal axis L. This continues until the first piston 34 approaches the then stationary second piston 36. As the first piston 34 approaches the second piston 36, the second piston is released to move and the first piston 34 then again assumes the position illustrated in FIG. 1. Thus, the pistons are alternately stopped and rotated intermittently during recurrent periods.

As shown in the figures, the expansible chamber device includes multiple pairs of interdigitated pistons that move independently about a common central longitudinal axis in the same direction, either clockwise or counter clockwise. The piston pairs alternately stop and rotate. The piston that is stopped generally absorbs the bulk of the reaction forces generated within the contained volumes of the device. The moving piston transmits the action of the forces generated within the volumes. The action of the forces manifests itself as a torque and or rotation of the output shaft 24 about the longitudinal axis L. A braking mechanism is used to locate the position of the pistons or piston pairs in a manner that while one piston is stopped the other piston is free to move in the predetermined designated direction. An anti-reversing mechanism prevents the pistons from rotating in a direction opposite from the predetermined designated direction when the expansible chamber device is not used as a pumping mechanism.

The braking mechanism further allows the stationary piston to move from the stopped position into the designated direction while then stopping the previously moving piston. Lastly, a synchronizing mechanism is provided for limiting the relative angular displacement between the first and second pistons so that the expansible chamber device does not fall out of synchronization preventing the device from being started when used as an engine. The expansible chamber device of the present invention is useful in many ways to produce mechanical energy from chemical, thermodynamical and various other actions such as when used as an internal combustion engine and also to produce fluid flow or compression in response to a mechanical energy input when the device is used as a pump or compressor.

With still yet continued reference to FIGS. 1 and 2, the motion of the pistons 34, 36 can be caused by either the rotation of the input shaft 24 such as when the device is used as a pump or compressor, or by pressures within the volumes A, B such as when the device is used as an engine or motor.

When the motions of the radial pistons are caused by pressure differentials across the piston faces, the pressure difference can be produced by chemical or thermodynamical actions within the material occupying the volumes A, B or by the flow of material into and out of the compartments defining the volumes A, B. When the subject expansible chamber device is used as a motor, the pressure in volume A is greater than the pressure in volume B causing the second piston to move in the counter clockwise direction as indicated by the arrow R.

Inlet and outlet ports 16, 18 are provided as illustrated in FIG. 1 through the housing for communication of fluid into volume A and out of volume B, respectively. The inlet port 16 is used to introduce flowing materials such as, for example, a fuel mixture, into the first volume A from an external source. The outlet port 18 permits material such as exhaust gases or the like to exit the second volume B. When the first volume A is connected to an external source of a compressed fluid such as when the device is used as a fluid motor, the second piston 36 is urged into counter clockwise rotation as shown in the drawing figure by the arrow labeled R. During movement of the second piston, the first piston 34 is held fixed in place as illustrated by the braking mechanism to be described in detail below. As the second piston rotates, mass flow of material is permitted to escape the second volume B through the outlet port 18. Alternatively, the material in the second volume can be permitted to merely compress within the second volume when the material is compressible.

During operation of the subject expansible chamber device, the second piston 36 continues its counter clockwise rotation until the second volume B is either reduced to near zero or until the face of the second piston closes the outlet port 18. At that time, the second volume B is substantially reduced to near zero and the second piston approaches close to the first piston 34. The braking mechanism is actuated at this point so that the first piston 34 may be released and allowed to move in a counter clockwise rotation. The first piston is urged into motion by either impact with the second piston or, by the pressure generated by the compressed material between the first and second pistons in the second volume B.

As the first piston 34 is permitted to rotate counter clockwise, it advances beyond the inlet port 16 to permit fluid to enter behind the advancing first piston and into the second volume B, the second piston 36 being stopped at the rotational position formerly occupied by the first piston by the action of the locking mechanism described below. The moving pistons cause the output shaft 24 to rotate about the longitudinal axis L to produce torque.

The expansible chamber device of FIGS. 1 and 2 can also act as a pump mechanism when the pistons are back driven through the shaft 24 by an external source of mechanical torque. The moving pistons act on the fluids in the volumes A, B creating vacuum and reduced pressure zones so that fluid enters into the inlet port 16 and exits out of the outlet port 18 at an elevated pressure. When the device is used as a pump, the advancing second piston 36 shown in FIG. 1 is driven by the external source of mechanical torque so as to in effect compress and force the fluid out of the second volume B and through the outlet port 18. In order to be effective, the pump must be connected to an external source of power that can overcome the fluid pressure forces generated in the second volume space B created when the second piston 36 is advanced.

Lastly in connection with the two piston expansible chamber device shown in FIGS. 1 and 2, it should be noted that in some applications the fluids are never depleted or replenished from the first and second volumes A, B and no exchange of fluid flow into or out of the system occurs. In this case, the inlet and outlet ports 16, 18 are completely blocked. For certain chemical or thermodynamic actions, the materials contained within the volumes are alternately expanding and contracting in response to those actions. Loss of the materials out of the device is prevented by closing the inlet and outlet ports. One example of where such a process would be useful in the subject expansible chamber device is when the device is used for a Sterling or similar engines.

Figure 3:
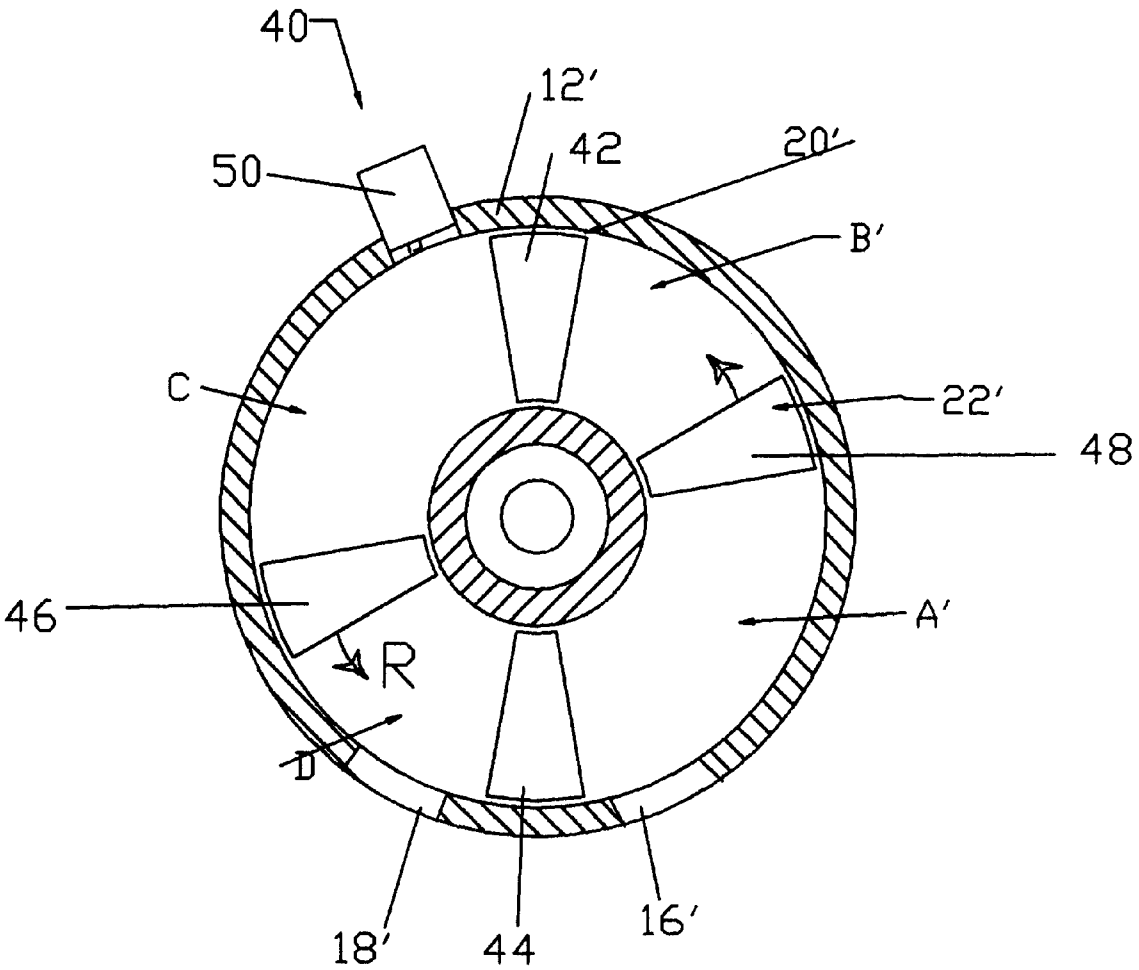
FIG. 3 is an end view taken in partial cross-section showing the overall arrangement of another expansible chamber device of the type to which the invention is directed.

FIG. 3 illustrates the subject expansible chamber device used as a 4-cycle internal combustion engine 40. Turning now to that figure, first and second interdigitated piston assemblies 20', 22' are rotatably movable in a cylindrical working chamber 14' defined by a circular housing member 12'. The first piston assembly includes a pair of diametrically opposed radial vanes forming pistons 42, 44. Similarly, the second piston assembly 22' carries a pair of diametrically opposed radial vanes forming third and fourth pistons 46, 48 in the working chamber.

Figure 4:
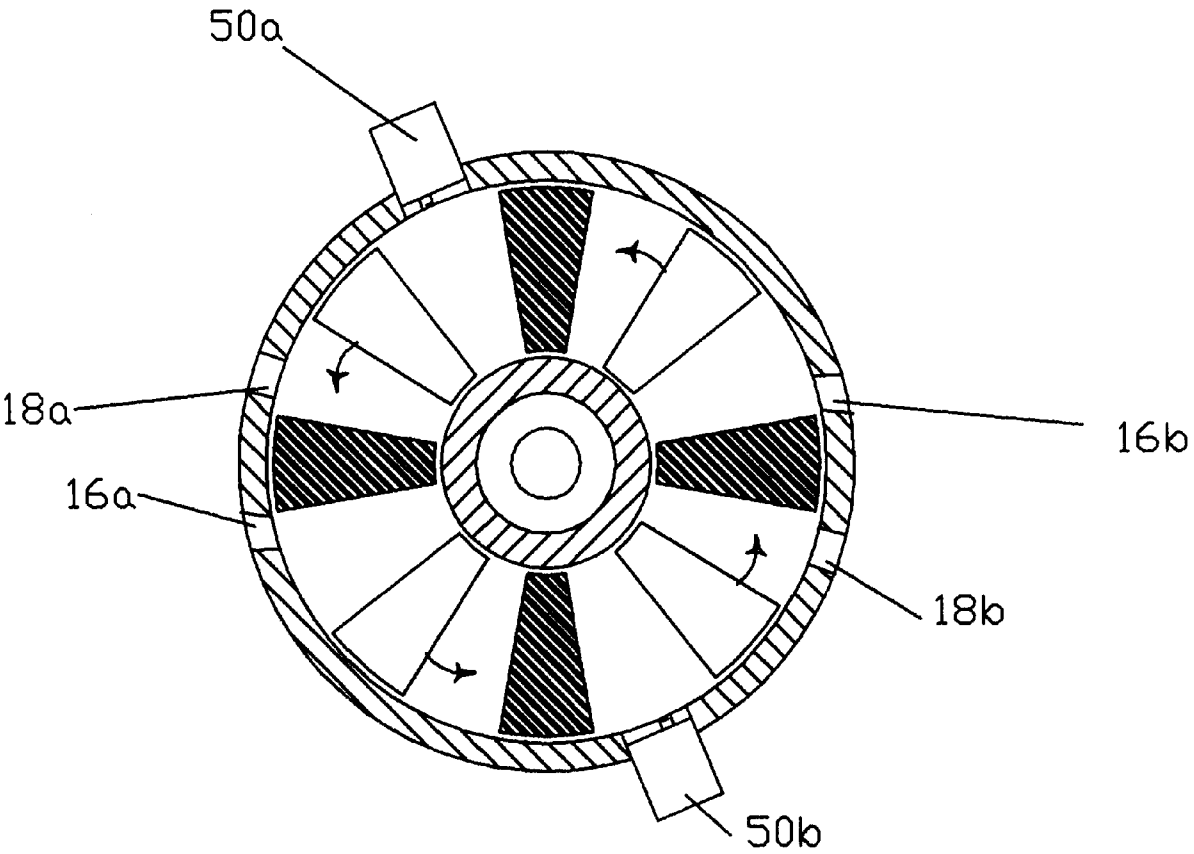
FIG. 4 is an end view taken in partial cross-section of an expansible chamber device of the type that includes a pair of spark plugs.

Also illustrated in FIG. 4, the engine 40 includes an ignition device 50, preferably a spark plug, and intake and exhaust ports 16', 18'. The first and second pistons 42, 44 are part of the first piston assembly 20', and accordingly, rotate together as a unit in a counter clockwise direction as shown. Similarly, the third and fourth pistons 46, 48 form a part of the second piston assembly 22' and, accordingly, rotate together as a unit in the same counter clockwise direction as shown in the drawing by the arrows labeled R. Side plates and shafts are used in the engine in a manner described above in connection with the device of FIGS. 1 and 2. In the piston positions illustrated in FIG. 3, the first and second pistons are stationary and the third and fourth pistons advancing. For operation as an internal combustion engine, a flammable mixture is introduced into the engine through an intake port 16' which is connected to a carburetor, fuel injector, or similar device. The fuel mixture flows into the first volume A' which is expanding as the fourth piston 48 rotates in the counter clockwise direction shown. The second volume B' contains a flammable fuel mixture that was introduced therein during a previous machine cycle.

The fuel mixture in the volume B' is being compressed in the cycle shown in FIG. 3 because the motion of the fourth piston 48 is counter clockwise with respect to the position of the stationary first piston 42. The reduction in size of the volume B' results in a compression of the flammable fuel mixture in the volume B'. When the third and fourth pistons 46, 48 are advanced sufficiently close to the first and second pistons 42, 44, the first piston assembly is released to permit counter clockwise rotation thereof. The second piston assembly is locked into the position illustrated in FIG. 3 previously occupied by the first piston assembly. As the first piston assembly moves counter clockwise, the compressed flammable fuel mixture in the volume B' is exposed to the ignition device 50. An electronic circuit senses the relative position of the first piston assembly and ignites the spark plug causing the fuel in the volume B' to ignite advancing the first piston further in the counter clockwise direction.

The volume C shown in FIG. 3 preferably contains ignited and expanding flammable fuel. The expanding fuel mixture in the third volume C causes the third piston 46 to advance in the counter clockwise rotation as shown. The motion of the third piston in the direction shown correspondingly urges the fourth piston to move because they are connected as described above.

The fourth volume D shown in FIG. 3 contains burned residue left behind from a previous ignition cycle. The motion of the third piston 46 in the counter clockwise direction towards the second piston 44 causes the material in the fourth volume D to be compressed and vent from the chamber 14' through the outlet port 18'.

FIG. 4 shows that a 4-cycle internal combustion engine can be formed having four pairs of pistons. A pair of ignition devices 50*a*, 50*b* are provided along with a pair of intake ports 16*a*, 16*b* and a pair of exhaust ports 18*a*, 18*b*. One significant advantage of the construction shown in FIG. 4 is that all of the pressure loads developed within the engine are well balanced. Accordingly, the bearing loads are substantially reduced and wear thereon decreased. In order to strike the preferred load balance, even pairs of pistons are provided. That is, four pistons per piston assembly, and so on.

Figure 5:
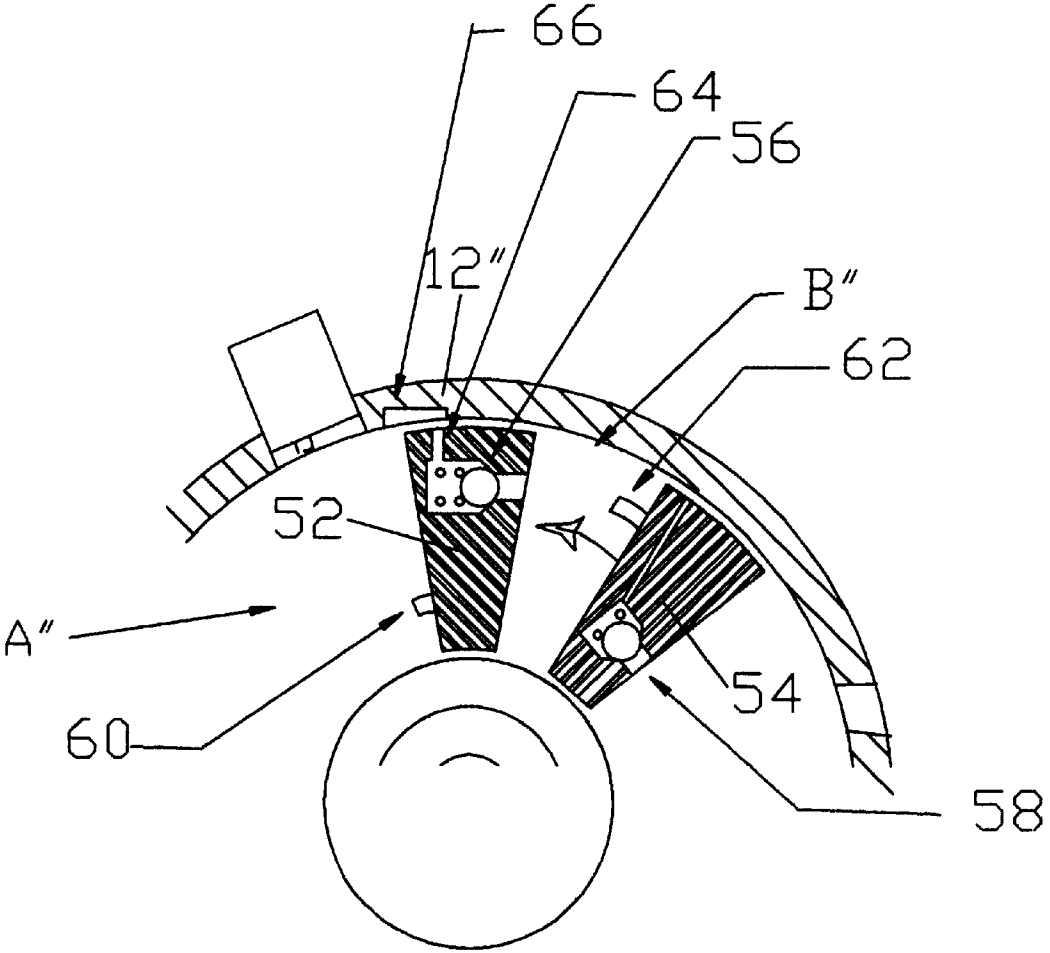
FIG. 5 is an end view in partial cross-section illustrating an ignition mechanism for use in an expansible chamber internal combustion engine.

FIG. 5 illustrates an ignition mechanism that takes advantage of the close proximity of the chamber containing the ignited fuel to the chamber containing the compressed fuel inherent in expansible chamber devices of the type described. Referring now to that figure, a static piston 52 is held in the position illustrated as a rotating piston 54 is advanced counter clockwise. A first volume A" contains ignited and expanding fuel and a second volume B" contains compressed fuel. A pair of check valves 56, 58 are provided on the pistons along with a pair of extension tabs 60, 62 as shown. A passage 64 provided on the static piston 52 is adapted to communicate fluids between the second volume B" and a bypass chamber 66 formed in the housing 12" when the check valve 56 is open. As the rotating piston 54 approaches the static piston 52, the extension tab 62 on the rotating piston 54 opens the check valve 56 on the static piston 52 in a well known manner. Fluid communication is thereby established between the first and second volumes A", B". When this happens, some of the burning fuel mixture in the first volume A" flows into the second volume B" igniting the compressed fuel mixture therein.

Figure 6:
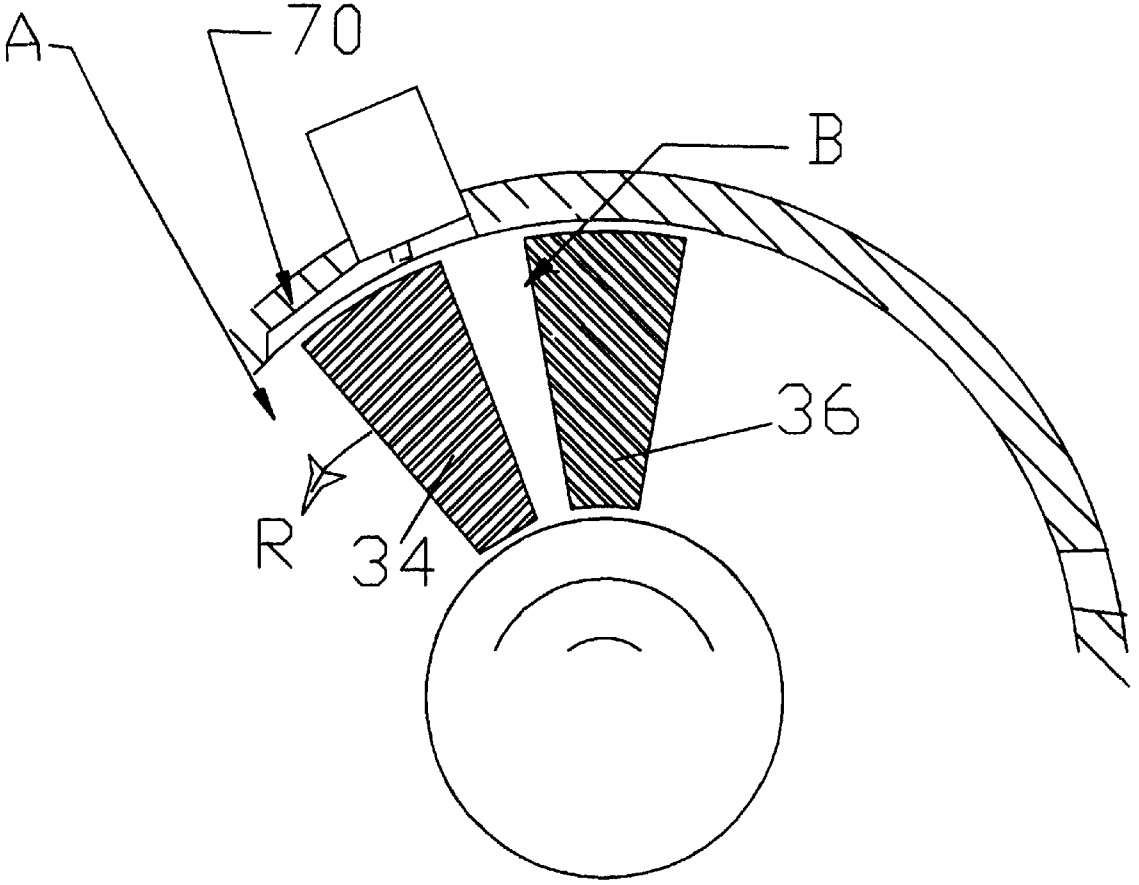
FIG. 6 is an end view in partial cross-section showing an alternative preferred fuel injection method for use in expansible chamber internal combustion engines.

FIG. 6 shows an alternative preferred fuel ignition method wherein a bypass passage 70 is provided on the inner wall of the housing of the internal combustion engine. As the first piston 34 passes the bypass passage 70 such as at the position illustrated in the figure, a fluid communication is established between the first volume A and the second volume B. When the first volume A contains hot expanding gases, the fluid communication of those hot gases into the second volume B enables the detonation of the fuel mixture within the second volume B. Although the bypass passage 70 is illustrated as being formed on the inner face of the outer circular wall of the housing 12, it can also be located on external or side walls of the device. In addition, it is to be noted that the bypass passage 70 is preferably strategically located so as to control the combustion rate and characteristics of the flame front traveling into the second volume B.

Figure 7:
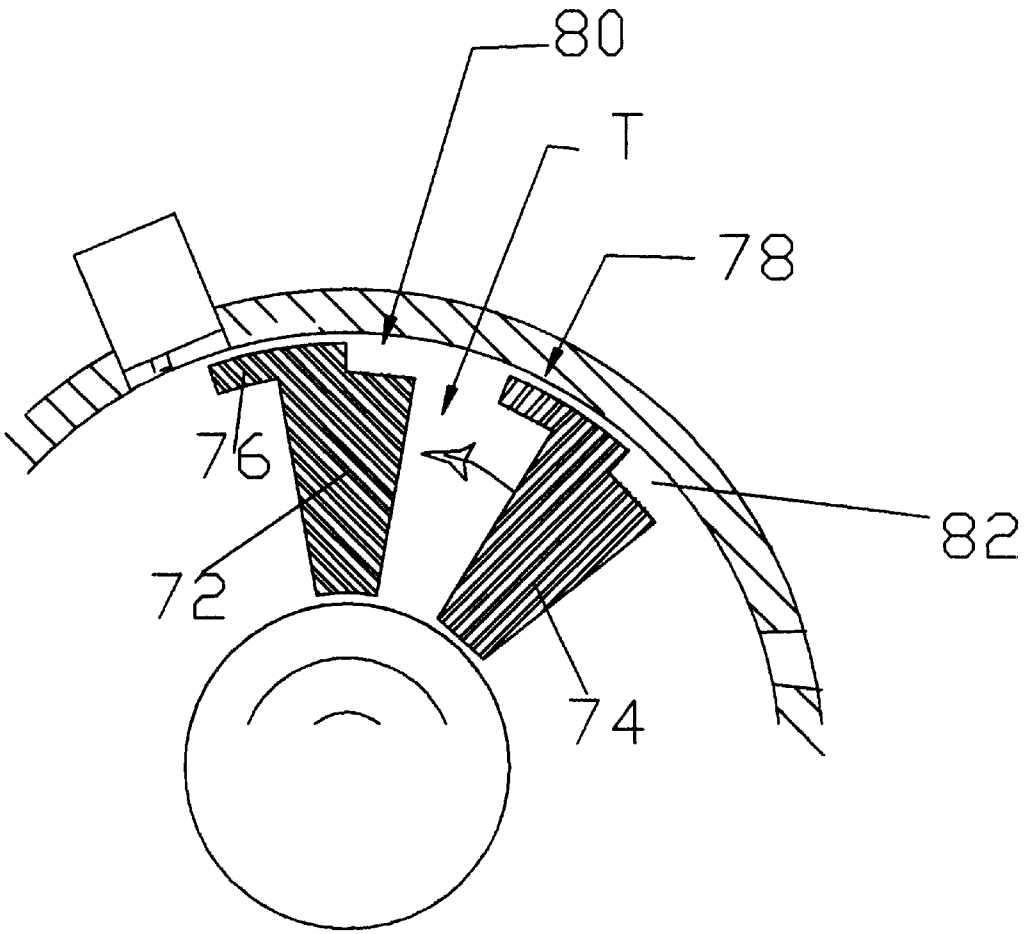
FIG. 7 illustrates a diesel ignition system adapted for use in an expansible chamber internal combustion diesel engine.
Figure 8:
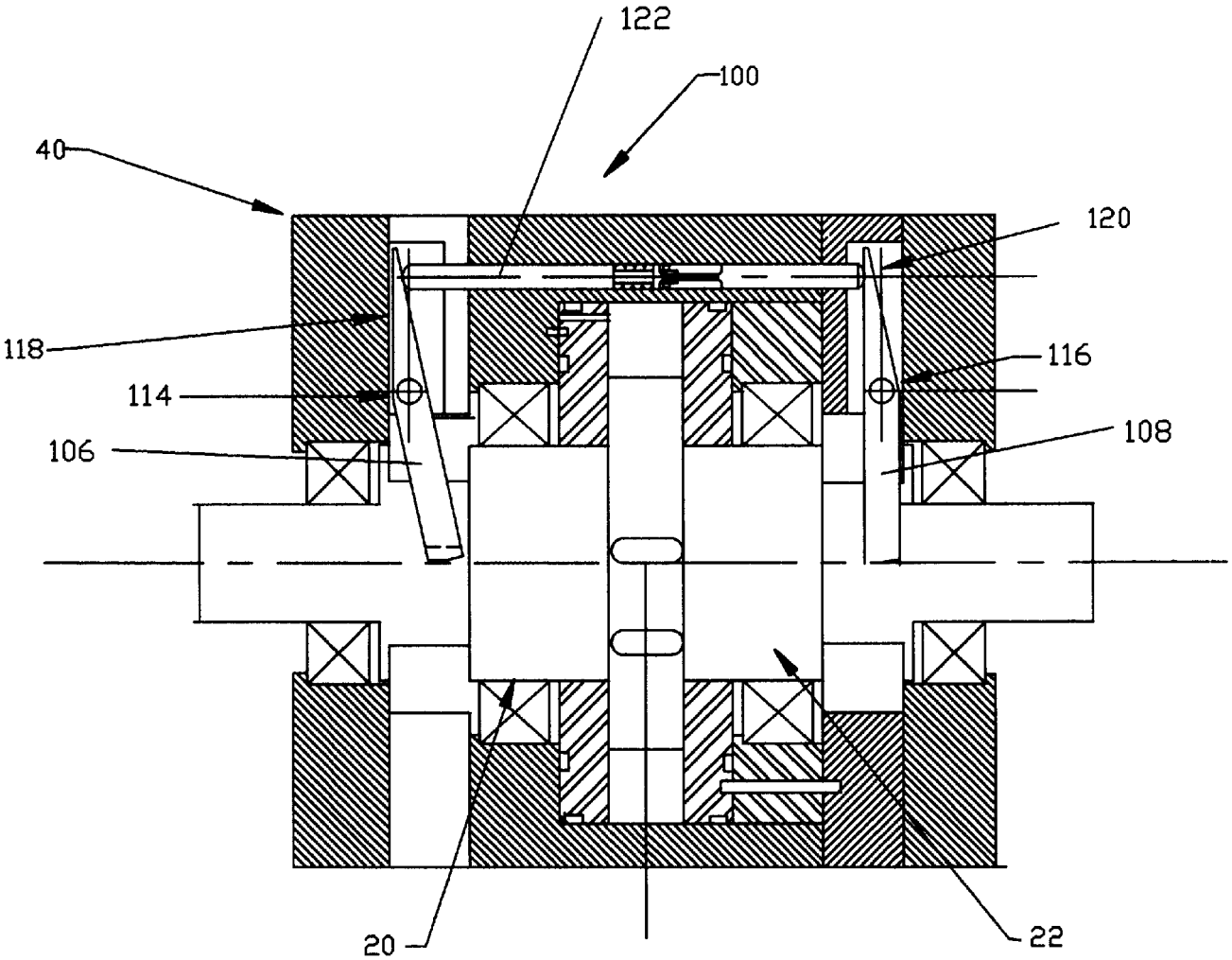
FIG. 8 is a side view taken in partial cross-section showing the subject braking system of the present invention adapted for use in an expansible chamber device.

FIG. 7 illustrates a diesel ignition system. Turning now to that figure, each piston 72, 74 is provided with a lead hammer member 76, 78, respectively and a trailing pocket recess 80, 82 as shown. The hammer members and pocket recesses are sized and positioned so that they are interengageable as the first and second piston 72, 74 come together. In operation, a small quantity of fluid becomes trapped in the pocket recesses 80, 82. As the pistons 72, 74 come together as illustrated, the pressure in the pocket recess 80 significantly exceeds of the pressure in the chamber B formed between the pistons. In position illustrated in FIG. 7, the fluid in the volume B initially is highly compressed and, further, the fluid in the pocket recess 80 undergoes further substantial compression as the hammer member 76 extends into the pocket recess 80. The higher compression ratio established in the pocket recess through the interaction of the hammer member with the recess results in a higher temperature there causing ignition to occur. The ignition in the pocket recess can be further enhanced as needed through the use of a catalyst located in either volume A or B or both. After the fuel is ignited in the pocket recess 80, the first piston 72 advances counter clockwise opening the pocket recess to the second volume B thus initiating the ignition of the entire fuel mixture in the second volume B.

As noted above, a braking mechanism is used for stopping the moving pistons in the desired position and holding them there stationary between periods of rotation to cause intermittent rotation of piston assembly pairs. Although the braking function can be accomplished in several ways including electromechanical, hydraulic, mechanical, or any combination thereof, the preferred braking mechanism of the instant invention is illustrated in FIGS. 8, 9*a*–9*g*, and 10. Referring now to those figures, the preferred braking mechanism 100 is shown used in conjunction with a 4-cycle internal combustion engine 40 of the type described above. A housing 12 defines a cylindrical working chamber 14 having intake and exhaust ports 16, 18. First and second interdigitated piston assemblies 20, 22 are rotatably movable in the cylindrical working chamber. Each of the piston assemblies include at least one pair of diametrically opposed radial vanes forming pistons in the working chamber. In the internal combustion engine illustrated, the first piston assembly 20 carries first and second pistons 42 and 44. Similarly, the second piston assembly 22 carries third and fourth radially extending third and fourth pistons 46, 48. The pistons divide the working chamber into a plurality of pairs of diametrically opposed compartments.

The preferred braking mechanism 100 formed in accordance with the present invention controls the motion of the piston assemblies to cause intermittent rotation of the first and second piston assemblies in the same direction during the current periods of rotation with each of the first and second piston assemblies being stopped between the periods of rotation. The braking mechanism includes a first set of cam surfaces 102 disposed on the first piston assembly 20 as best shown in FIGS. 9*a*–9*g*. A second set of cam surfaces 104 are similarly disposed on the second piston assembly 22 as shown in those figures. First and second elongate pivotable members 106, 108 include first ends 110, 112 adapted to engage the first and second set of cam surfaces 102, 104, respectively. Further, each of the first and second elongate pivotable members 106, 108 are rotatable about first and second rotation points 114, 116, respectively. The second ends 118, 120 of the first and second elongate pivotable members 106, 108 are adapted to engage an elongate slidable member 122 so that motion of a one or the other of the elongate pivotable members causes a corresponding motion in the other of the elongate pivotable members, preferably in the motion sequence illustrated in FIGS. 9*a*–9*g*. The operational sequencing of the braking mechanism 100 of the present invention will be described in detail with reference to those figures together with Table I below.

The slidable member 122 is preferably oriented within the internal combustion engine 40 in a manner that its longitudinal axis S is parallel to the longitudinal axis L defined by the first and second rotatable piston assemblies 20, 22. In addition, a line connecting the first and second rotation points 114, 116 is also preferably parallel to the longitudinal axis L of the piston assemblies to ensure that the motion between the numbers 106, 108 1:1.

Figure 10:
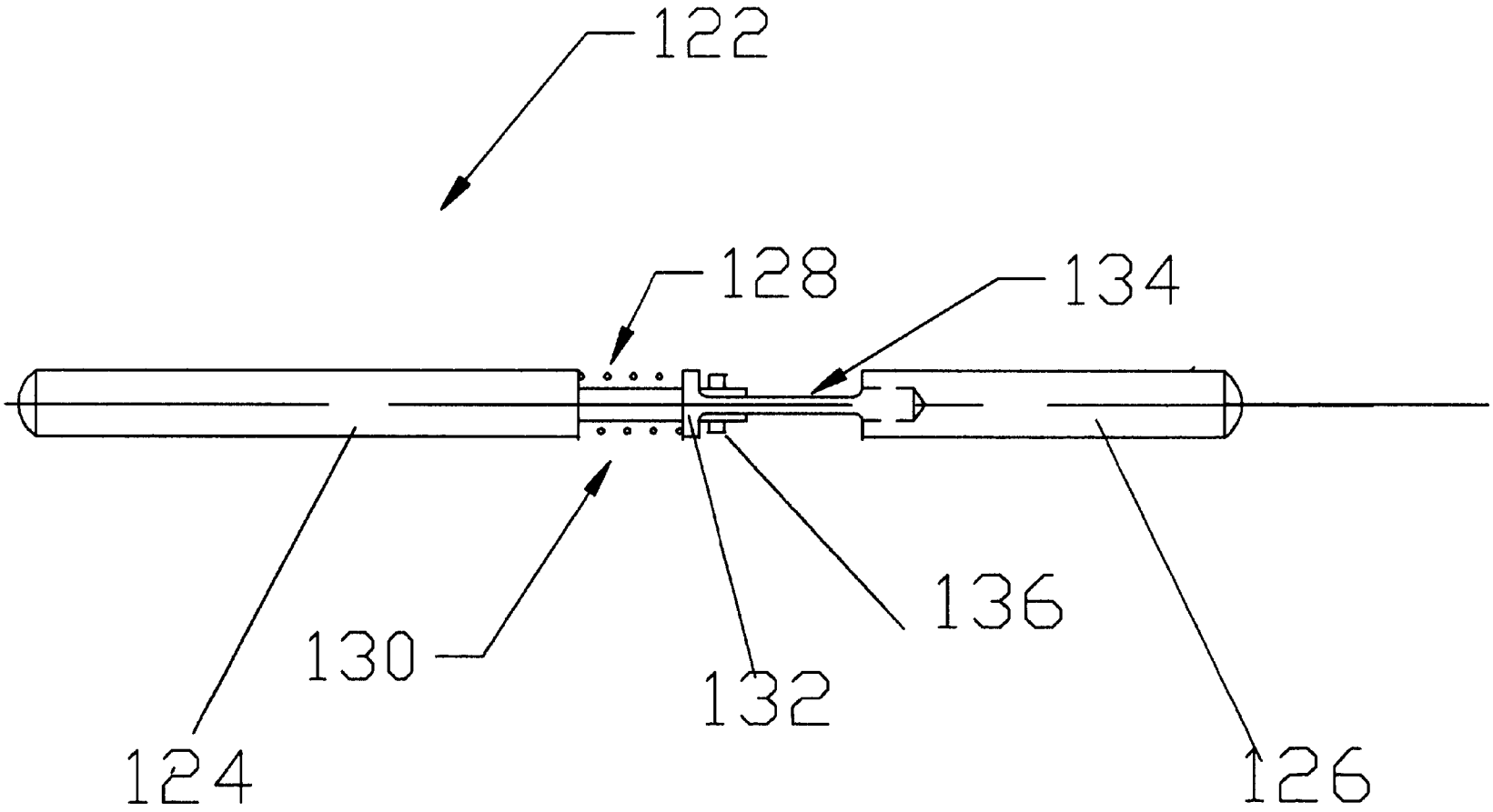
FIG. 10 is an elevational view of a slidable member used in the braking mechanism shown in FIGS. 8 and 9*a*–9*g* and having a damping spring.

Although a solid shaft type slidable member would function adequately, in its preferred form, the slidable member 122 of the invention is constructed as best illustrated in FIG. 10. As shown there, the slidable member is formed as the combination of first and second rod members 124, 126 that are connected together by an intermediate damping spring member 128 to permit relative slidable motion between the first and second rod members. The first rod member 124 includes a reduced diameter region 130 that is sized to accommodate the damping spring member thereon. The spring member is held between the end of the reduced diameter region on the first rod member 124 and an annular connecting member 132 carried on a set of spaced apart arms 134 extending longitudinally from the second rod member 126. The arms are positioned around the second rod member in a manner leaving a gap to permit longitudinal motion of the reduced diameter region 130 therewithin. A locking pin 136 holds the first and second rod members together against force of the damping spring member 128.

With continued reference once again to FIGS. 8 and 9*a*–9*g*, the first set of cam surfaces 102 preferably includes a first pair of ramp surfaces 140, 142 and a first pair of stop blocks 144, 146 arranged on the first piston assembly 20 as shown. Similarly, the second set of cam surfaces 104 includes a second pair of ramp surfaces 148, 150 and a second pair of stop blocks 152, 154 carried on the second piston assembly 22 as shown.

Figure 9A:
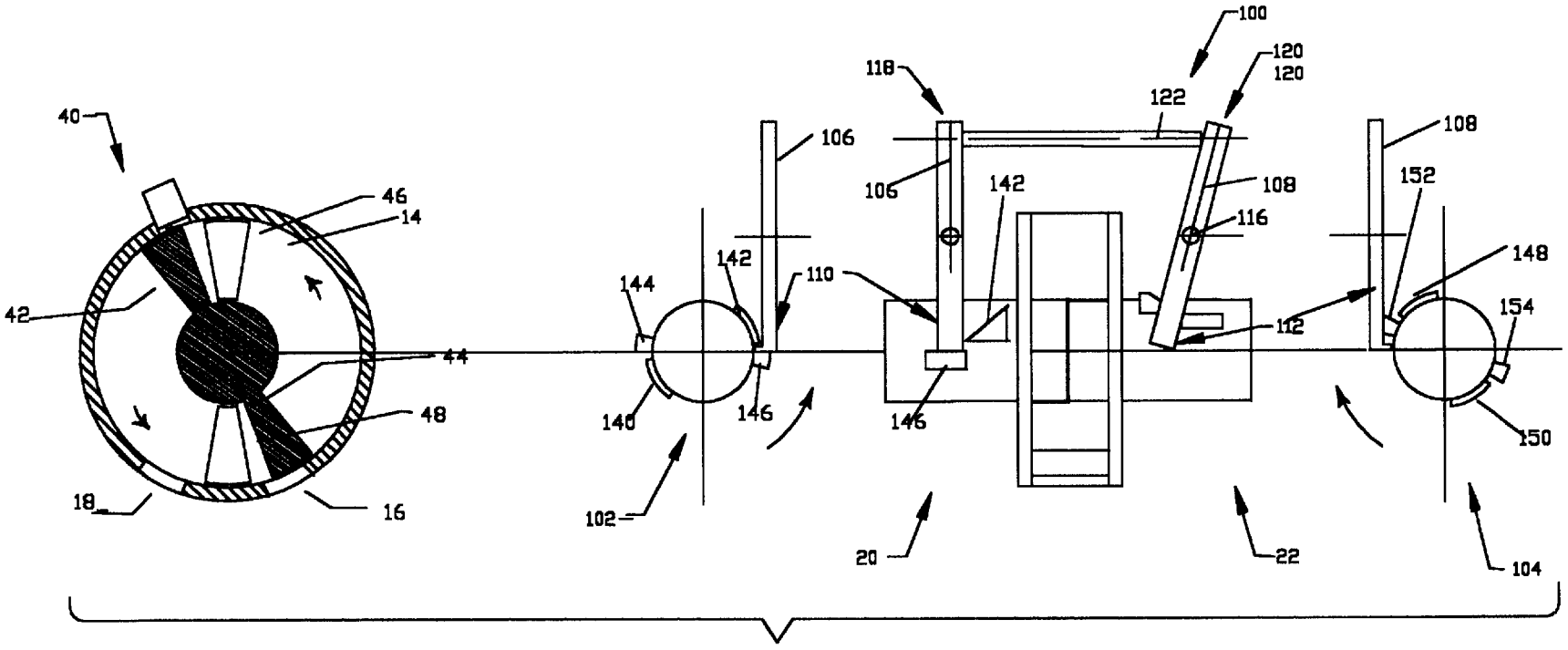
FIGS. 9*a*–9*g* are a series of end views taken in partial cross-section illustrating the sequence of operating the preferred braking mechanism formed in accordance with the present invention.
Figure 9B:
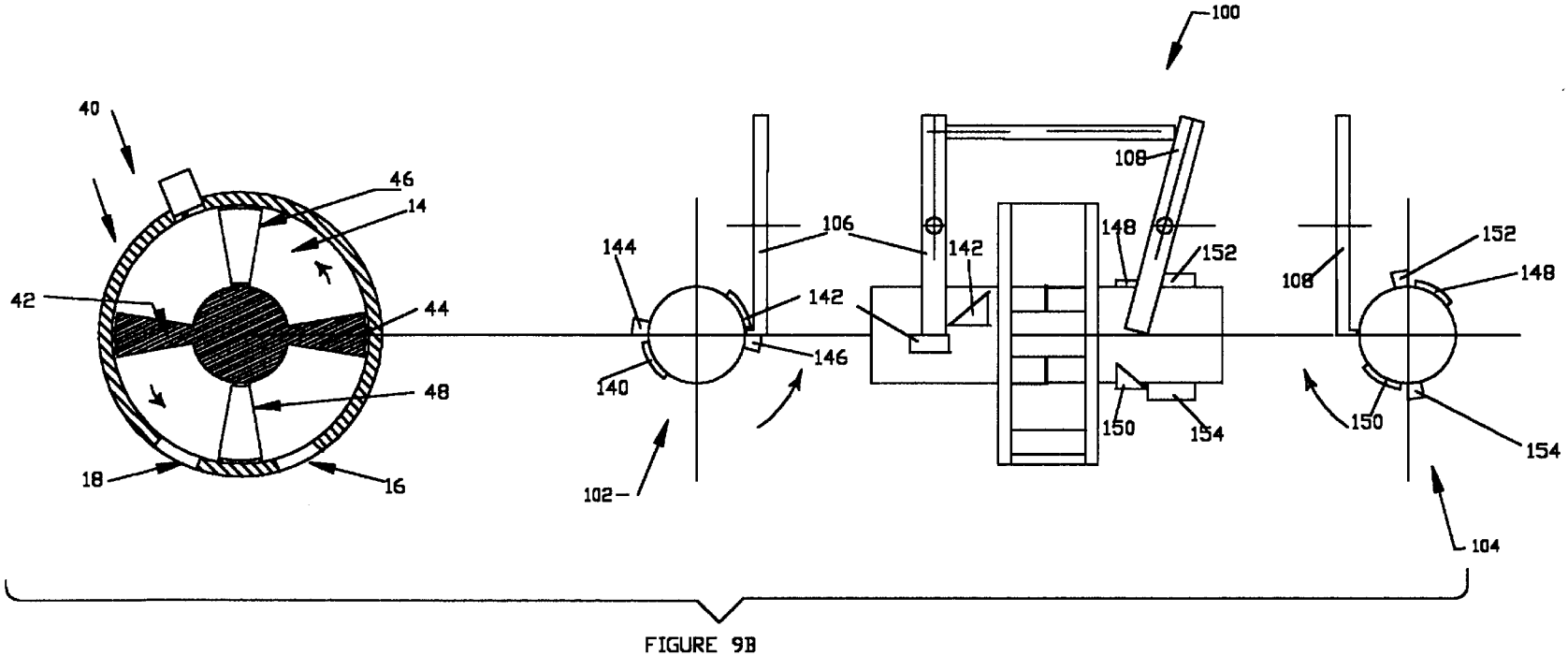
Figure 9C:
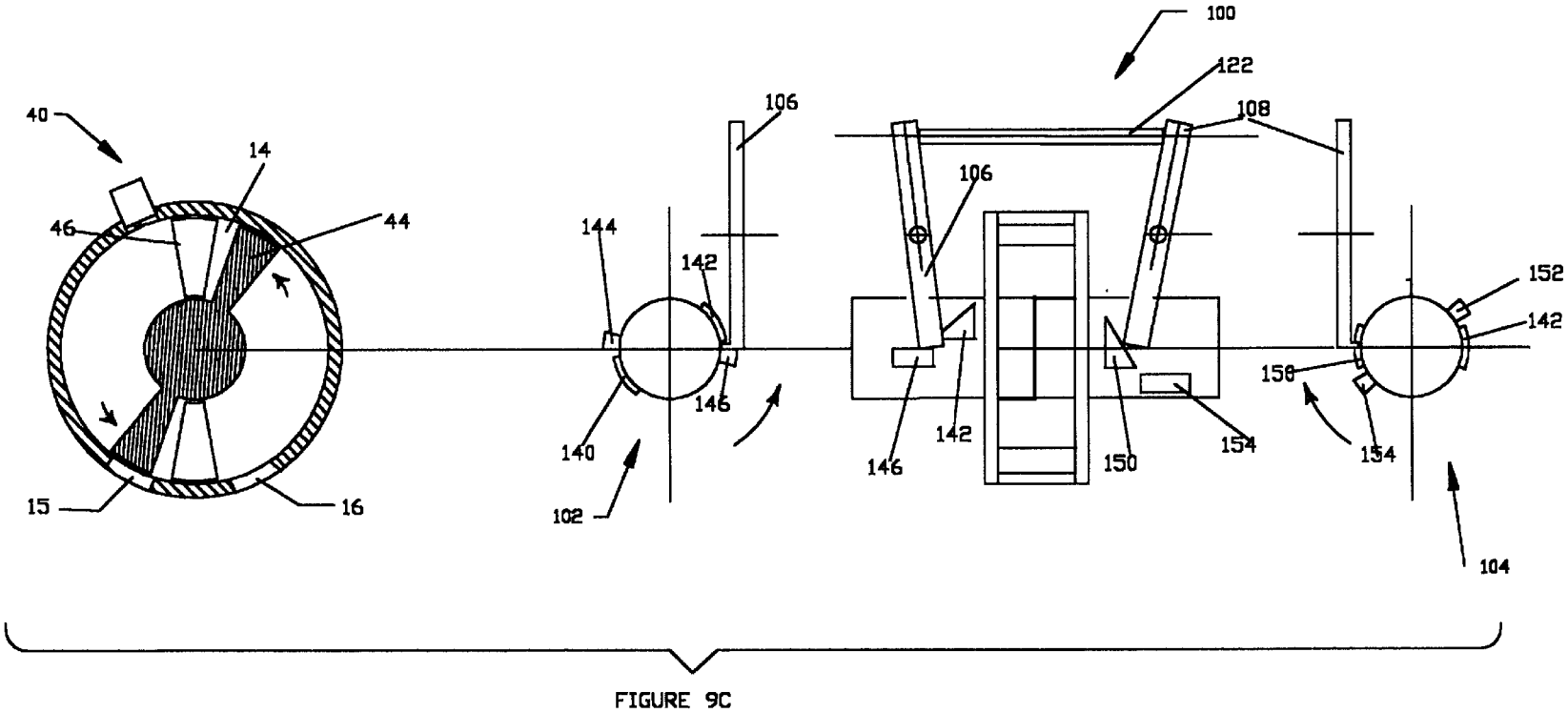
Figure 9D:
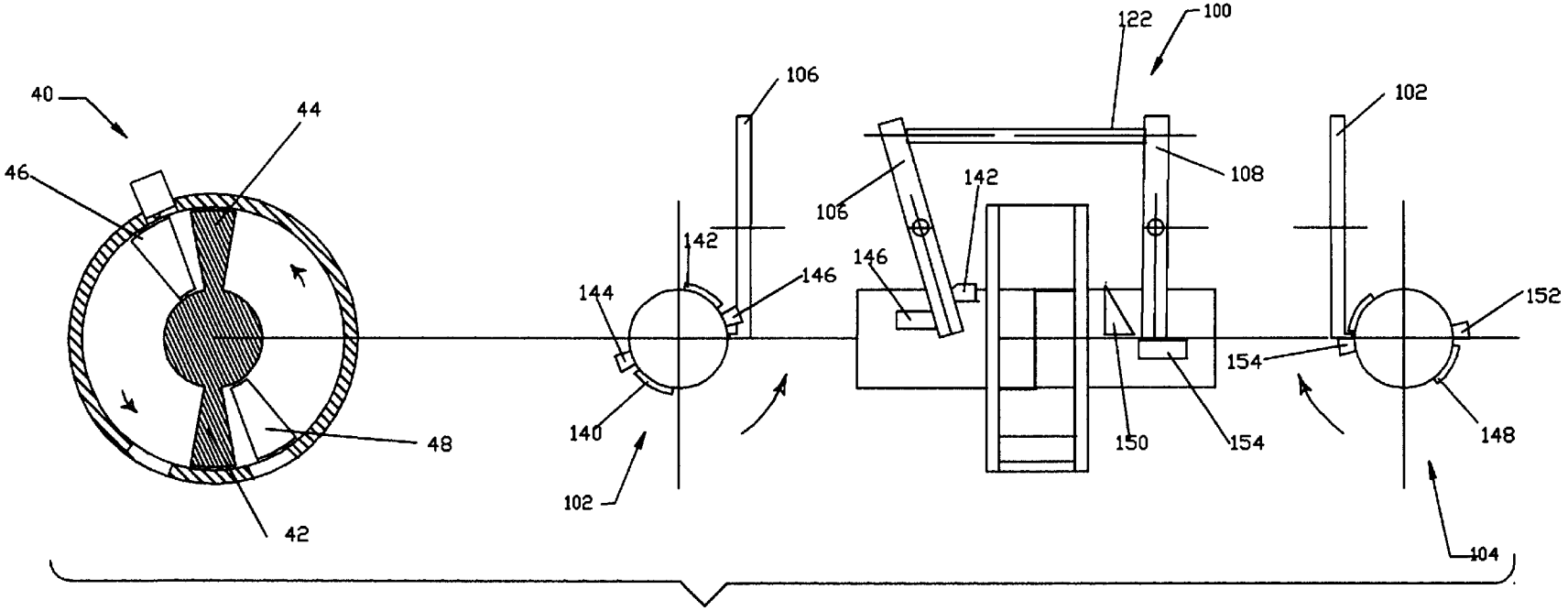
Figure 9E:
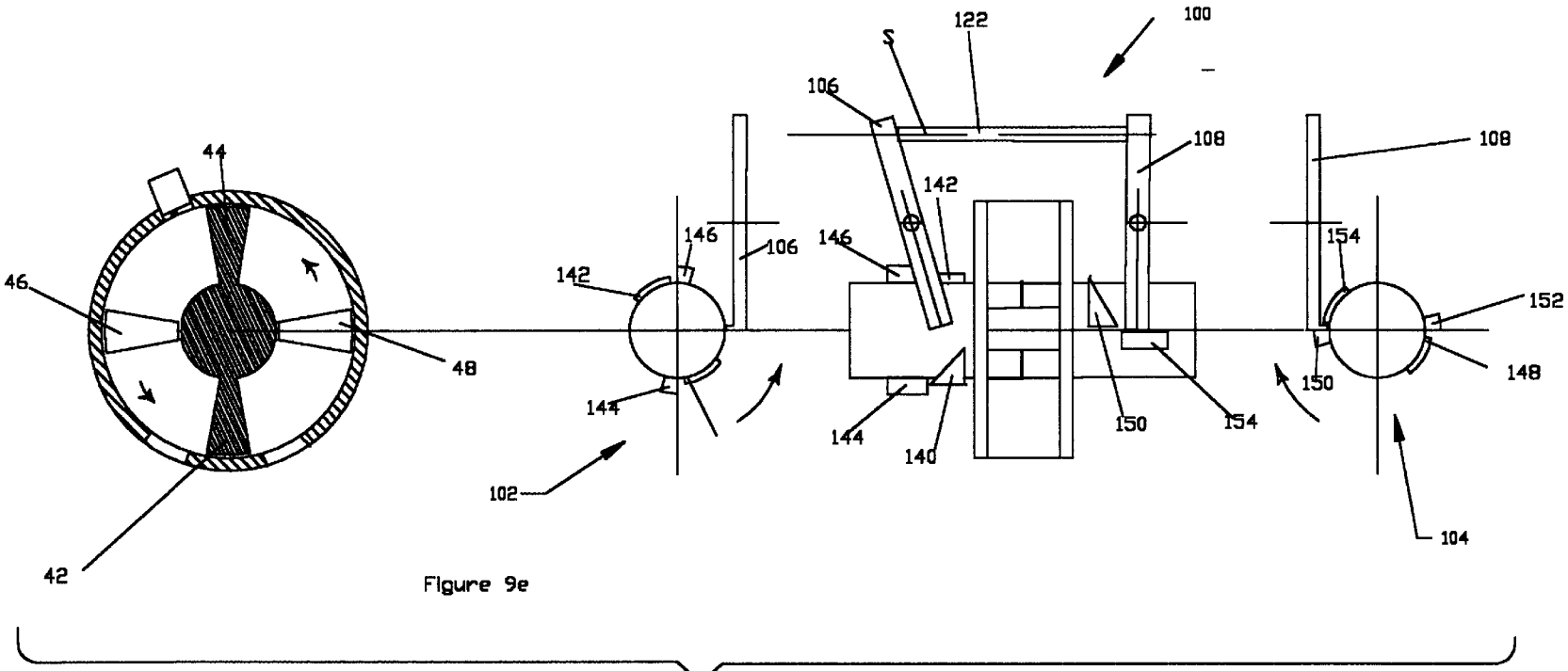
Figure 9F:
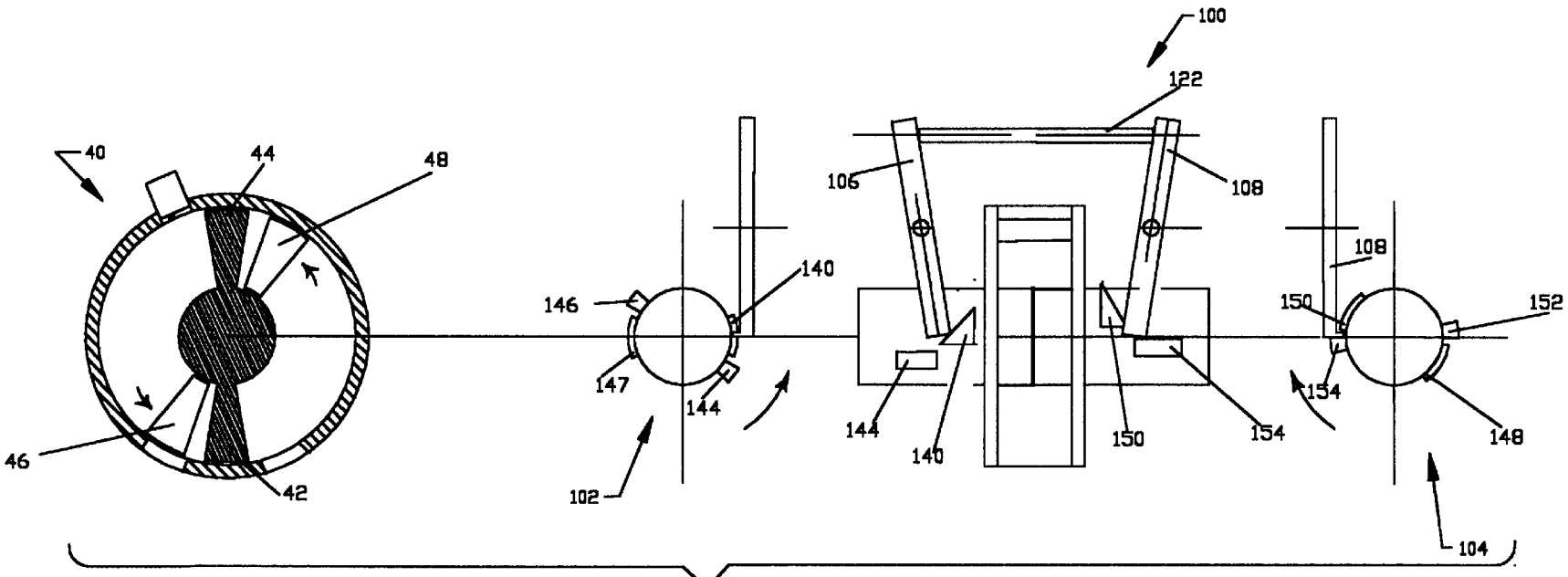
Figure 9G:
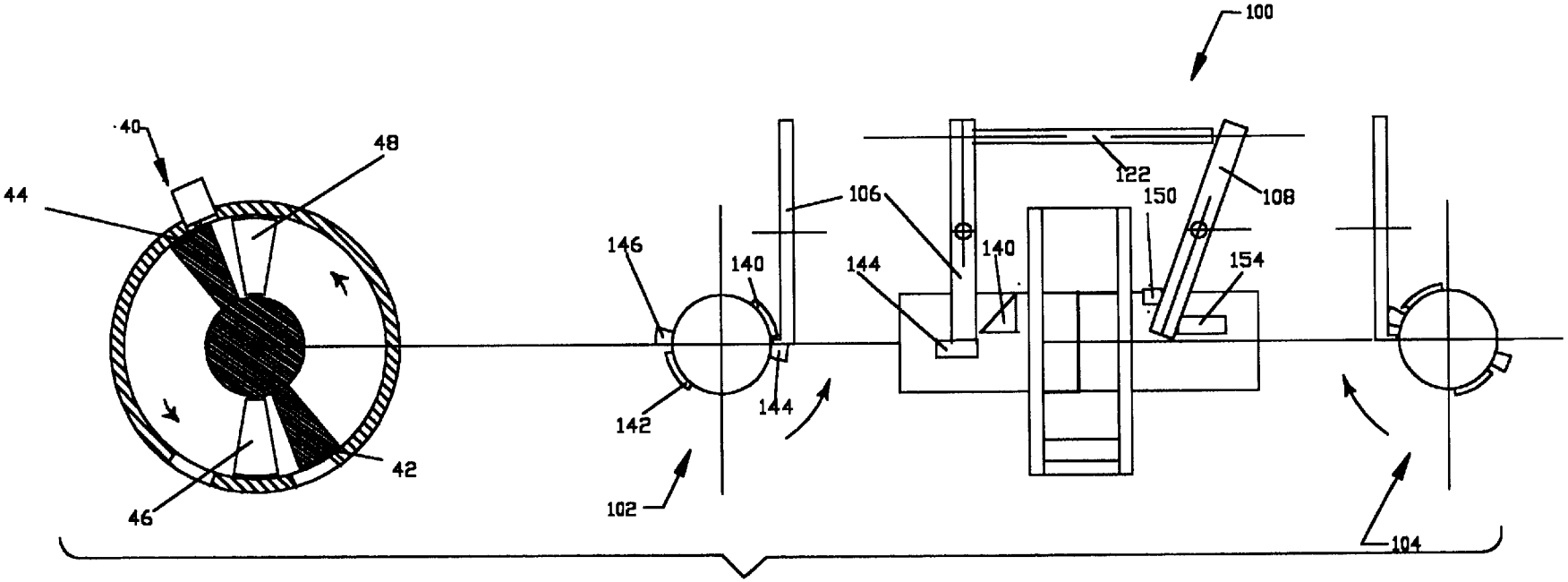

The first pair of stop blocks 144, 146 are adapted to selectively engage the first end 110 of the first pivotable member 106 when the first pivotable member is in a first position shown in FIGS. 9*a*, 9*b*, and 9*g*. When the first end of the first pivotable member is engaged with either one of the first pair of stop blocks, the rotation of the first piston assembly 20 is stopped.

Similar to the above, the second pair of stop blocks 152, 154 are adapted to selectively engage the first end 112 of the second pivotable member 108 when the second pivotable member is in a first position shown in FIGS. 9*d* and 9*e*. When the first end of the second pivotable member is engaged with either one of the second pair of stop blocks, the rotation of the second piston assembly 22 is prevented.

The first pair of ramp surfaces 140, 142 disposed on the first piston assembly are adapted to engage the first end 110 of the first pivotable member 106 when the first pivotable member is in a second position opposite the first position as shown best in FIGS. 9*d*, 9*e*, and 9*f* When the first end of the first pivotable member engages either one of the ramp surfaces provided on the rotating first piston assembly 20, the first pivotable member is urged from the second position shown in FIGS. 9*d*, 9*e*, and 9*f* into the first position shown in FIGS. 9*a*, 9*b*, and 9*g*. As the first pivotable member is moved from the second position to the first position, the second pivotable member is moved as well through the linear motion of the slidable member 122. More particularly, as the first pivotable member moves from the second position to the first position, the second pivotable member moves from its first position shown in FIGS. 9*d* and 9*e* into its second position shown in FIGS. 9*a*, 9*b*, and 9*g*.

The second pair of ramp surfaces 148, 150 provided on the second rotating piston assembly 22 are adapted to engage the first end 112 of the second pivotable member 108 when the second pivotable member is in a second position opposite the first position as shown best in FIGS. 9*a*, 9*b*, and 9*g*. As the first end of the second pivotable member engages either of the second pair of ramp surfaces, the second pivotable member is urged from the second position the first position shown in FIGS. 9*d* and 9*e*. Simultaneous with the movement of the second pivotable member from the second position to the first position, the first pivotable member moves to its second position shown best in FIGS. 9*d* and 9*e*.

The Table I below summarizes the sequencing of the preferred braking mechanism 100 of the present invention described above and illustrated in FIGS. 9*a*–9*g*.

TABLE I

| FIG. | FIRST PISTON ASSEMBLY | SECOND PISTON ASSEMBLY | FIRST PIVOTABLE MEMBER | SECOND PIVOTABLE MEMBER |
|---|---|---|---|---|
| 9a | Locked | Free | First Position | Second Position |
| 9b | Locked | Free | First Position | Second Position |
| 9c | Locked | Free | Sliding OFF Stop Block | Sliding ON Ramp Member |
| 9d | Free | Locked | Second Position | First Position |
| 9e | Free | Locked | Second Position | First Position |
| 9f | Free | Locked | Sliding ON Ramp Member | Sliding ON Stop Block |
| 9g | Locked | Free | First Position | Second Position |

Figure 11:
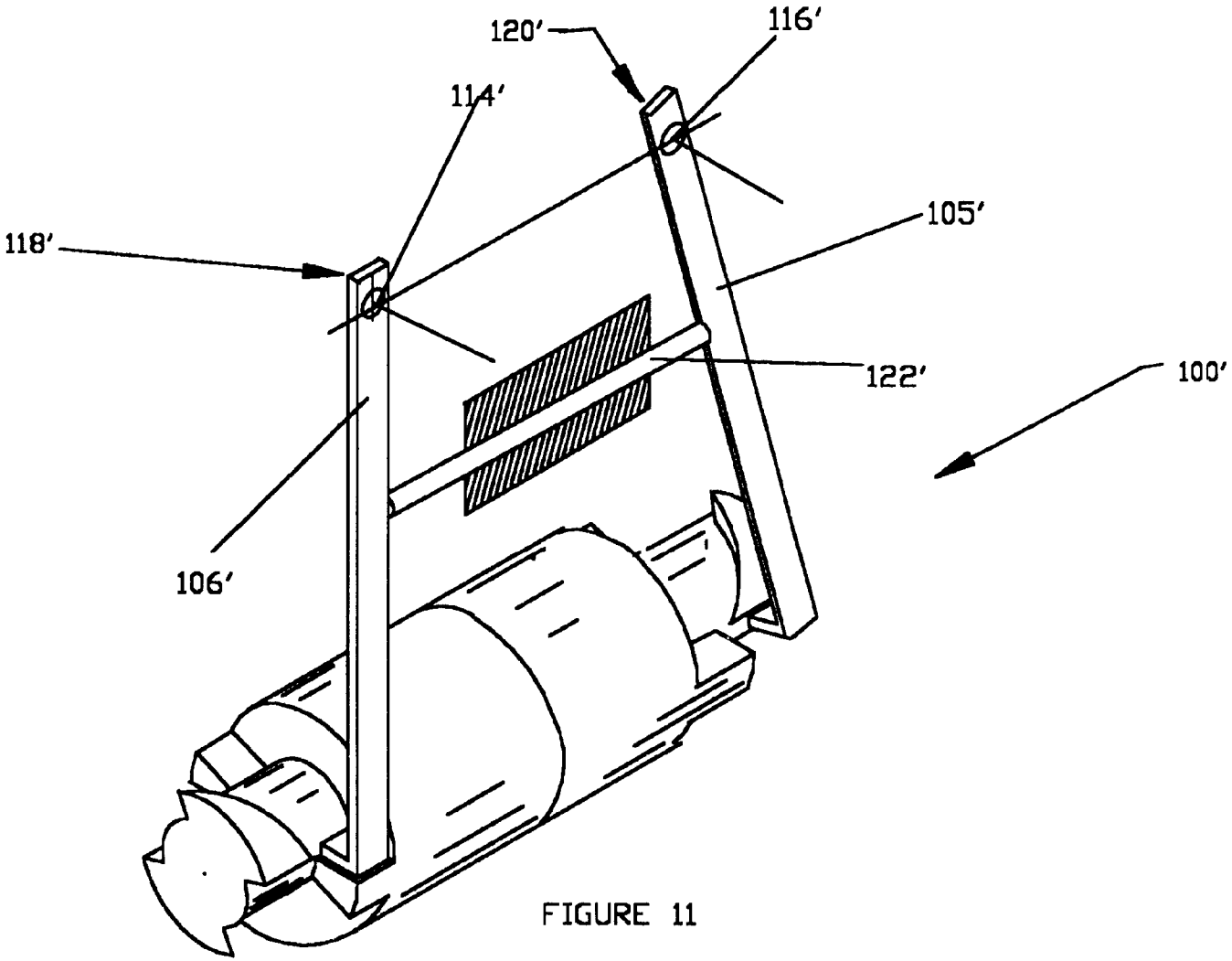
FIG. 11 is a perspective illustration of a second preferred braking mechanism formed in accordance with the present invention.
Figure 12:
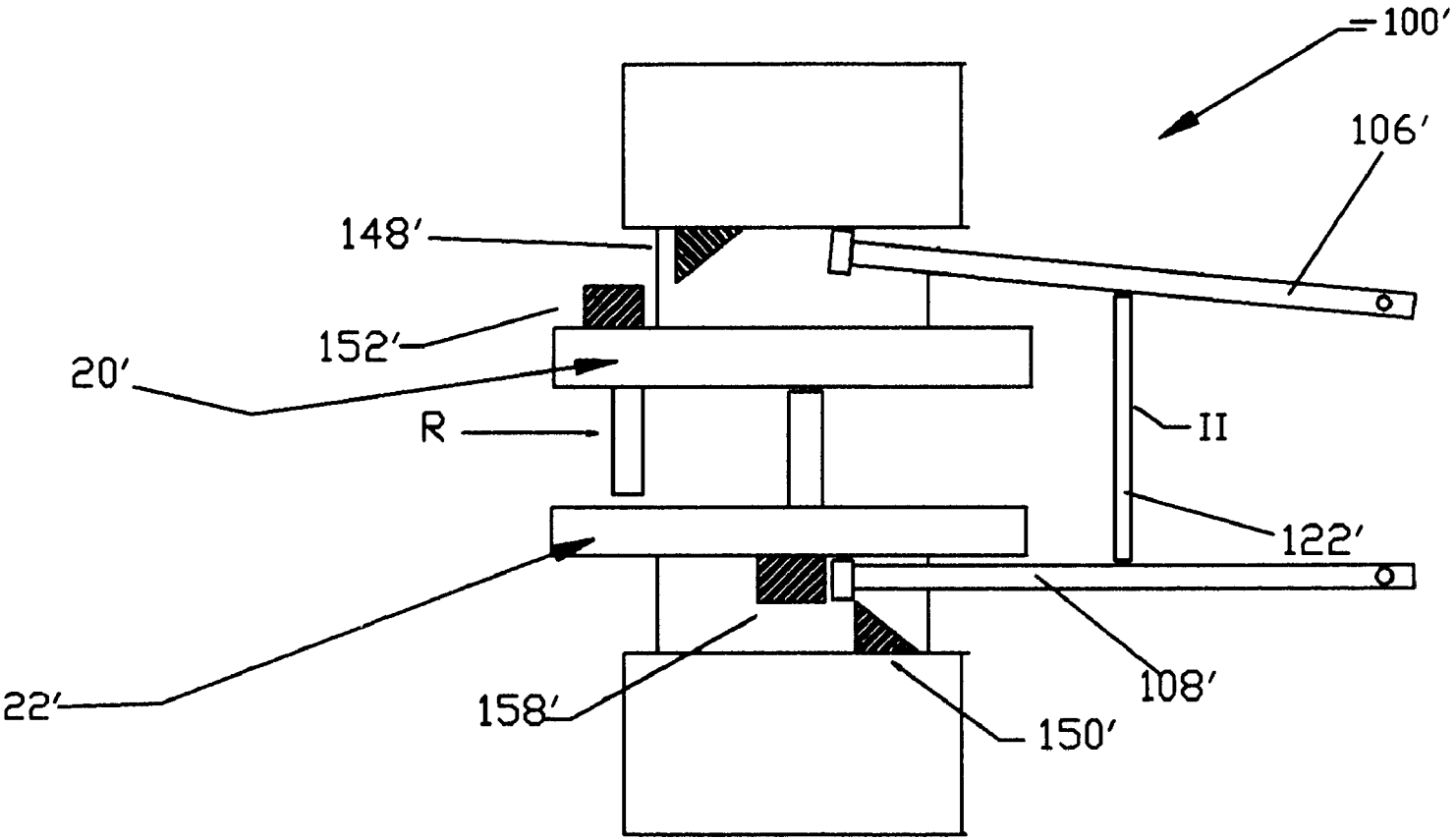
FIG. 12 is a schematic illustration of the braking mechanism shown in FIG. 11 for schematically describing the operation thereof.
Figure 13:
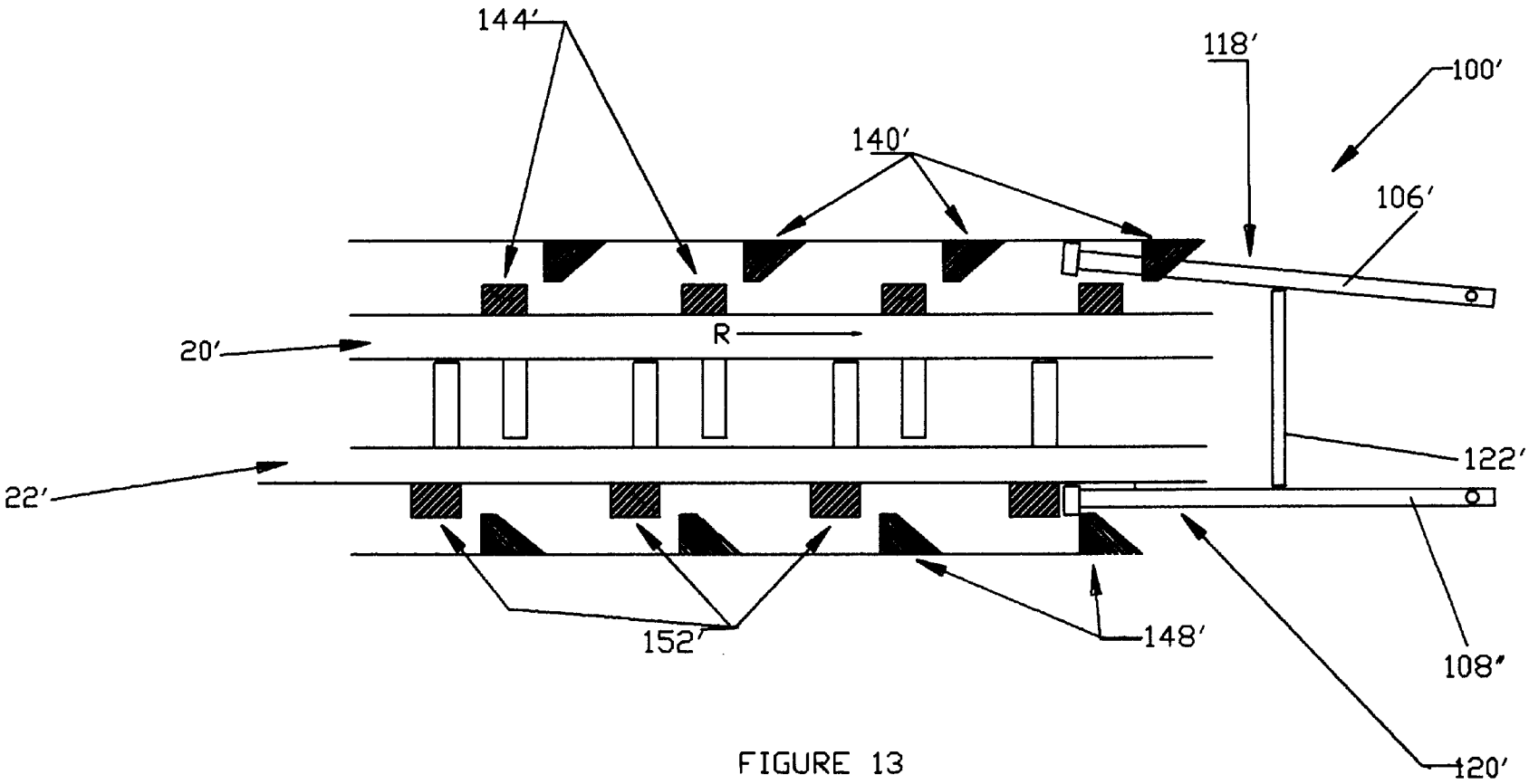
FIG. 13 is a schematic illustration of the operation of the braking mechanism of FIG. 11 describing the operational sequence thereof.

FIGS. 11, 12 and 13 illustrate a second braking mechanism 100' formed in accordance with a second preferred embodiment of the invention. With reference now to those figures, it can be seen that the first and second rotation points 114', 116' of the first and second elongate pivotable members 106', 108' are formed at the extreme second ends 118', 120' thereof rather than near the midpoints as in the first embodiment. The second slidable member 122' engages the first and second elongate pivotable member 106', 108' generally between the first and second ends of the elongate pivotable members as shown. The figures show that rotational movement of either one of the elongate pivotable members causes a corresponding movement in the other of the elongate pivotable members through the mechanical interconnection of the slidable member 122' attached therebetween.

The braking mechanism 100' formed in accordance with the second preferred embodiment of the invention is illustrated in FIG. 13 as an "unfolded" sequence of rotating piston assemblies. As shown, the first piston assembly 20' includes a first set of ramp surfaces 140' and a first set of stop blocks 144' arranged as illustrated. The second piston assembly 22' carries a second set of ramp surfaces 148' and a second set of stop blocks 152'. The ramps and stop blocks are arranged to engage the second ends 118', 120' of the elongate pivotable members 106', 108' substantially in a manner as described above. In FIG. 13, the second pivotable member 108' is shown in its first position and the second pivotable member 106' is shown in its second position. Accordingly, the second piston assembly 22' is held stationary and prevented from rotating. However, the first piston assembly 20' is not held stationary and, accordingly, advances in the direction labeled R in the figures. The set of ramp surfaces 140' advancing with the rotating the first piston assembly 20' engage the second end 118' of the first elongate pivotable member 106' urging that member towards its first position whereat the first set of stop blocks 144' are engaged to prevent further rotation of the first piston assembly. Simultaneous with the movement of the first pivotable member, the second elongate pivotable member 108' is moved off the second set of stop blocks and into its second position to permit the free rotation of the second piston assembly 22'.

Figure 14:
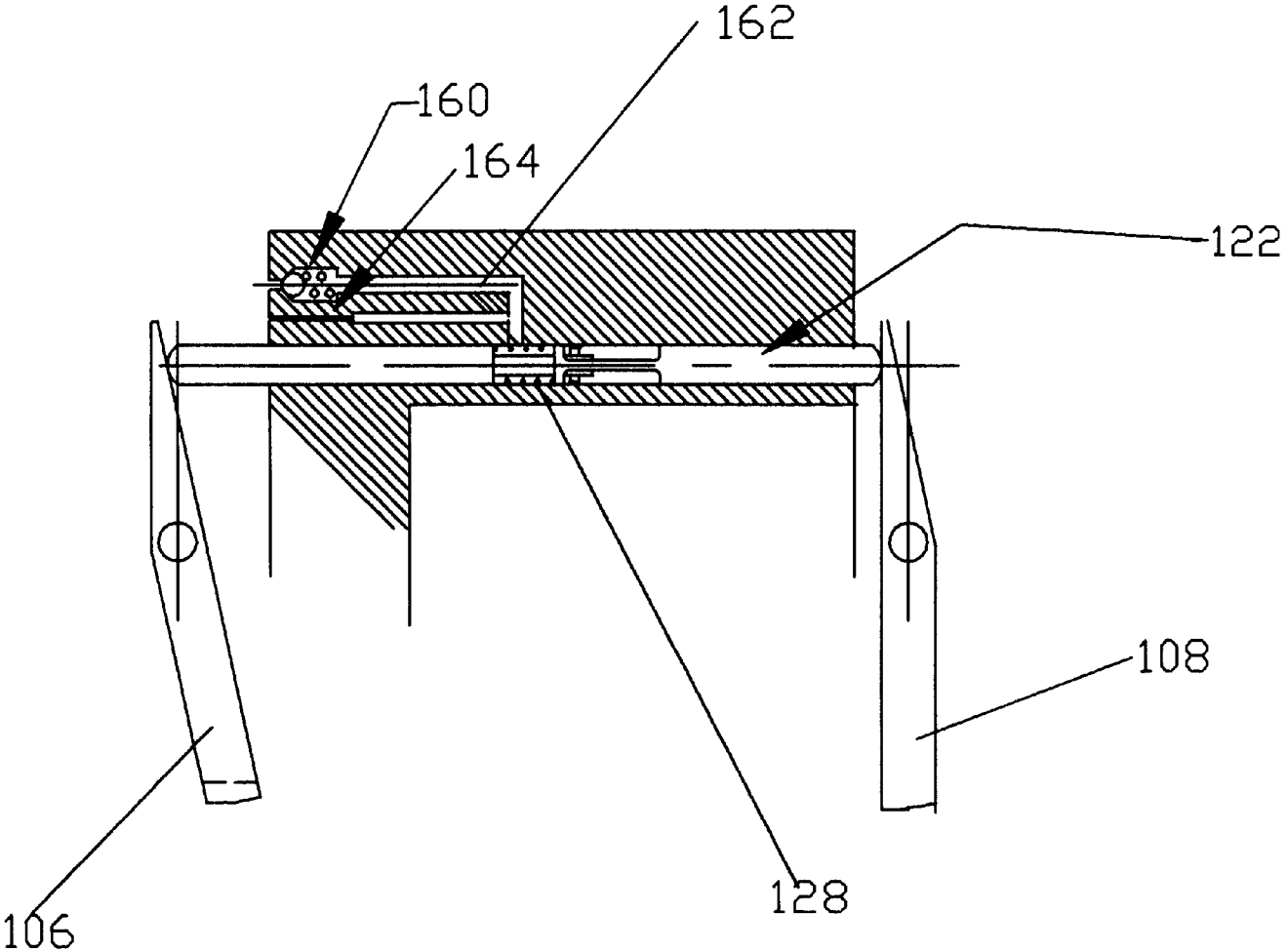
FIG. 14 illustrates an alternative preferred embodiment of the sidable mechanism in partial cross-section and embodied in an expansible chamber device.

In FIG. 14, an alternative preferred embodiment of the slidable member construction is shown for providing a variable length to the slidable member based on the velocity thereof. As shown in that figure, a check valve 160 permits pressurized fluid to enter into a chamber 162 formed at the spring area of the slidable member as shown. A control orifice 164 is disposed near the check valve and is in fluid communication with the chamber. The size of the orifice is made large enough so that at low velocities of the slidable member, the damping spring member 128 controls the overall length of the slidable member. However, at high velocities, the control orifice 164 resists fluids flow. The resulting pressure in the spring chamber 162 resists the shortening of the slidable member 122. Thus, the relative positions of the elongate pivotable members 106, 108 are a function of the position of the ramp surfaces and the velocity of the slidable member.

Figure 15:
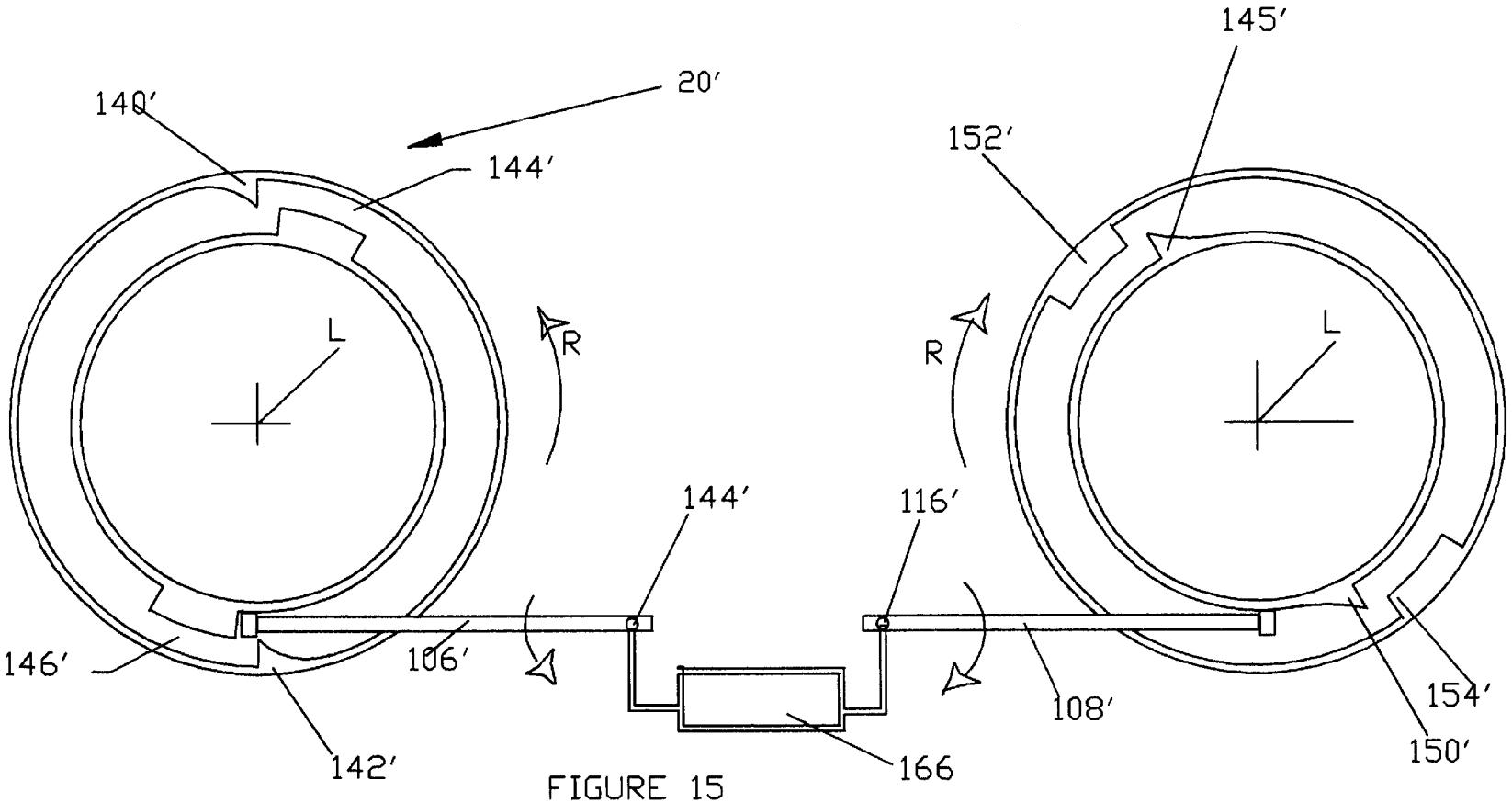
FIG. 15 is a schematic illustration of an alternative braking mechanism formed in accordance with the present invention.

As noted above, the brake mechanism formed in accordance with the first preferred embodiment of the invention moves to engage and disengage the piston assemblies by a motion substantially parallel to the longitudinal axis L of the rotating position assembly groups. As shown in FIG. 15, however, an equivalent function can be realized by levers that move perpendicular to the longitudinal axis L. As shown in that figure, a first pair of ramp surfaces 140', 142' are disposed on the first piston assembly 20' along with a first pair of top blocks 144', 146'. In a similar fashion, a second pair of ramp surfaces 148', 150' are disposed on the second piston assembly 22' along with a second pair of stop blocks 152', 154'. It is to be noted that on one end of the motor the ramp surfaces are disposed on the outer periphery of the piston assembly and the stop blocks are disposed radially inward or nearer to the axis of rotation of the piston assembly. On the other end of the motor as shown on the right in FIG. 15, the stop blocks are disposed on the outer periphery of the piston assembly and the ramp surfaces are disposed radially inward or nearer to the axis of rotation of the piston assembly. Elongate pivotable levers 106', 108' are connected together by an axle mechanism 166 shown in block diagram in the figure. The axle mechanism extends into the page on the left of FIG. 15 and out of the page on the right of FIG. 15. Rotation of the first pivotable member about the first rotation point 114' causes a corresponding motion in the second elongate pivotable member about the second rotation point 116'. Accordingly, when one of the elongate pivotable members is on the outer ramp radius, the other is on the outer block radius. Similarly, when one of the pivotable members is on the inner block radius, the other is on the inner ramp radius. The pivotable members are thus toggled between ramp and block radiuses.

Figure 16A:
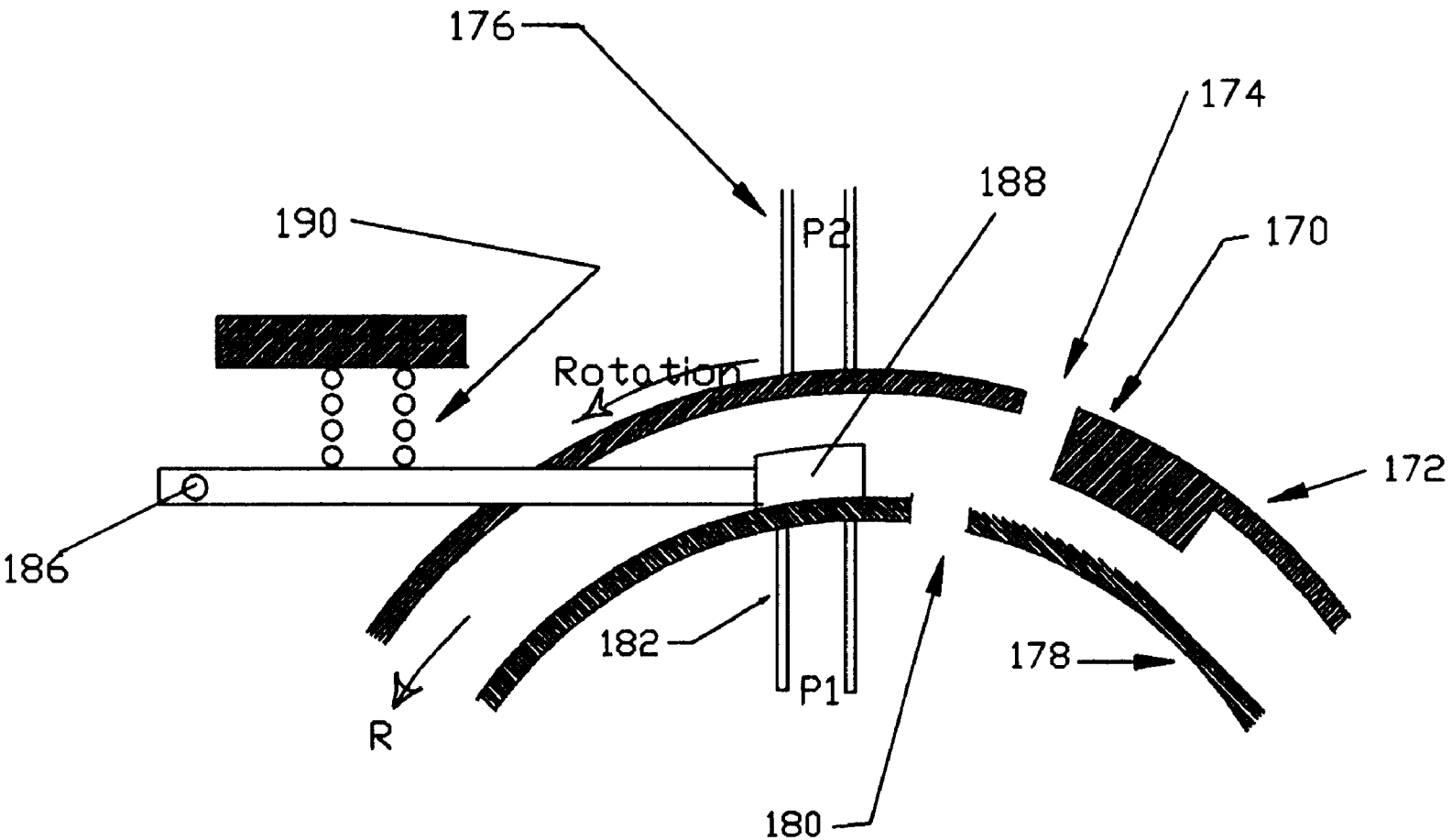
FIGS. 16*a*–16*c* are a schematic series of illustrations describing the operation of a pneumatic embodiment of the braking mechanism of the present invention.
Figure 16B:
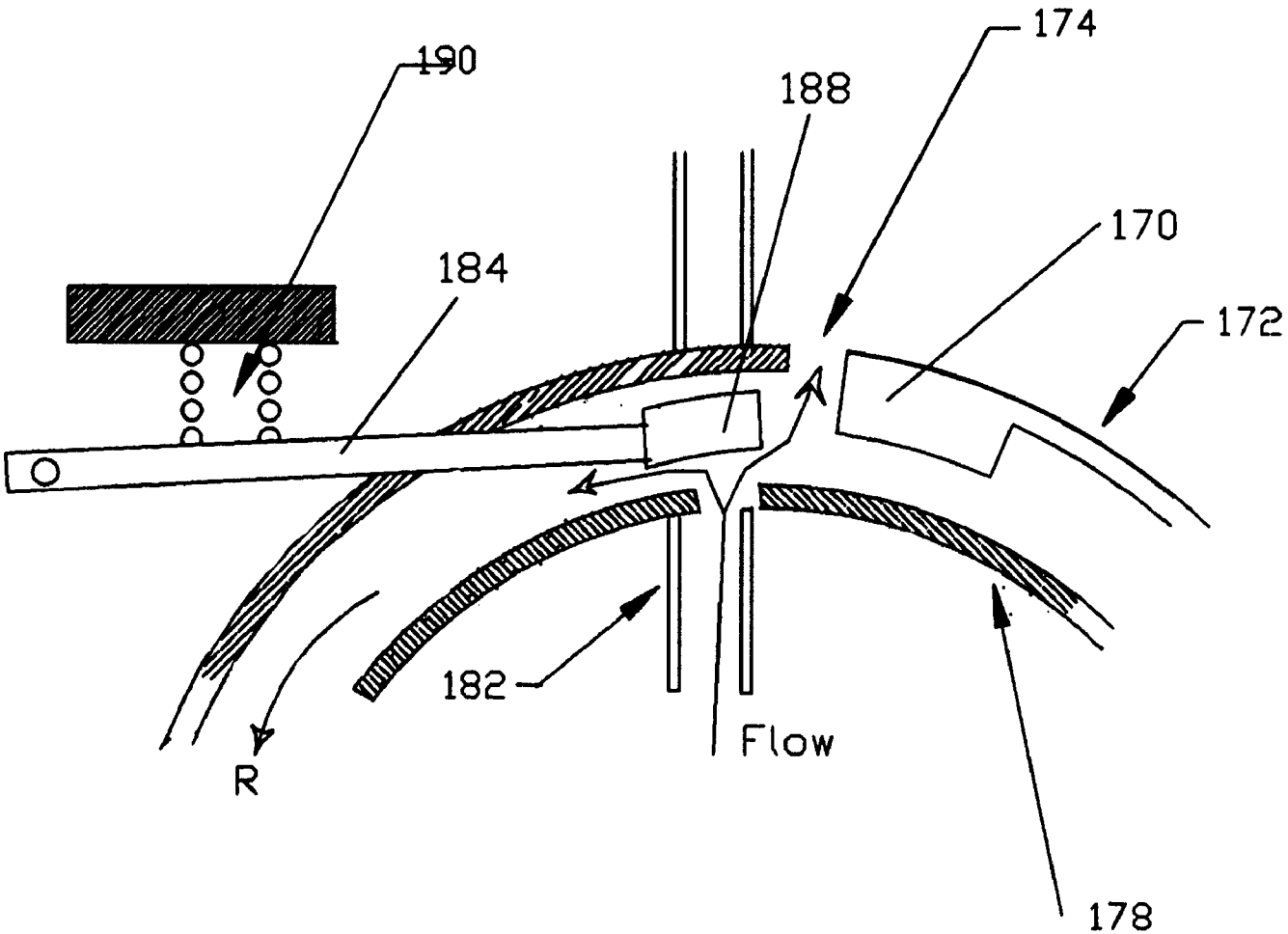
Figure 16C:
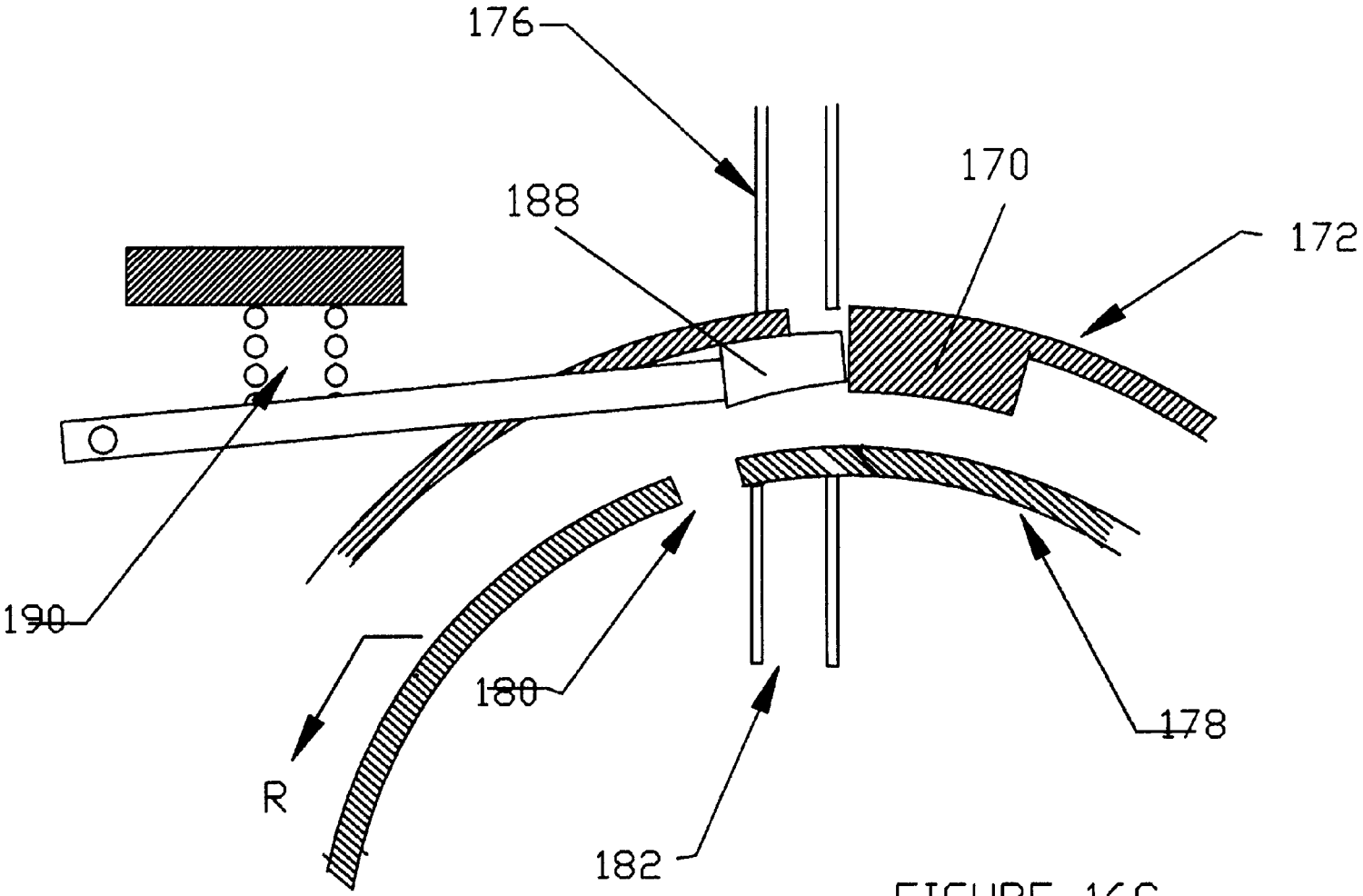

FIGS. 16*a*–16*c* illustrate a pneumatic embodiment of the subject braking mechanism formed in accordance with a third preferred embodiment of the invention. As shown there, a stop block 170 is carried on a first portion of a rotating piston assembly 172 adjacent a fluid port 174 as shown. A pressure nozzle 176 is connected to an operatively associated source of compressed fluid such as, for example, compressed air. The pressure nozzle 176 is disposed near the rotating piston assembly so that fluid communication is established between the fluid port and the auxiliary source of compressed fluid when the fluid port is in the position adjacent the pressure nozzle such shown in FIG. 16*c*.

A second portion of the rotating piston assembly 178 carries a second fluid port 180 as shown. The first and second rotating piston assembly portions 172, 178 rotate together as illustrated in the sequence shown in FIGS. 16*a*, 16*b*, and 16*c*. An inner pressure nozzle 182 is adapted to communicate pressurized fluids from an operatively associated external source into the second fluid port 180 when the second portion of the rotating piston assembly 178 is in the position best illustrated in FIG. 16*b*.

Disposed between the first and second portions of the rotating piston assembly 172, 178 is an elongate toggle member 184 connected on one end to a pivot point 186 and having a port cap member 188 on its distal end. A spring member 190 is attached on one end to a fixed member of the engine and on its other end to the elongate toggle member urging the same into a downward orientation best shown in FIG. 16*a*.

In operation, as the first and second portions of the rotating piston assembly 172, 178 rotate in the direction labeled R in the figures, the elongate toggle member 184 is moved from the position shown in FIG. 16*a* into the position shown in FIG. 16*c* by the interaction of the cap member 188 with the pressurized fluid expelled through the second fluid port 180 as illustrated in FIG. 16*b*. Engagement of the elongate toggle member with the stop block 170 prevents rotation of the rotating piston assembly. In accordance with this preferred embodiment of the subject braking mechanism, the rotating piston assembly can be freed to rotate merely by the introduction of a fluid flow through the fluid port 174 to urge the elongate toggle member into downward motion as viewed in the figures to dislodge the toggle member from the stop block from the position shown in FIG. 16*c* to that illustrated in FIG. 16*a*. It is to be noted that a complementary system having a complementary operation is provided on the other end of the motor for alternately applying braking action at appropriate times. As an example, the flow through port 174 in FIG. 16*c* is initiated when the device on the other piston assembly nears a stop block corresponding to the stop block 170 shown.

As noted above description, when the subject expansible chamber device is used in an engine application such as, for example, as an internal combustion engine, a fluid motor, a thermodynamic motor, a steam engine, or other similar device, the output shafts of the piston assemblies experience intermittent rotation in the same direction during recurrent periods of rotation with each of the piston assemblies being stopped between the periods of rotation. Accordingly, each of the output shafts are alternately rotating and stationary. Although alternating motion is suitable for some applications such as in pumps of the type using the device and in saws or vibrators or the like, most applications require a single continuous rotating output shaft.

Figure 17:
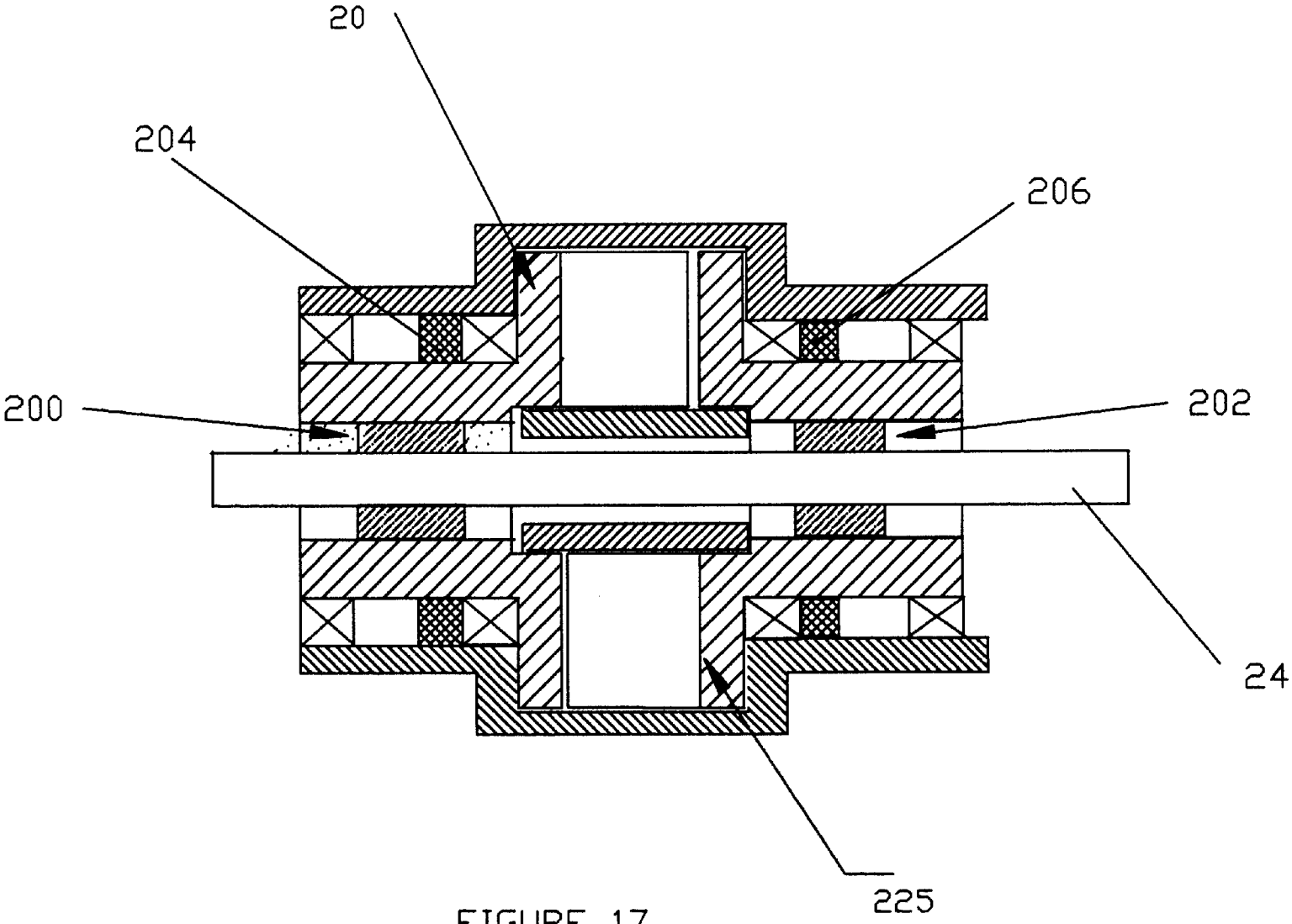
FIG. 17 is a schematic illustration in partial cross-section of an apparatus for generating continuous rotation of an output shaft for use with expansible chamber devices.

A simple way of generating continuous rotation of an output shaft is shown in FIG. 17. There, the first piston assembly 20 is connecting in a driving relationship with the output shaft 24 through a sprag-type racheting clutch member 200. Similarly, the second piston assembly 22 is connected in driving relation to the output shaft 24 to a second sprag-type racheting clutch 202. In this arrangement, when one piston assembly and clutch is driving the output shaft 24, the other piston assembly can remain stationary with the output shaft overriding the clutch of the stationary piston assembly. Backward rotation of the first piston assembly is prevented by a first racheting member 204 which is preferably a sprag clutch, a brake, or any other suitable electromechanical device. Similarly, backward rotation of the second piston assembly is prevented by a second racheting member 206 which, like the first racheting member, is preferably a sprag clutch, a brake, or any other suitable electromechanical device.

Figure 18:
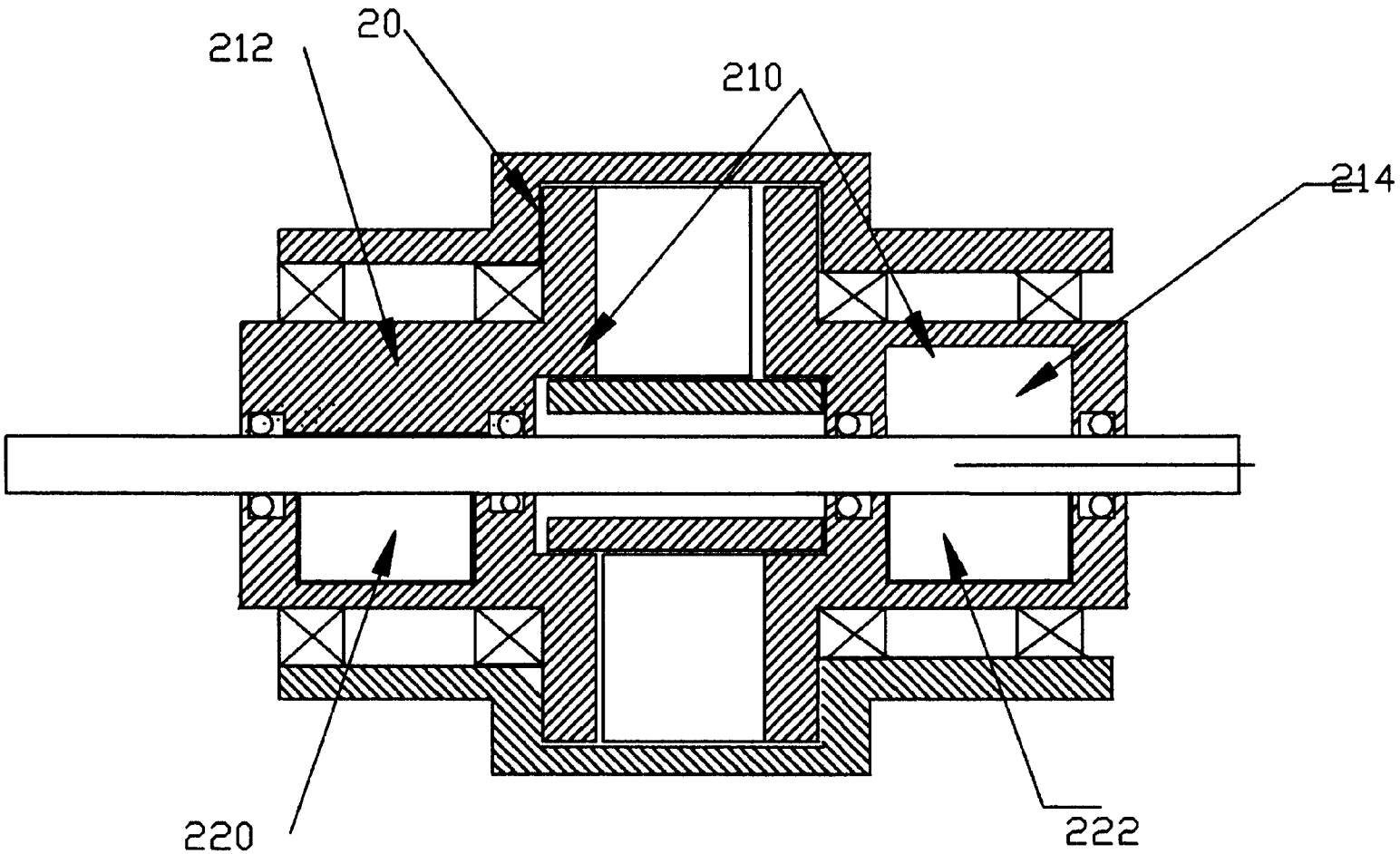
FIGS. 18 and 18*a* show side and end views, respectively, in partial cross-section of a hydraulic output shaft drive mechanism for realizing continuous rotation of an output shaft in an expansible chamber device.
Figure 18A:
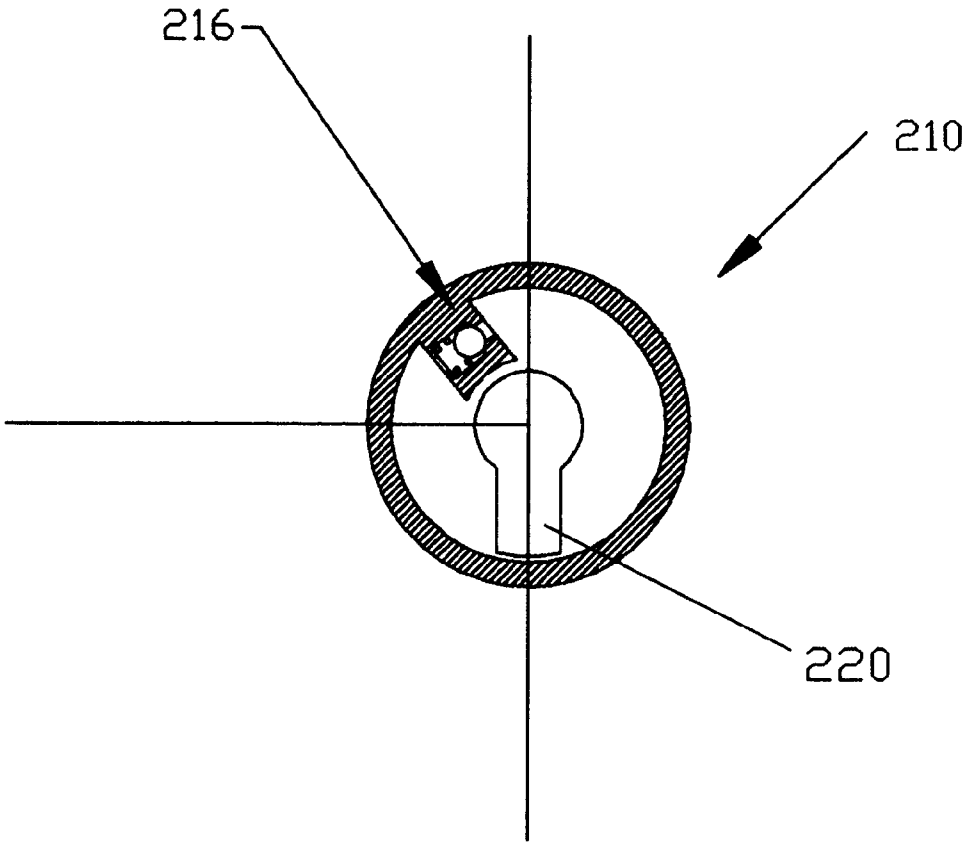

A hydraulic output shaft drive mechanism 210 is shown in FIGS. 18 and 18*a* whereat the first piston assembly 20 is shown connected to a rotating hydraulic vane 212 in the second piston assembly is similarly connected to a second hydraulic vane 214. The vanes 212, 214 each include a check valve member 216, 218, respectively. Also, associated with each of the first and second piston assemblies is a second hydraulic vane 220, 222 disposed in opposite facing relationship to the first and second hydraulic vanes 212, 214. Operationally, forward motion of the hydraulic vanes 212, 214 causes motion of the second set of hydraulic vanes 220, 222. When the first piston assembly is stationary and the first hydraulic vane 212 connected thereto is also stationary, the rotating shaft driven by the second piston assembly 22 drives and rotates the second hydraulic vane 222. The check valve member 216 in the hydraulic vane 212 opens to permit relative motion in one direction, that is, the relative motion between the vanes 212 and 220. Thus, the hydraulic vanes connected to alternately stopped and moving pistons provide a continuous output shaft rotation through the hydraulic drive mechanism 210.

Figure 19:
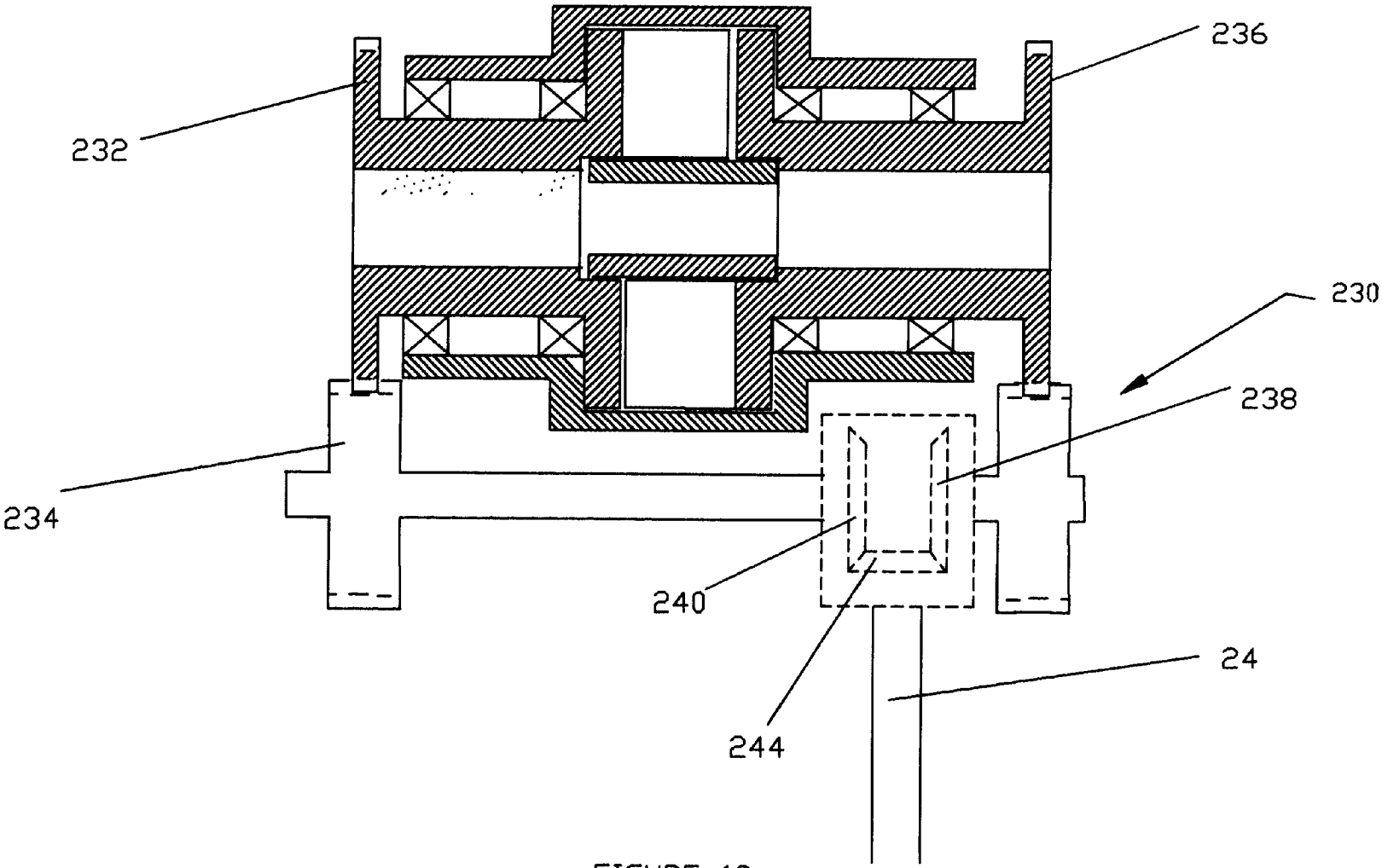
FIG. 19 illustrates, in partial cross-section in schematic form, a differential drive mechanism used to interface in output shaft with a pair of piston assemblies.

FIG. 19 illustrates a differential drive mechanism 230 used to interface the output shaft to the first and second piston assemblies and provide continuous output shaft rotation. A first pair of gears 232, 234 are connected to the first piston assembly 20 as shown. Similarly, a second pair of gears 236, 238 are disposed in driving relationship on the second piston assembly 22 as shown. The first pair of gears 232, 234 are connected to a left differential gear member 240. The second pair of gears 236, 238 are connected to a right differential gear member 242 as shown. A pinion gear 244 connected to the output shaft 24 engages the left and right differential gear members 240, 242 so that while the first and second pair of gears alternately move, the differential drive mechanism 230 provides a continuous rotation of the output shaft 24. This type of mechanical interconnection between a pair of members having disparate motion and a single other member is well known in the automobile drive train art.

Figure 20:
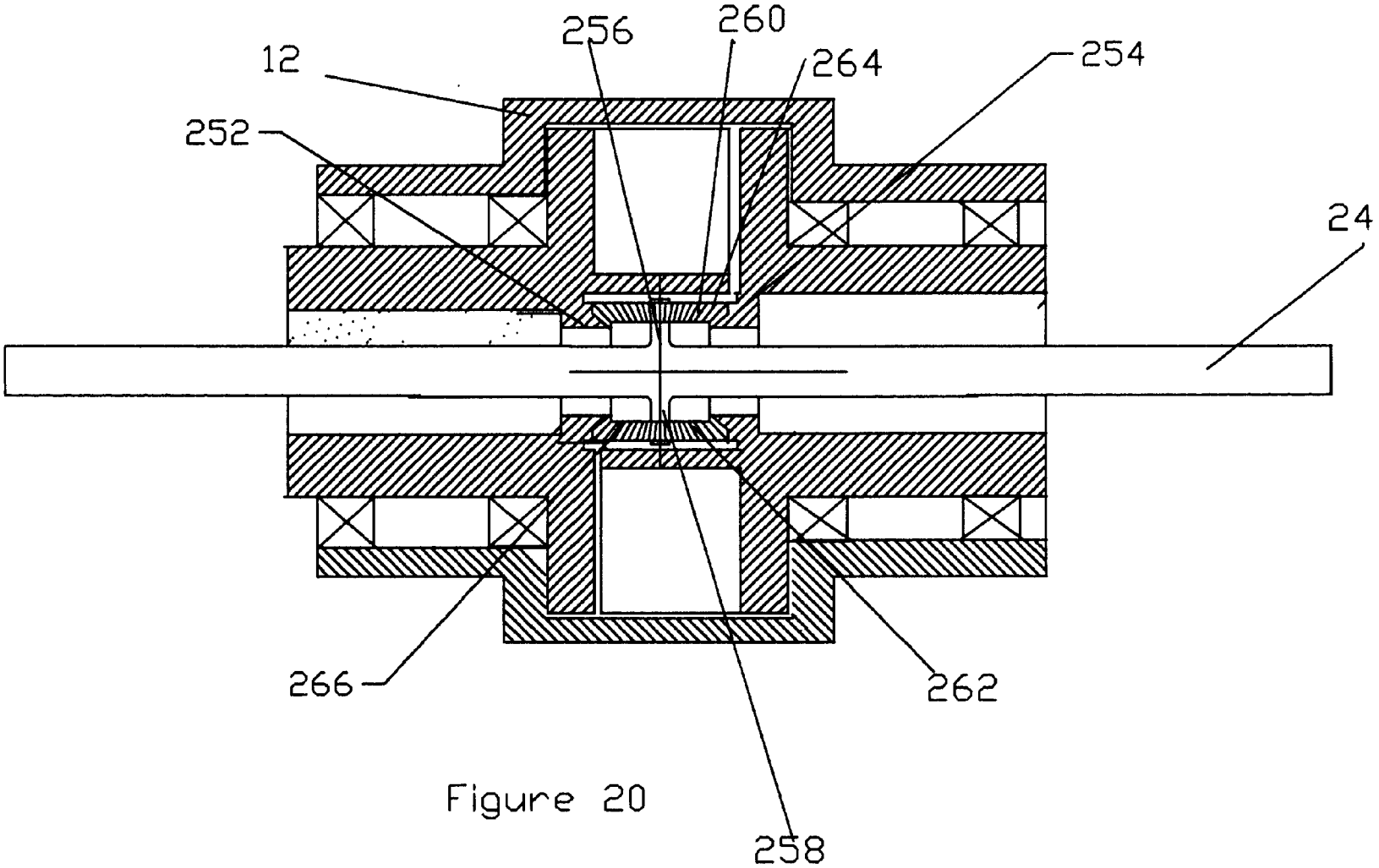
FIG. 20 illustrates an improved internal differential drive mechanism formed in accordance with the present invention.

An improved internal differential drive mechanism 250 is illustrated in FIG. 20 whereat it is shown that the drive mechanism is totally contained within the housing 12 of the internal combustion engine. A first set of conical gear teeth 252 are provided on the first piston assembly 20 in a manner illustrated. Similarly, a corresponding second set of conical gear teeth 254 are provided on the second piston assembly 22. The first and second sets of conical gear teeth are arranged and configured as mirror images of each other. A pair of diametrically disposed and oppositely directed mounting tabs 256, 258 are rigidly connected to the output shaft 24 as shown. The mounting tabs carry first and second carrier gears 260, 262 thereon within the internal combustion engine housing. The carrier gears 260, 262 are rotatably mounted on the mounting tabs 256, 258 and further, are provided with conically shaped gear teeth 264, 266, respectively. The gear teeth are adapted to engage the corresponding set of gear teeth 252, 254 so that rotation of either of the first or second piston assemblies will cause a corresponding motion in the same direction in the output drive shaft 24.

In the above embodiment, although only a pair of carrier gears rotatably mounted on mounting tabs are illustrated, three or more gears carried on an equal number of mounting tabs could be used as well.

Figure 21:
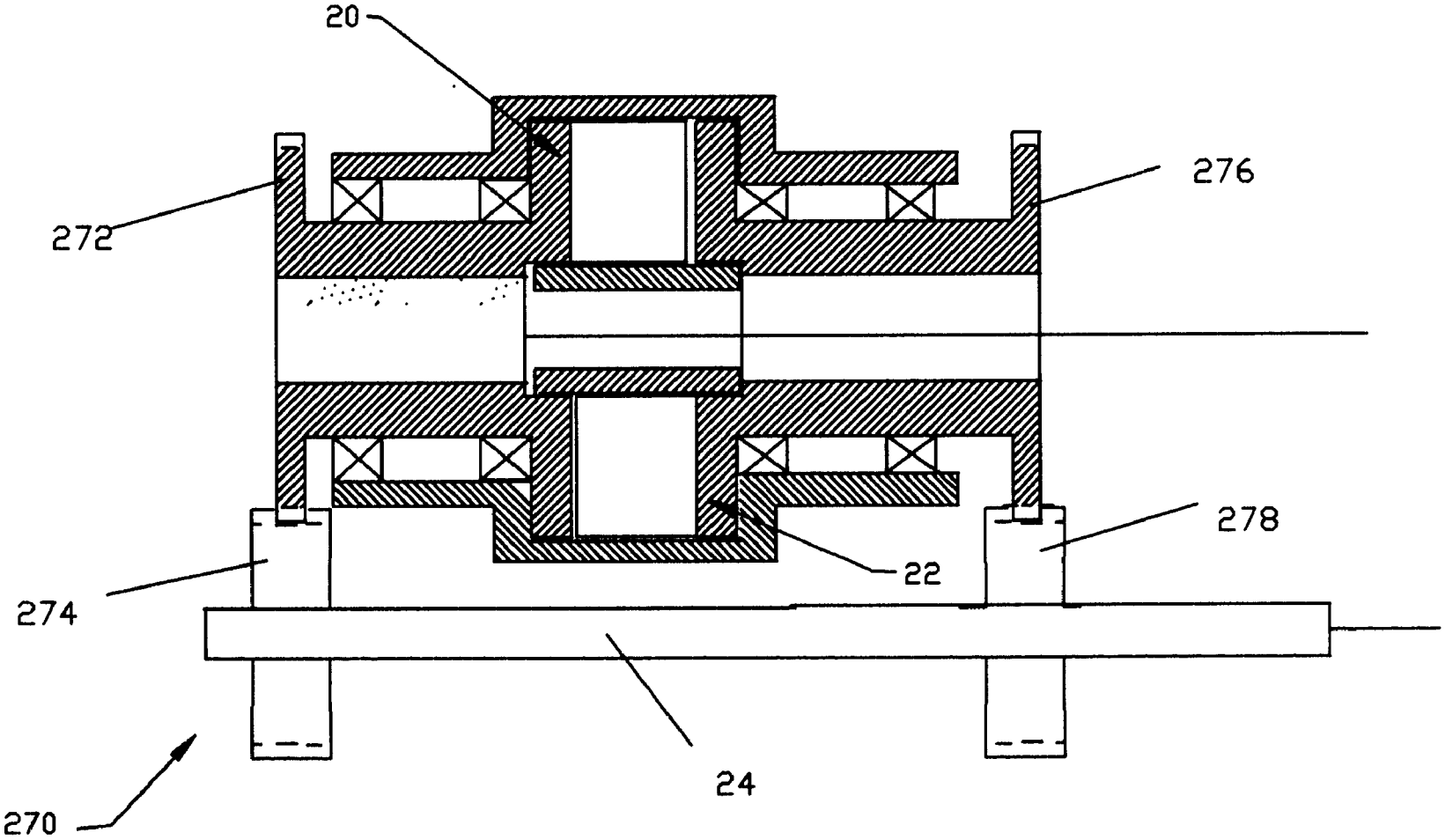
FIGS. 21 and 21*a* illustrate in schematic and partial cross-section view an alternative output drive mechanism for producing a continuous output shaft rotation from two discontinuous driving forces.
Figure 21A:
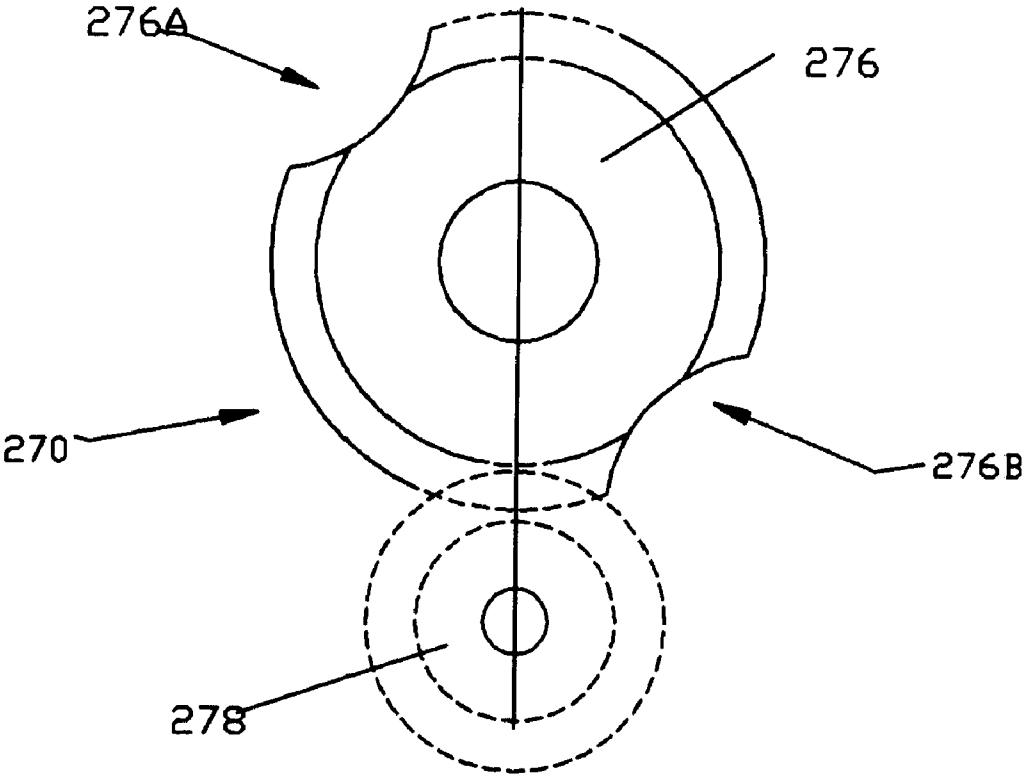

FIGS. 21 and 21*a* illustrate yet another output drive mechanism 270 for producing a continuous output shaft rotation from two discontinuous driving forces. In this embodiment, the first piston assembly 20 is connected to a first notched gear 272 which is in turn selectively engaged with a secondary drive gear 274 fixedly affixed to the output shaft 24. Similarly, the second piston assembly 22 is provided with a second notched gear 276 which is selectively enmeshed with a further secondary drive gear 278 fixedly attached to the output shaft as shown.

In accordance with this embodiment, the notches in the gears 272, 276 align with the secondary drive gears 274, 278 when the respective piston assembly is stopped. As best shown in FIG. 22*a*, the second piston assembly 22 is connected to the output shaft 24 by the engagement of the teeth on the second notched gear 276 with the secondary drive gear 278. The notches 276*a*, 276*b* on the gear 276 are not aligned with the secondary gear 278. Rather, the gear pair 276, 278 are engaged. In this position, the first piston assembly 20 on the other side of the motor is stopped and, accordingly, the first notched gear 272 is positioned such that the notch provided thereon is aligned with the first secondary drive gear 274 thus disengaging the first piston assembly from the output shaft. As one of the piston assemblies stops, the notches provided on the notched gears align with the matching secondary drive gear and, accordingly, mechanically disengages the stopped piston assembly from the output shaft. As the stopped piston assembly begins to move, the notches provided on the notched gears accordingly rotate out of position so that the teeth on the notched gears can engage the appropriate secondary drive gear thus connecting the moving piston assembly to the output shaft. Accordingly, the output drive mechanism 270 shown in FIGS. 21 and 21 a provide a continuous motion of an output drive shaft even though the first and second piston assemblies are alternately moving and stopped.

Figure 22:
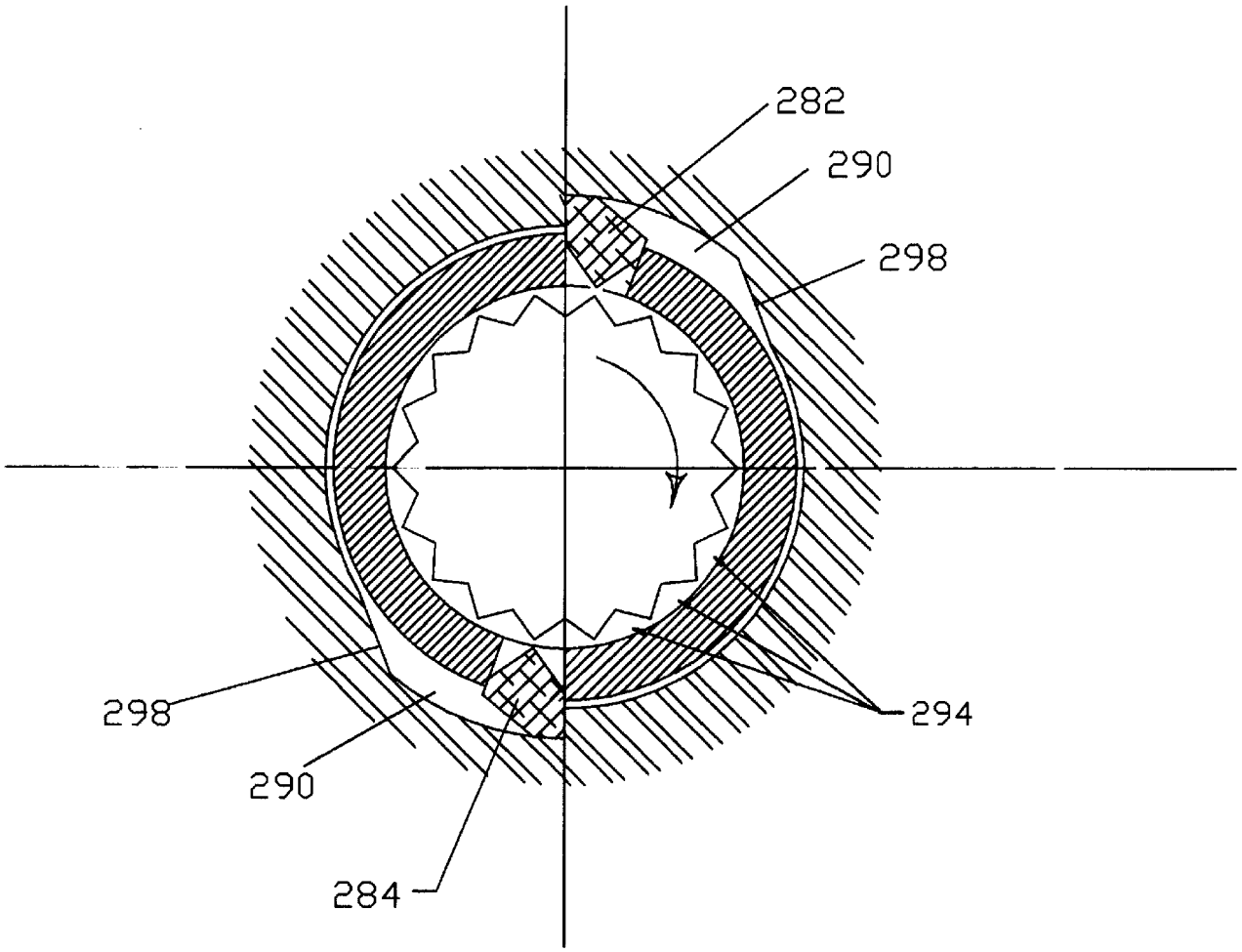
FIGS. 22 and 22*a* show another preferred output drive mechanism in cross-section for transferring alternating motion of piston assemblies to continuously rotating output shaft.
Figure 22A:
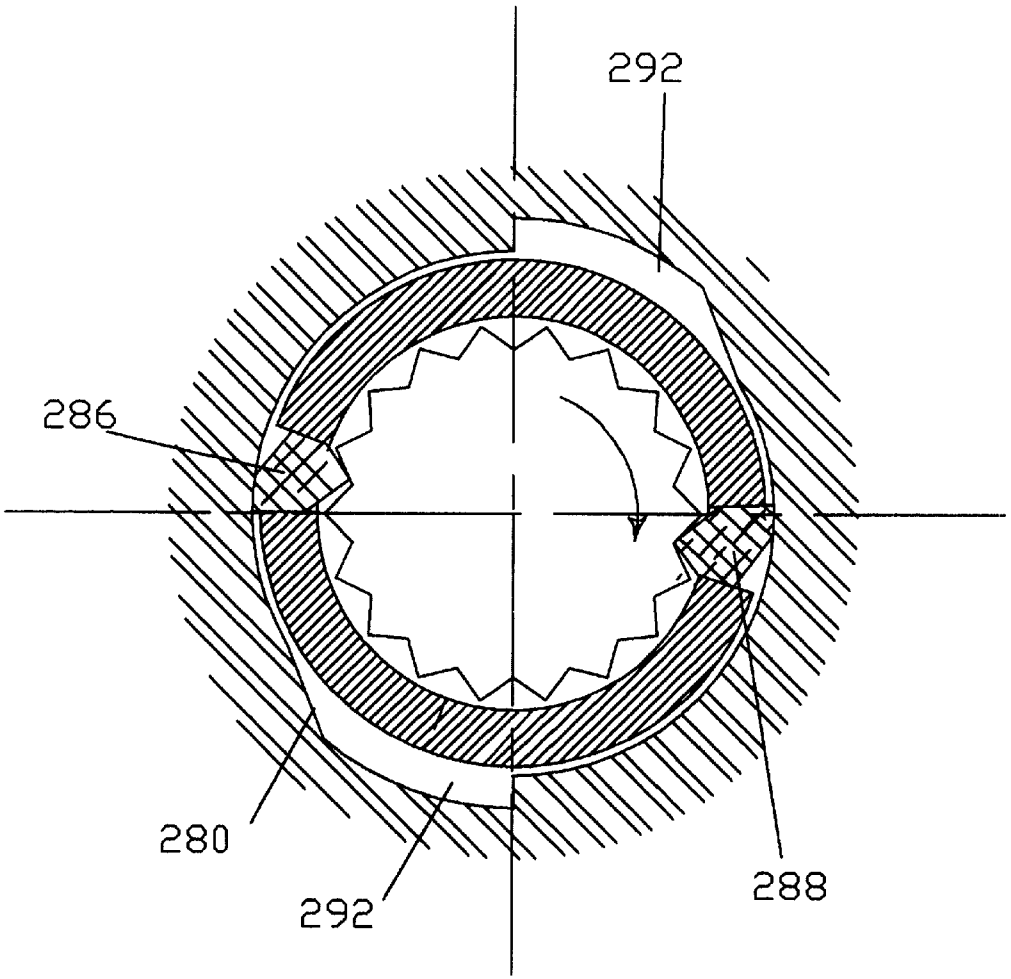
Figure 23:
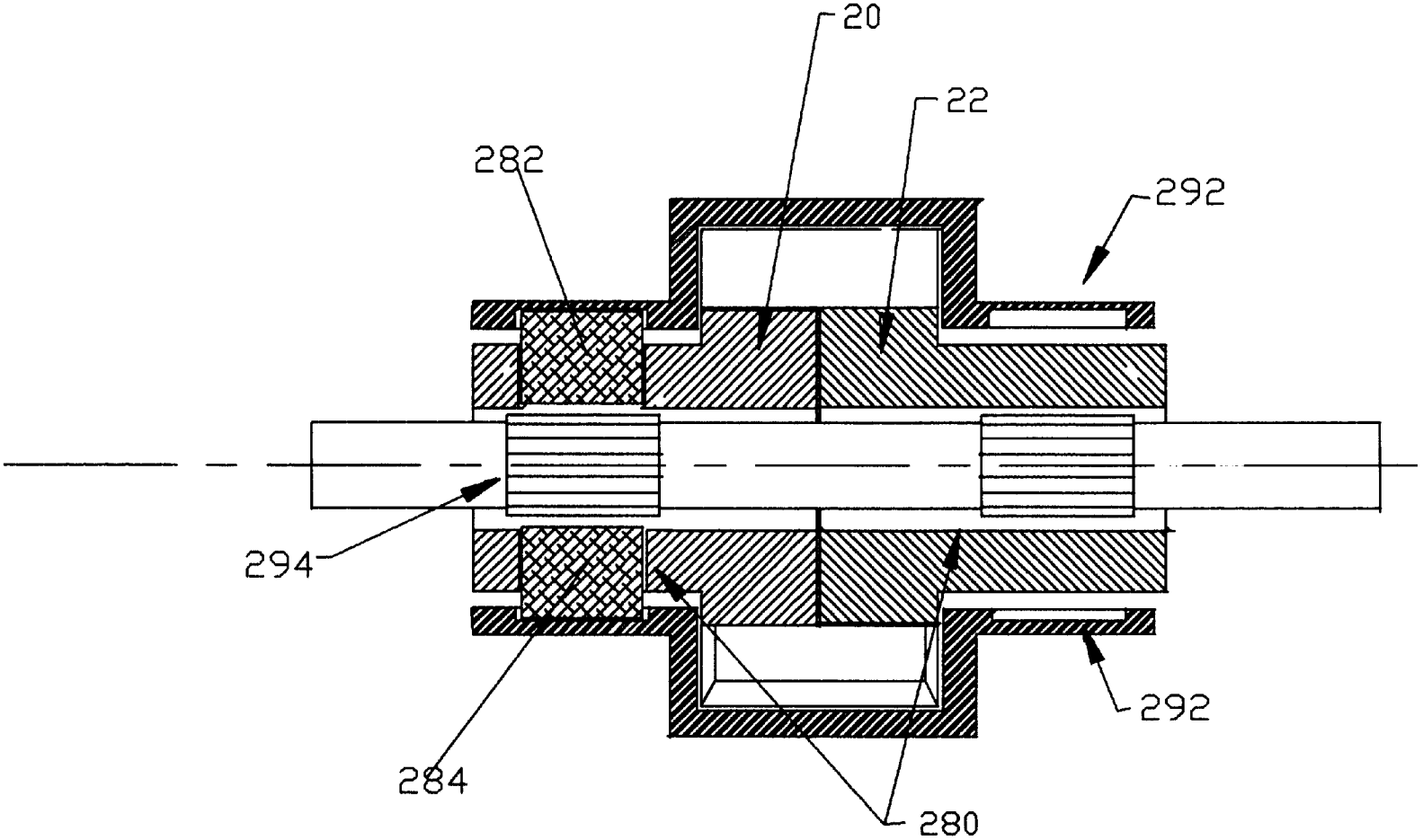
FIG. 23 is a side view in partial cross-section of the device illustrated in FIG. 22.
Figure 24:
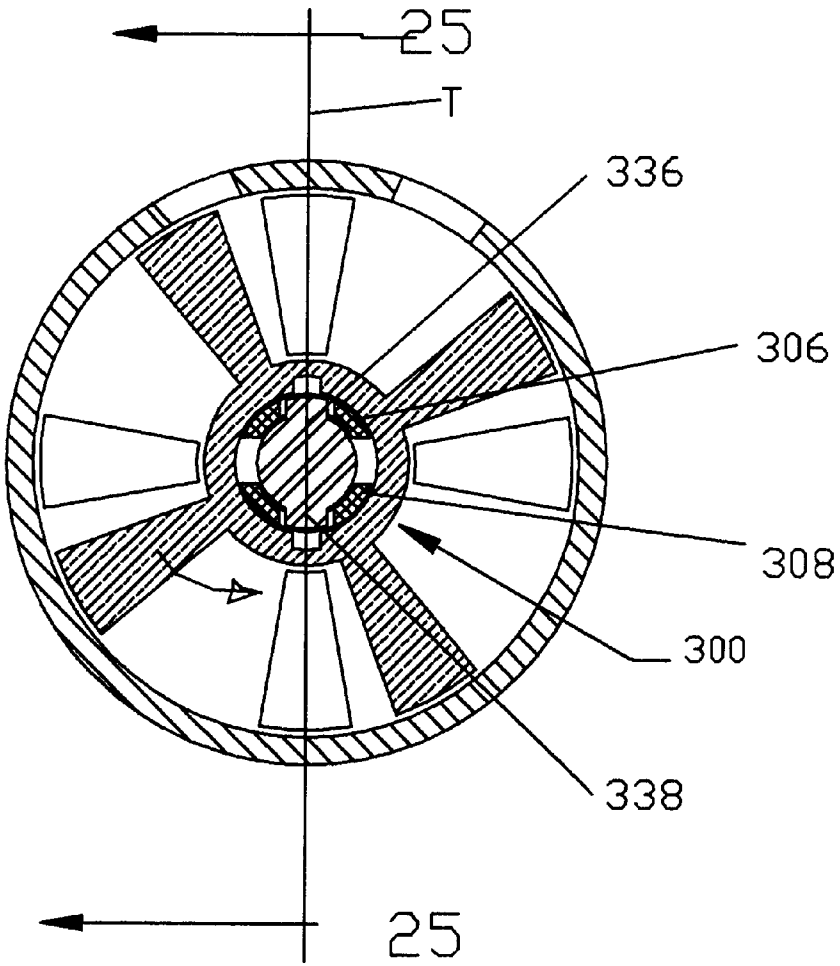
FIG. 24 is an end view taken in cross-section of a preferred piston assembly synchronizing system formed in accordance with the present invention.
Figure 25:
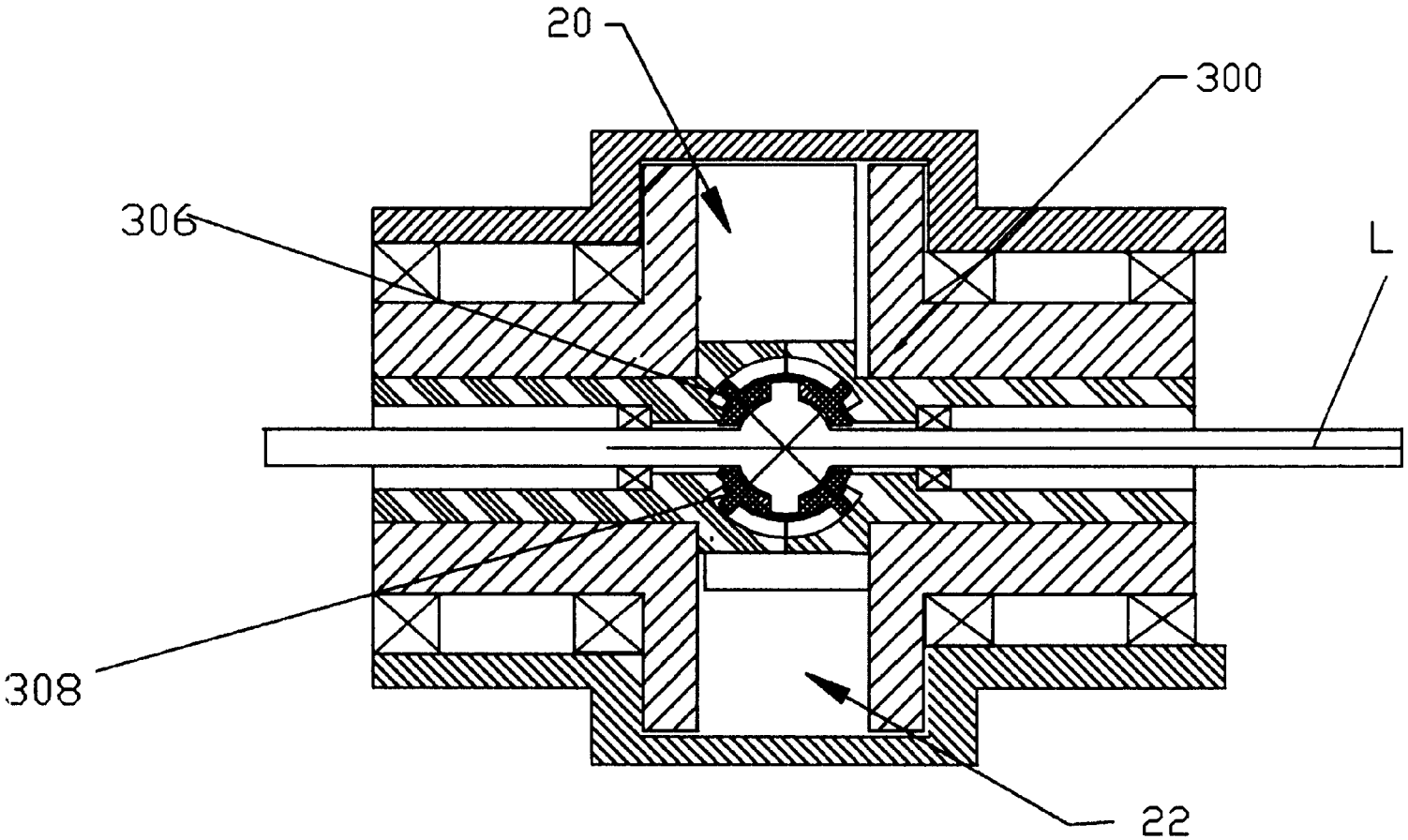
FIG. 25 is a side cross-sectional view of the piston synchronizing assembly taken along line 25—25 of FIG. 24.

FIGS. 22, 22*a*, and 23 show yet another preferred output drive mechanism 280 for transferring the alternating motion of first and second piston assemblies to a continuously rotating output shaft. Further, the output drive mechanism illustrated in those figures further provides a racheting function for preventing the reverse rotation of the first or second piston assembly that is stationary. FIG. 22 illustrates a cross-section of the subject output drive mechanism showing the components thereof in their operational state in a stationary piston assembly. FIG. 22*a* illustrates the subject output drive mechanism and the components thereof in their operational position in a moving piston assembly. FIG. 23 shows a longitudinal cross-section view of an expansible chamber into a combustion engine utilizing the output drive mechanism 280 shown with the stopped piston assembly on the left and the rotating piston assembly on the right.

A first pair of key members 282, 284 are carried on the first piston assembly 20 in the manner illustrated. Similarly, a second pair of key members 286, 288 are carried on the second piston assembly 22. The key members are radially movable both inwardly and outwardly for reasons to be subsequently described. The first set of slots 290 are provided in the housing adjacent the first piston assembly 20 as shown. Similarly, a second set of slots 292 are defined in the housing near the second piston assembly in a corresponding fashion. The first and second set of slots enable the first and second pairs of key members to move radially outwardly when the corresponding housing members are appropriately positioned.

A first set of recesses 294 are defined in the output shaft adjacent the first piston assembly to enable the first pair of key members 282, 284 to move radially inwardly as the key members carried on the output shaft are passed under a set of ramps 298 formed integrally with the first set of slots 290. In the position shown in FIG. 22, the first pair of key members 282, 284 are engaged with the first set of recesses 294 thus preventing backward rotation of the first piston assembly. In the position shown in FIG. 22*a*, the second pair of key members 284 are disposed radially inwardly hereto engagement with a second set of recesses 296 formed on the output shaft in the second piston assembly area.

Turning next to FIGS. 24–27, a preferred piston assembly synchronizing system 300 formed in accordance with the present invention is used to limit the relative rotational movement between the first and second piston assemblies 20, 22 about the longitudinal axis L within a predetermined range. In expansible chamber type internal combustion engines of the type described, it is important that the first and second piston assemblies are arranged in a predetermined orientation with respect to each other before the engine is started so that the braking mechanism 100 can properly engage the first and second set of cam surfaces 102, 104 in a manner described above. In the art of expansible chamber devices it is well known that the first and second piston assemblies must be held to within a predetermined range of relative angular displacement with respect to each other. The synchronizing system 300 shown in FIGS. 24–27 provides a preferred mechanism for synchronizing the piston assemblies.

In the subject synchronizing system, a set of connection areas 302 are provided on the output shaft 24 in a manner as shown. The connection areas extend in directions transverse to the longitudinal axis L of the output shaft. A set of link elements 304 are mechanically engagable with the set of connection areas as shown. Each link element 306, 308 of the set of link elements are simultaneously slidably engagable with both the first and second piston assemblies 20, 22 to transmit rotational motion from the first and second piston assemblies to the output shaft 24 and to permit relative rotation between the first and second piston assemblies about the longitudinal axis L within a predetermined range of motion. Each of the link elements 306, 308 includes a first group of link areas 310 adapted for slidable engagement with the first piston assembly and a second group of link areas 312 adapted for slidable engagement with the second piston assembly to permit the relative rotation between the first and second piston assemblies about the longitudinal axis within the predetermined range. Each link element 306, 308 is rotatably engaged with the set of connection areas 302.

Figure 26:
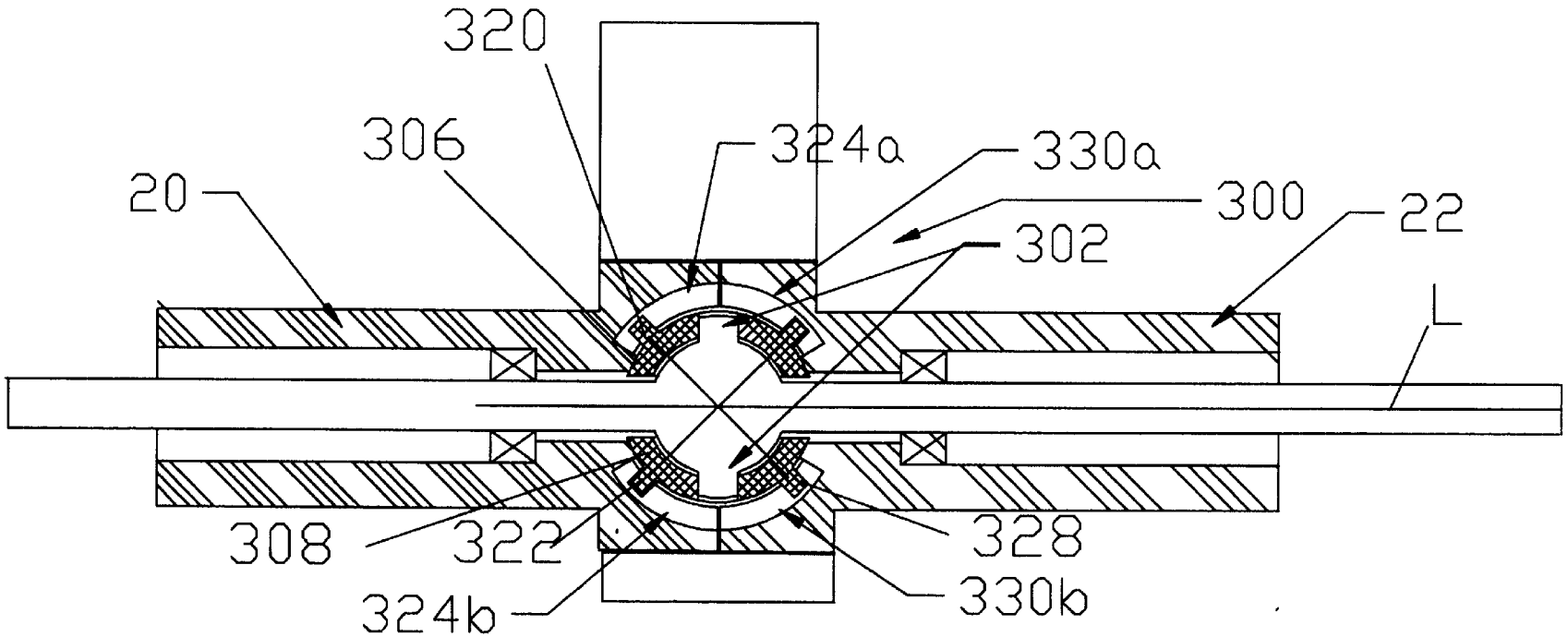
FIG. 26 is a side view taken in cross-section of the preferred piston assembly synchronizing system illustrated in FIGS. 24 and 25.
Figure 27:
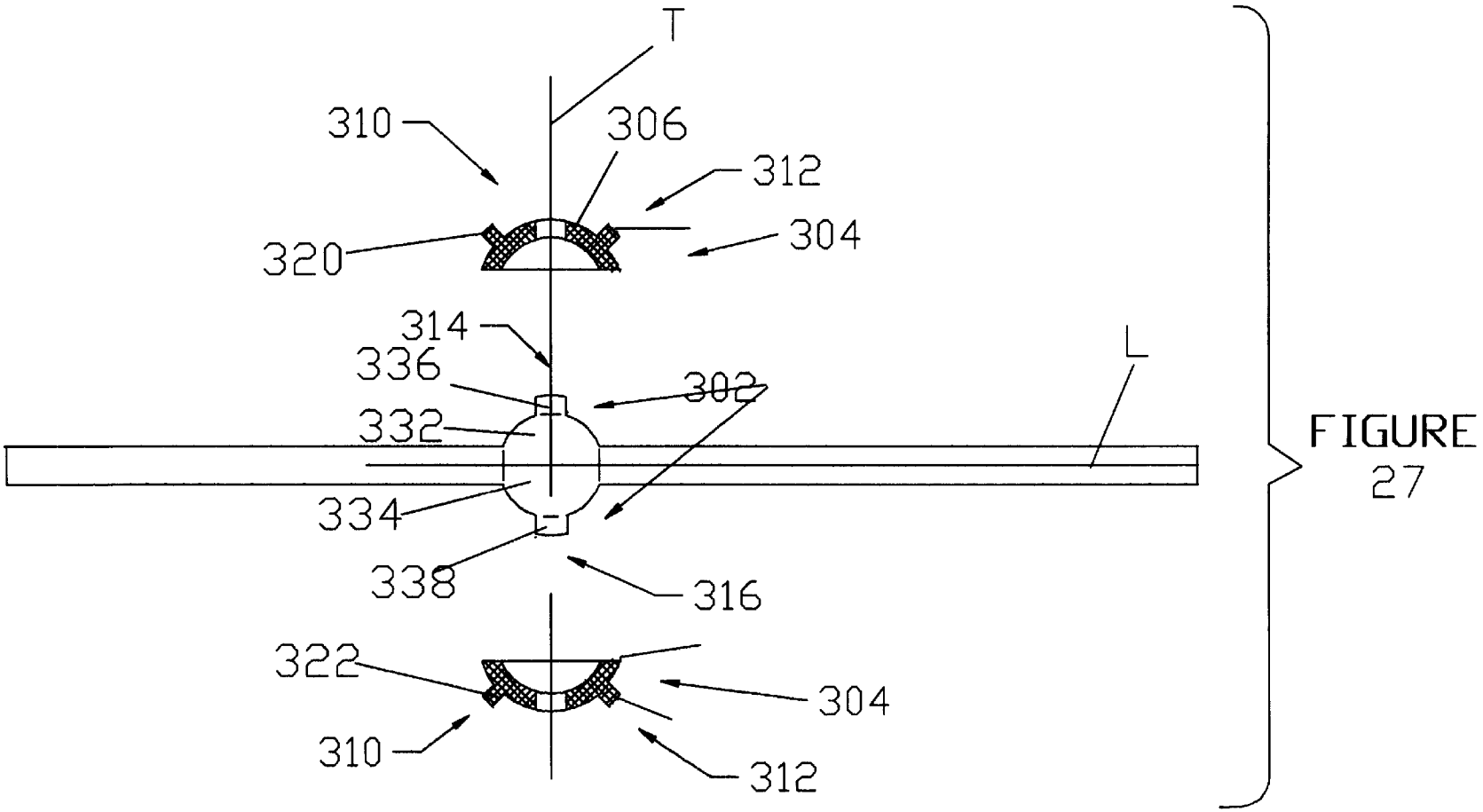
FIG. 27 is an exploded view of the preferred piston assembly synchronizing system shown in FIGS. 24–26.

The set of connection areas includes a pair of axle members 314, 316 extending from the output shaft 24 in opposite directions substantially perpendicular to the longitudinal axis L. The first link element 306 is rotatably carried on the first axle member 314 and the second link element 308 is rotatably carried on the second axle member 316. As best shown in FIG. 26, the first group of link areas 310 includes a pair of first link pins 320, 322 adapted for slidable movement in a pair of top and bottom arcuate grooves 324*a*, 324*b* formed in the first piston assembly 20. The second group of link areas 312 include a pair of second link pins 326, 328 adapted for slidable movement in a pair of top and bottom arcuate grooves 330*a*, 330*b* formed in the second piston assembly 22.

In order to provide sufficient support to the set of link elements 304, the pair of axle members 314, 316 include a pair of spherical bearing surfaces 332, 334 extending from the output shaft 24 and a pair of circular tab members 336, 338 extending from the spherical bearing surfaces.

In operation, the rotatable set of link elements together with the first and second group of link areas are rotatable about rotating a transverse axis T to enable a relative angular difference between the first and second piston assemblies. The contour of the arcuate grooves 324, 326 and corresponding shape of the set of link elements determine the maximum extent of relative rotation enabled between the first and second piston assemblies. In accordance with the preferred embodiment of the subject synchronizing system 300, the predetermined range is between 0 and 70 degrees when the synchronizing system is used in an expansible chamber device of the type shown in FIG. 4 having four pistons carried on each piston assembly, between 0 and 150 degrees when the synchronizing system is used in an expansible chamber device of the type shown in FIG. 3 having two pistons carried on each piston assembly, and between 0 and 330 degrees when used in an expansible chamber device of the type shown in FIGS. 1 and 2 having a single piston carried on each piston assembly. The rotating transverse axis T defined by the pair of opposite circular tab members can lead or lag the rotating output shaft 24 within the range of 0 to 35 degrees.

Starting and stopping pumps and internal combustion engines formed in accordance with the expansible chamber device of the present invention can be accomplished using a number of methods. Once started, the present invention used as an internal combustion engine will continue to run as long as fuel and ignition is supplied. A pressurized fluid such as compressed air or gases from a starting cartridge, for example, can be introduced into one or more of the chambers formed between the rotating piston assemblies. Preferably, the compressed air is introduced into the power producing volumes such as, for example, the volume C shown in FIG. 3.

Another method of starting the expansible chamber device used as a combustion engine is to rotate the free piston group or piston assembly by connection to an external source of power such as, for example, a starter motor. For small engines, a manual crank or spring mechanism can be used to initiate rotation of the free piston assembly. In either case, a rachet type connection would be useful and preferred so that once started, the output shaft of the engine can overrun the starting mechanism.

In the embodiment described above in connection with the differential output mechanisms shown in FIGS. 19 and 20, the output shaft 24 can be used directly for connection of the internal combustion engine to an external source of starting power. One preferred example of starting power is a conventional Bendix starter such as those commonly found in automobiles and motorcycles. In the embodiment illustrated in FIGS. 21 and 21*a*, a Bendix type starter or electric motor or mechanical starting mechanism are useful as well.

Once started and coordinated sequential movement of the piston assemblies are sustained, the moving piston group gains kinetic energy which must be dissipated before the pistons among the group stop at their designated location. In an internal combustion engine such as that shown in FIG. 3, the kinetic energy is dissipated or absorbed by the work used in compressing the fluid in the volume B'. Also, the kinetic energy stored in the moving piston group can be absorbed by preventing the exhaust gases from escaping the housing such as through the exhaust port 18' shown in FIG. 3 for a portion of the stroke or motion of the piston pair 42, 44. This is accomplished by precisely locating the exhaust port 18' with respect with the stopped piston 44. By moving the exhaust port 18' counter clockwise as viewed in FIG. 3, a portion of the stroke of the piston 46 includes travel beyond the exhaust port 18' so that some of the exhaust gases become trapped between the pistons 44 and 46. The trapped exhaust gas volume is, therefore, useful as a cushion for absorbing the kinetic energy of the rotating piston group.

Figure 28:
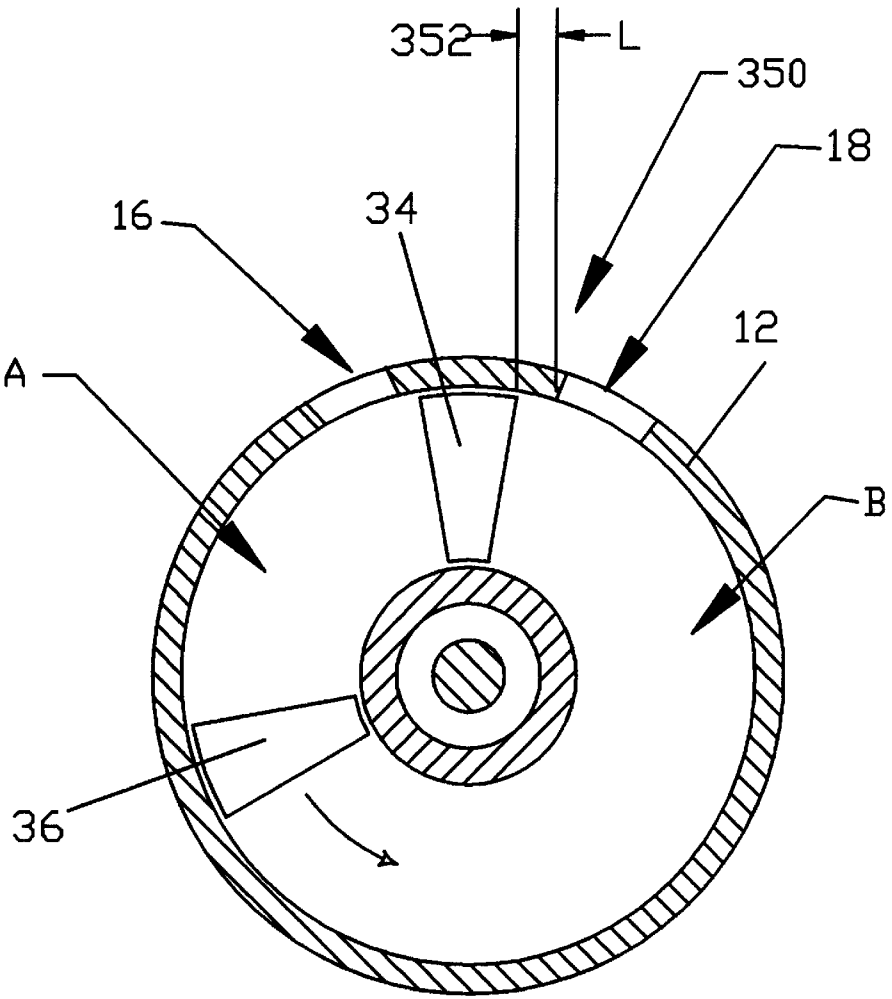
FIG. 28 is an end view in cross-section of a kinetic energy absorbing technique for use with expansible chamber devices in accordance with the invention.

In some cases and in certain applications, it may be necessary to augment the kinetic energy absorbing techniques described above. As an example, in the pump illustrated in FIG. 1, kinetic energy dissipation can be augmented by placing the exhaust port 18 at a location on the housing where free exhaust flow is established for the majority of motion of the second piston 36 but, a restriction in flow for piston motion occurring just before the point in which the second piston 36 is stopped. In that case, the work involved in compressing the trapped fluid acts as an energy dissipation mechanism. As shown in FIG. 28, the output port 18 allows free exhaust flow for the majority of rotation of the second piston 36. However, as the body of the second piston 36 approaches the stationary piston 34, the exhaust port 18 becomes blocked. A portion 350 of the housing 12 defines a chamber together with the first and second pistons 34, 36 whereat the exhaust gases become trapped and cannot escape. The body of the second piston 36 is used to occlude the exhaust port so that the exhaust gas fluid is trapped for a distance 352 of second piston movement. The fluid thereby trapped during the motion of the second piston through the distance 352 can be allowed to escape in a controlled fashion using various mechanisms such as, for example, valves, orifices, or close clearances. The energy required to cause flow of the trapped volume is used to dissipate the kinetic energy of the rotating second piston 36.

Figure 29:
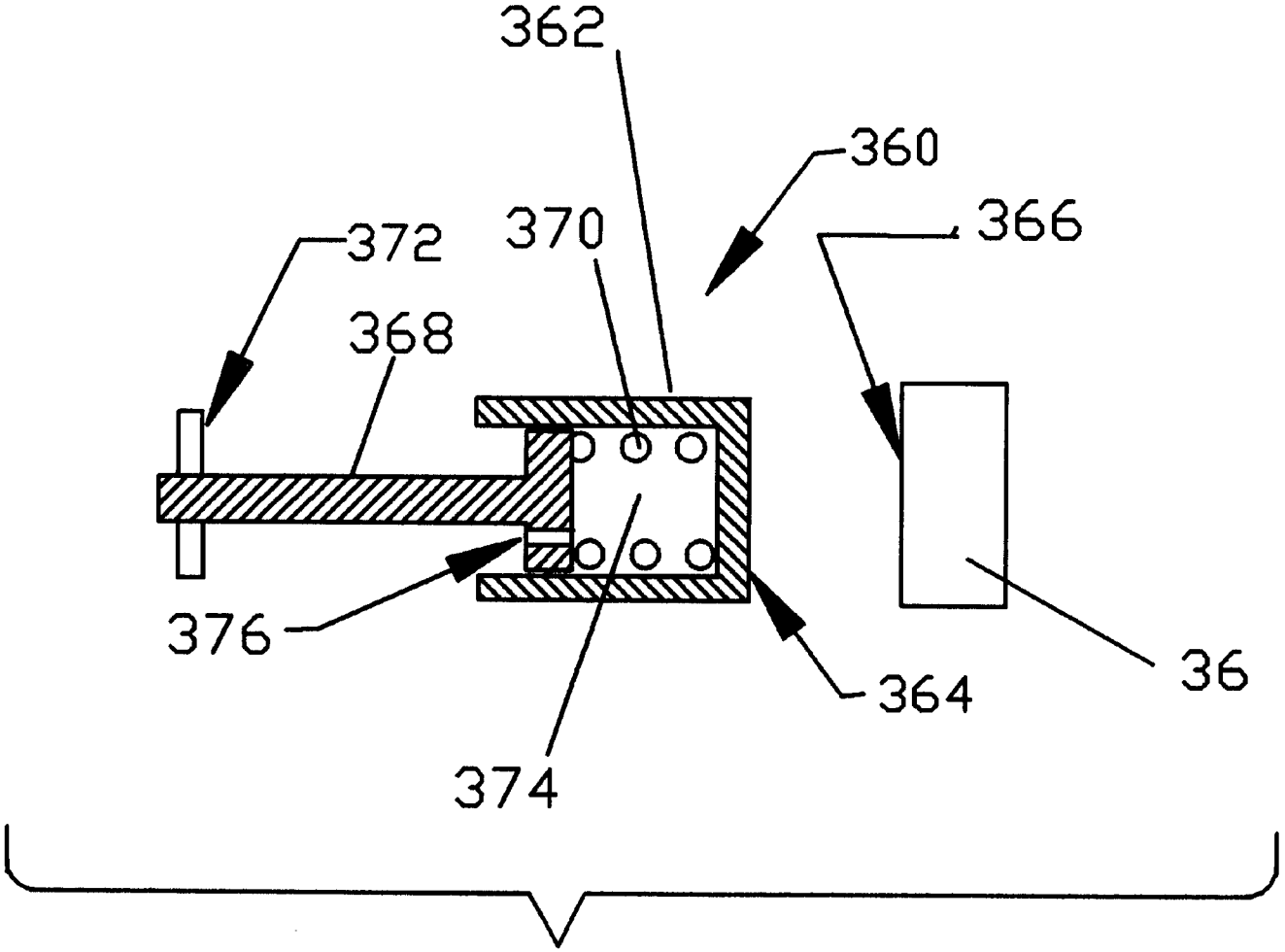
FIG. 29 is a side view of a piston stopping mechanism shown in partial cross-section and schematic view.

The kinetic energy of the rotating piston can also be dissipated using various mechanical, hydraulic, or other mechanisms such as, for example, stops, brakes, or clutches for stopping and holding the pistons. As shown in FIG. 29, a piston stopping mechanism 360 includes a cup member 362 having a smooth face surface 364 adapted to engage the lead face surface 366 of the moving piston 36. The cup member 362 is supported on a support arm 368 and is slidable thereover. A spring member 370 holds the cup member 362 in place on the support arm 368 and, further, biases the cup member to the right as viewed in the figure. The support arm 368 is connected to the stationary piston (not shown) using a suitable pivot support mechanism 372 or any other equivalent attachment means.

In operation, the piston stopping mechanism 360 absorbs the kinetic energy of the rotating piston 36 by using the kinetic energy to perform the work of compressing the spring member 370. The properties of the spring member such as, for example, the spring constant, length, and the like, are selected based upon the anticipated level of kinetic energy in the moving piston.

With continued reference to FIG. 29, additional energy dissipation is provided above and beyond the amount absorbed by the spring using a fluid reservoir 374 formed by the cup member 362 and an end of the elongate support arm 368. Fluid, such as air, contained within the reservoir 374 is permitted to escape through a precision orifice 376 formed on the face of the support arm 368. As the cup member 362 is urged to the left as viewed in the Figure, the fluid contained within the reservoir 374 escaping through the precision orifice 376 works in concert with the spring member 370 to absorb the kinetic energy stored in the moving piston 36 in an efficient fashion.

Kinetic energy absorption can be accomplished using other devices as well such as, for example, solid mechanisms that deflect or deform thereby absorbing kinetic energy. One example is an elongate tubular member having a small cross section and a large length relative to the cross section. Such a member would deform significantly when it is impacted by the moving piston 36 and, thereafter, spring back into its original configuration.

Figure 30:
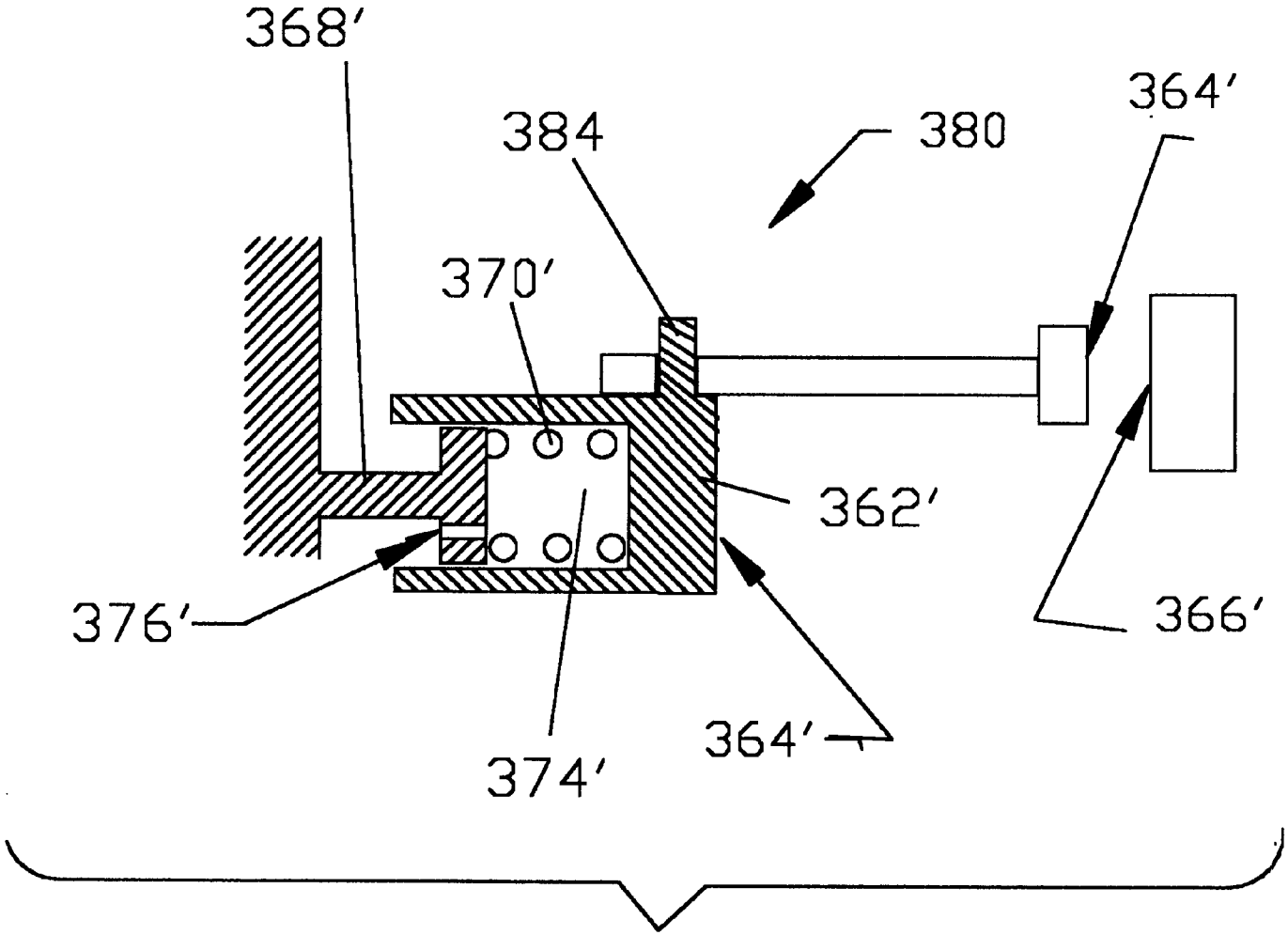
FIG. 30 is an alternative piston stopping mechanism shown in partial cross-section and schematic view.

FIG. 30 illustrates yet another piston stopping mechanism 380 useful in connection with the present invention. As shown there, an auxiliary stop member 382 is supported on a pivotable mounting tab 384 which is in turn connected to a cup member 362'. The cup member 362' is carried on a support arm 368' having a precision orifice 376', the operation of which was described above in connection with the piston stopping mechanism 360 shown in FIG. 29. The auxiliary stop member 382 includes an enlarged head region 386 having a face surface 364' adapted to engage the lead face surface 366' of the moving piston 36. The pivot motion provided by the pivotable mounting tab 384 enables the piston stopping mechanism 380 to absorb the kinetic energy contained in the moving piston by use of springs and dash pots.

Another method of absorbing the kinetic energy in the moving piston in expansible chamber type internal combustion engines is by controlling the ratio of the power stroke to the compression stroke. By increasing the compression stroke length and decreasing the power stroke length there is an offset in fluid compression resulting in an absorption of energy owing to the compression stroke. In that way, the rotating pistons are slowed and stopped at their predesignated positions. Further, in internal combustion engines, the piston impact can be controlled by regulating the timing of the ignition and the spacing of the intake and exhaust ports. The location of the ports can be controlled in a manner to limit the amount of impact generated by the moving piston at the time that it is necessary to stop.

Figure 31:
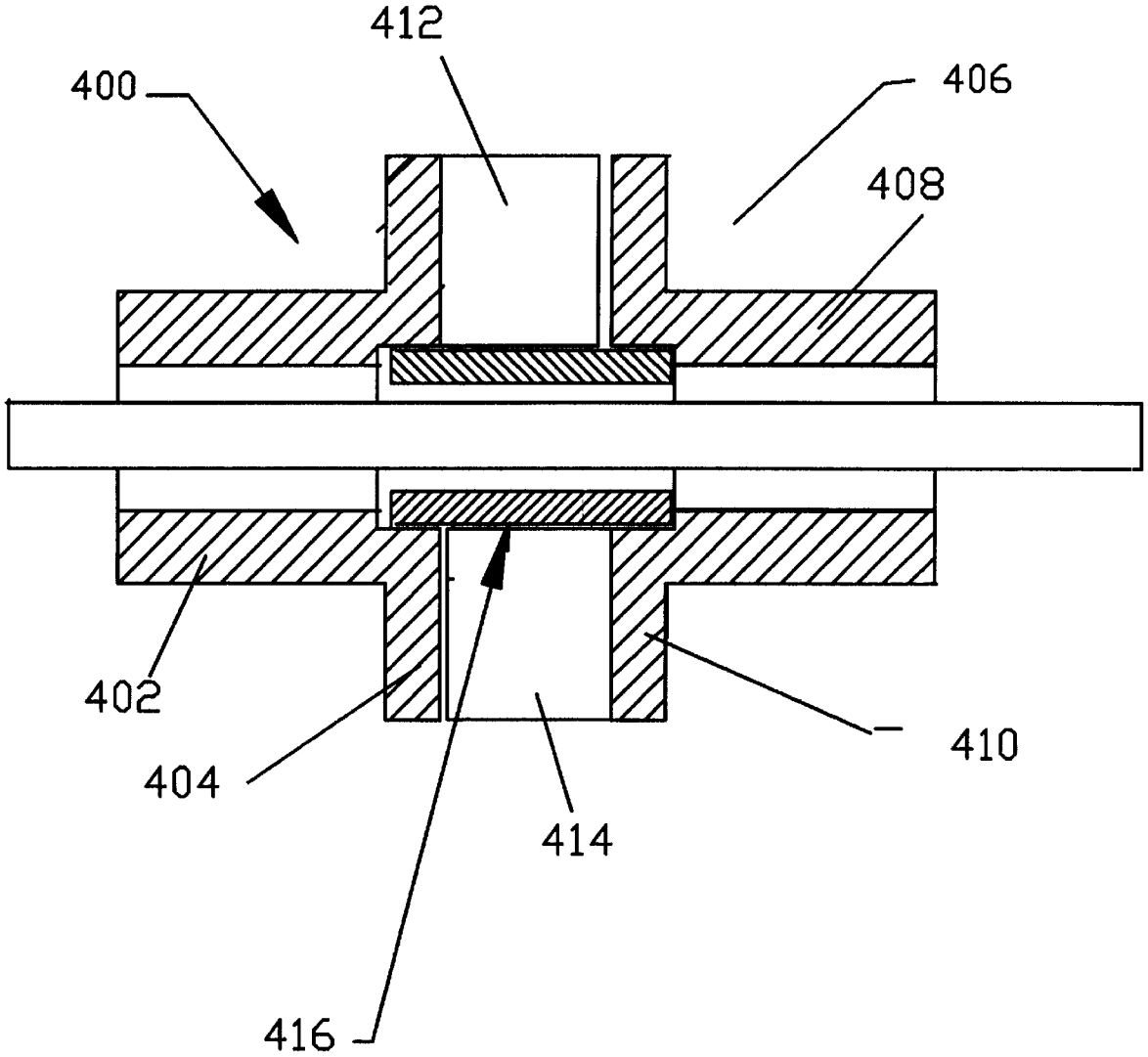
FIG. 31 is a side view in partial cross-section illustrating a preferred piston assembly configuration.

Various alternative piston assembly configurations are enabled in accordance with the preferred embodiments of the present invention. As shown in FIG. 31, a first piston assembly 400 includes a cylindrical shaft portion 402 and a circular side plate 404. Similarly, a second piston assembly 406 includes a cylindrical shaft portion 408 and a circular side plate 410. A first piston 412 is connected to the circular side plate 404 in a manner illustrated. Similarly, a second piston 414 is connected to the circular side plate 410 of the second piston assembly 406. Each of the pistons 412, 414 extend axially away from the circular side plate. The pistons rotate within a housing (not shown) which forms the outer circular wall of the working cavities. A cylindrical sleeve member 416 is disposed between the first and second piston assemblies in a manner shown so as to form an inner race for engagement with the inner axially extending edge of the first and second pistons. The cylindrical sleeve member is preferably disposed in the orientation illustrated independent of either piston assembly. However, the cylindrical sleeve member can be interagally formed with either of the piston assemblies as may be needed.

Figure 32:
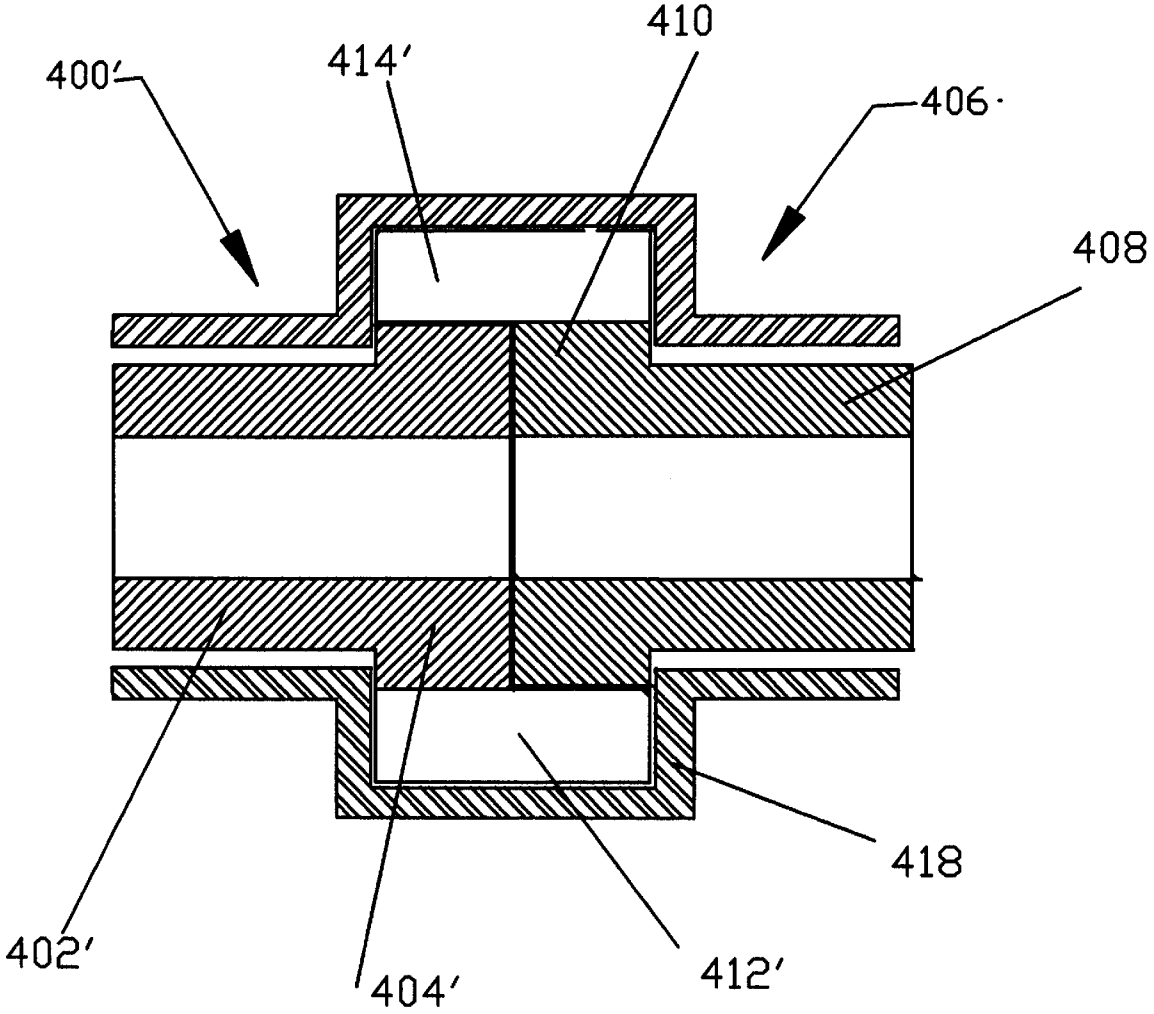
FIG. 32 is a side view in partial cross-section of an alternative preferred piston construction arrangement.

In FIG. 32, the first and second pistons 412', 414' extend axially in a manner so as to overlap the circular side plates of the opposite piston assemblies. As shown, the first piston 412' is attached to the outer circumferential edge of the circular side plate 404' of the first piston assembly 400'. Similarly, the second piston 414' is attached to the outer circumferential edge of the circular side plate 410 of the second piston assembly 406. The outer circumferential radiuses of the circular side plates together with a housing 418 form the side walls of the working volumes used in the internal combustion engine illustrated.

It is to be noted that the piston assembly constructions illustrated in FIGS. 31 and 32 are generally symmetrical. The piston assembly construction illustrated in FIG. 33, however, is not symmetrical. There, the first piston assembly 450 includes a cylindrical shaft portion 452, a circular side plate member 454, and a cylindrical extension member 456 as shown. The cylindrical extension member rotates in a shell type fashion forming the outer cylindrical wall of the working volumes of the internal combustion engine. The second piston assembly 458 includes a cylindrical shaft portion 460 and a circular side plate member 462. The second piston assembly does not include a cylindrical extension member. Rather, the cylindrical extension member 456 of the first piston assembly axially overlaps the circular side plate member 462 of the second piston assembly. A suitable seal is positioned between the overlapping cylindrical extension member and the cylindrical side plate member of the second piston assembly. A cylindrical sleeve member 464 is disposed between the first and second piston assemblies as shown. As with the piston assembly embodiments described above in connection with FIGS. 31 and 32, the cylindrical sleeve member 464 is preferably held in place independent of the rotation of the first and second assemblies. Alternatively, the cylindrical sleeve member can be attached to one or the other of the first and second piston assemblies.

Figure 33:
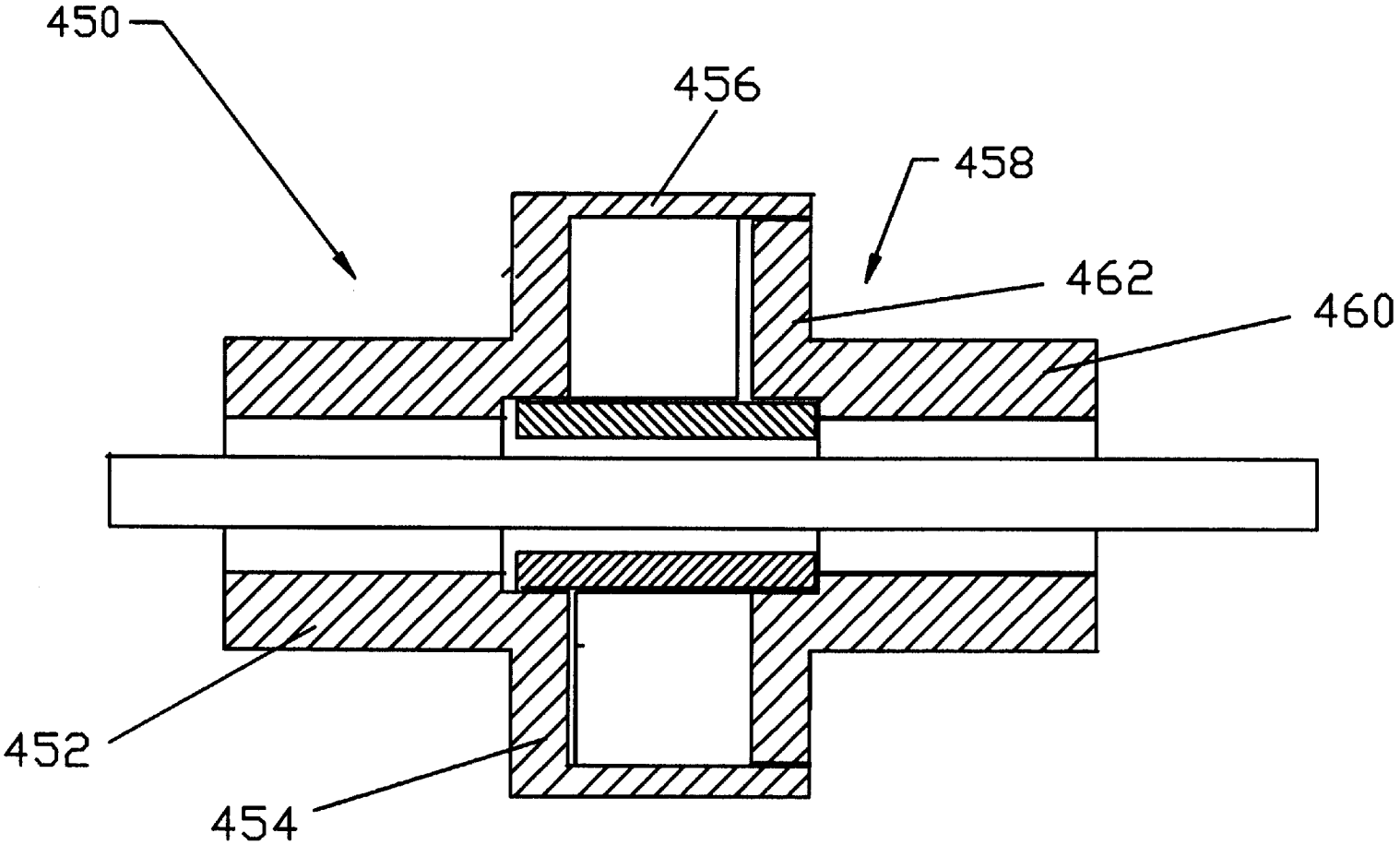
FIG. 33 illustrates an asymmetric piston assembly construction in partial cross-section.
Figure 34:
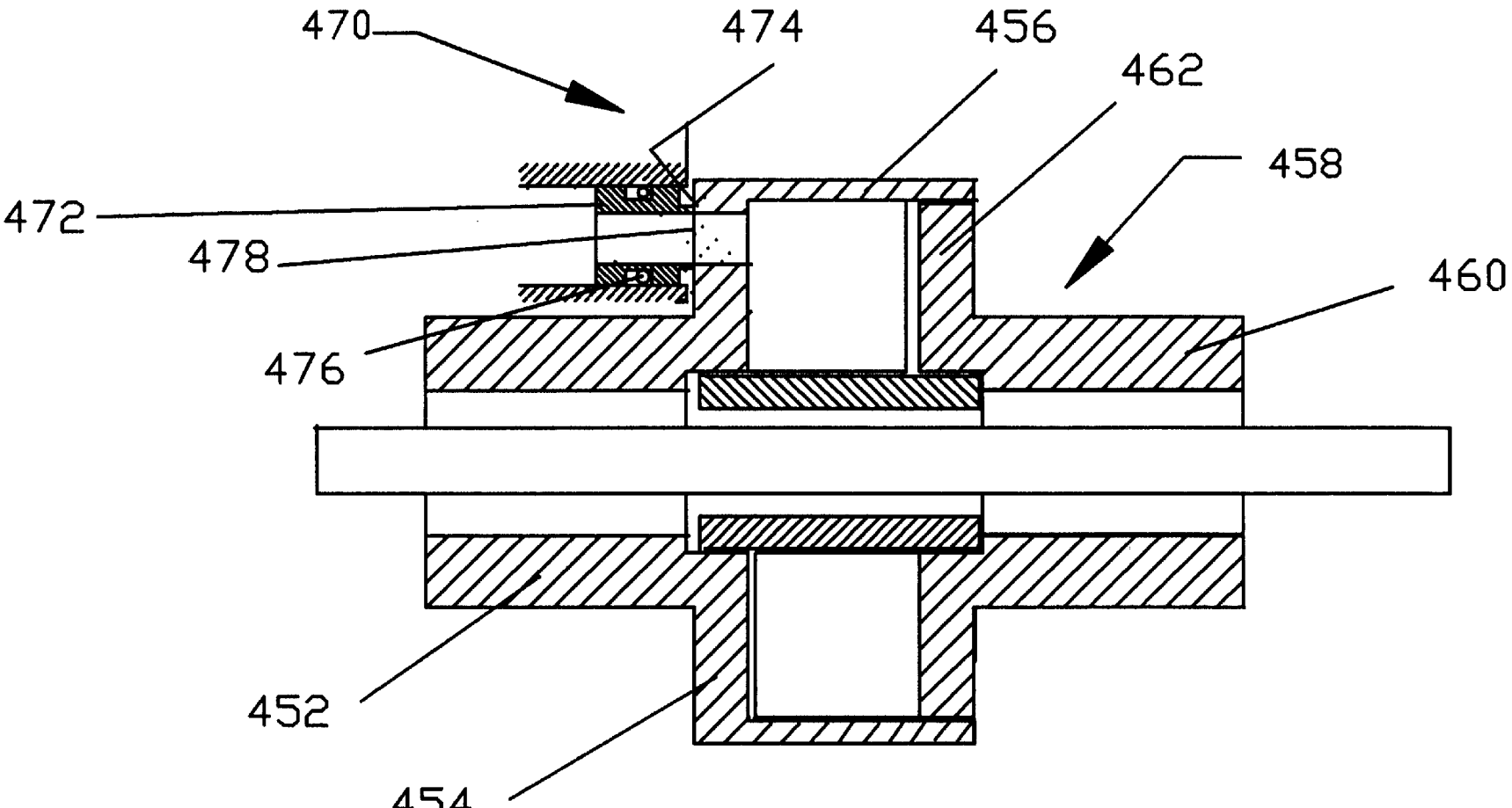
FIG. 34 illustrates a fluid port device of the type used in the piston assembly construction shown in FIG. 33.

FIG. 34 shows a fluid port device 470 useful in the piston assembly construction shown in FIG. 33 where a cylindrical extension member 456 overlaps the circular side plate member of the opposite piston assembly. In that implementation, the intake and exhaust ports must necessarily provide access to the working chambers through the side plates or on the periphery of the outer shell defined by the cylindrical extension member. The ports in the rotating piston groups must be aligned with matching ports provided in the housing with the respective piston assemblies held stationary. Leakage between the rotating parts is controlled by use of pressure loaded seals commonly found in the art. The pressure loaded seals are generally arranged independent of the moving cylinders as shown in FIG. 34. A movable cylinder 472 is held in place against the back side 474 of the circular side plate member 454 using a spring member 476 as shown. A longitudinal opening 478 extends through the movable cylinder 472 as shown to permit fluid flow into or out from the working cylinders.

Figure 35:
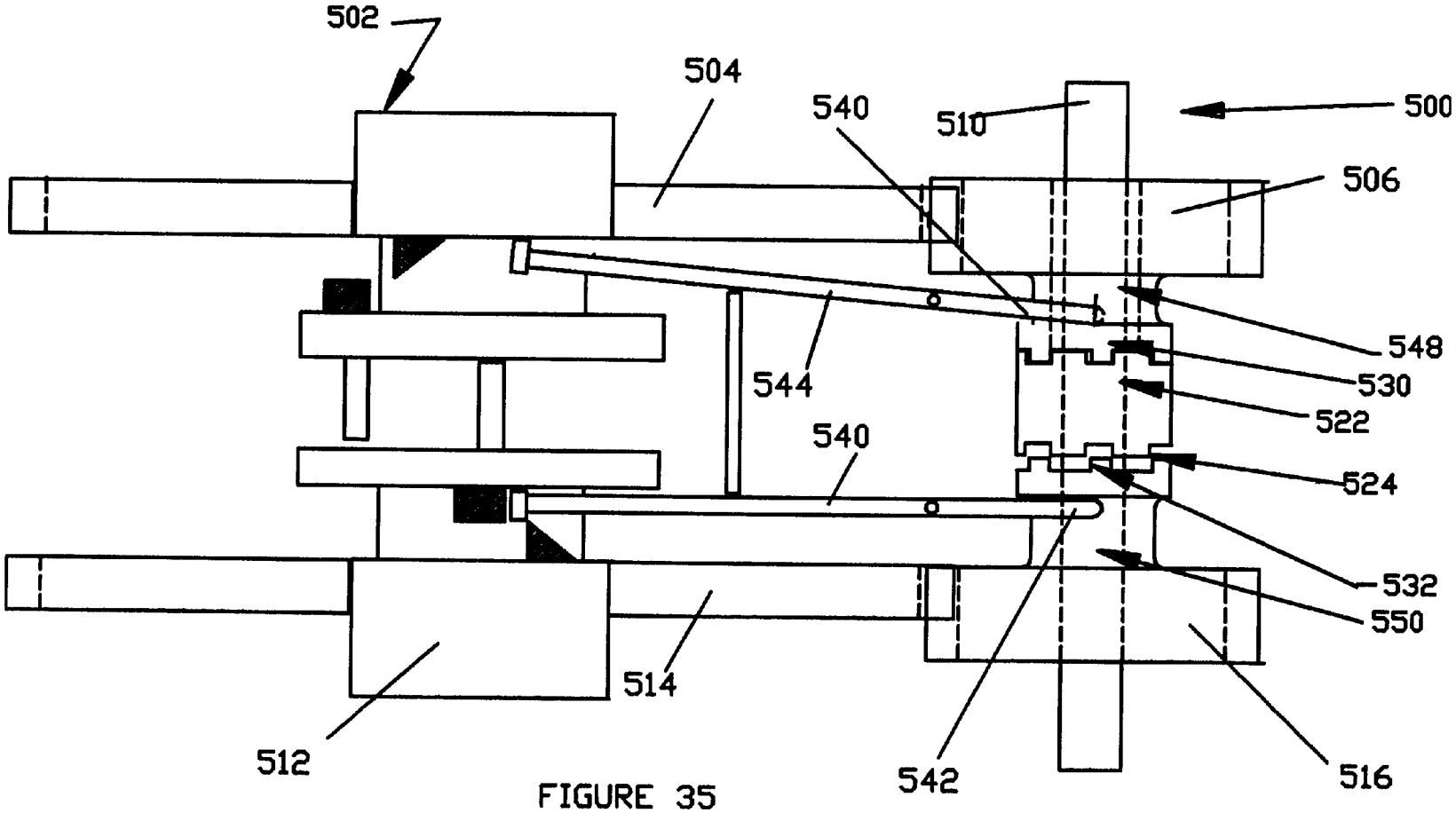
FIG. 35 illustrates a clutch-type mechanism in schematic form useful in starting expansible chamber internal combustion engines.

As noted above, when the subject expansible chamber device is used as an internal combustion engine, a number of starting methods and mechanisms can be used to initiate and sustain motor operation. FIG. 35 illustrates a gear clutch starting mechanism formed in accordance with the present invention. As shown there, the first piston assembly 502 is connected to a starting gear member 504 which is in turn enmeshed with a starter driving gear 506 as shown. The starter driving gear is slidable on an elongate drive shaft member 510 through use of a spline or other type of slidable connection. The second piston assembly 512 includes a corresponding starting gear member 514 enmeshed with a similar starter driving gear 516. The starting and driving gears 504, 506 associated with the first piston assembly are substantially formed as mirror images with the starting and driving gears 514, 516 associated with the second piston assembly.

A clutch hub member 520 is fixedly attached to the drive shaft member 510 between the starter driving gears 506, 516 of the first and second piston assemblies, respectively, as shown. The clutch hub member includes the first and second sets of engagement teeth 522, 524 as shown. The engagement teeth on the clutch hub member are adapted to engage a corresponding first and second set of engagement teeth 526, 528 formed on engagement regions 530, 532 of the starter driving gears 506, 516 as shown.

As shown in FIG. 35, engagement ends 540, 542 of the elongate pivotable members 544, 546 are adapted to slidably engage corresponding grooves 548, 550 formed on the starter driving gears 506, 516, respectively. Operationally, as the elongate pivotable members pivot in response to engagement with the ramps formed on the first and second piston assemblies, the engagement ends thereof pivot as well, urging the starter driving gears 506, 516 into and out of engagement with the clutch hub member 520 so that input power delivered to the drive shaft member 510 can be transmitted to the appropriate first or second piston assembly to urge the combustion engine into starting rotation.

Figure 36:
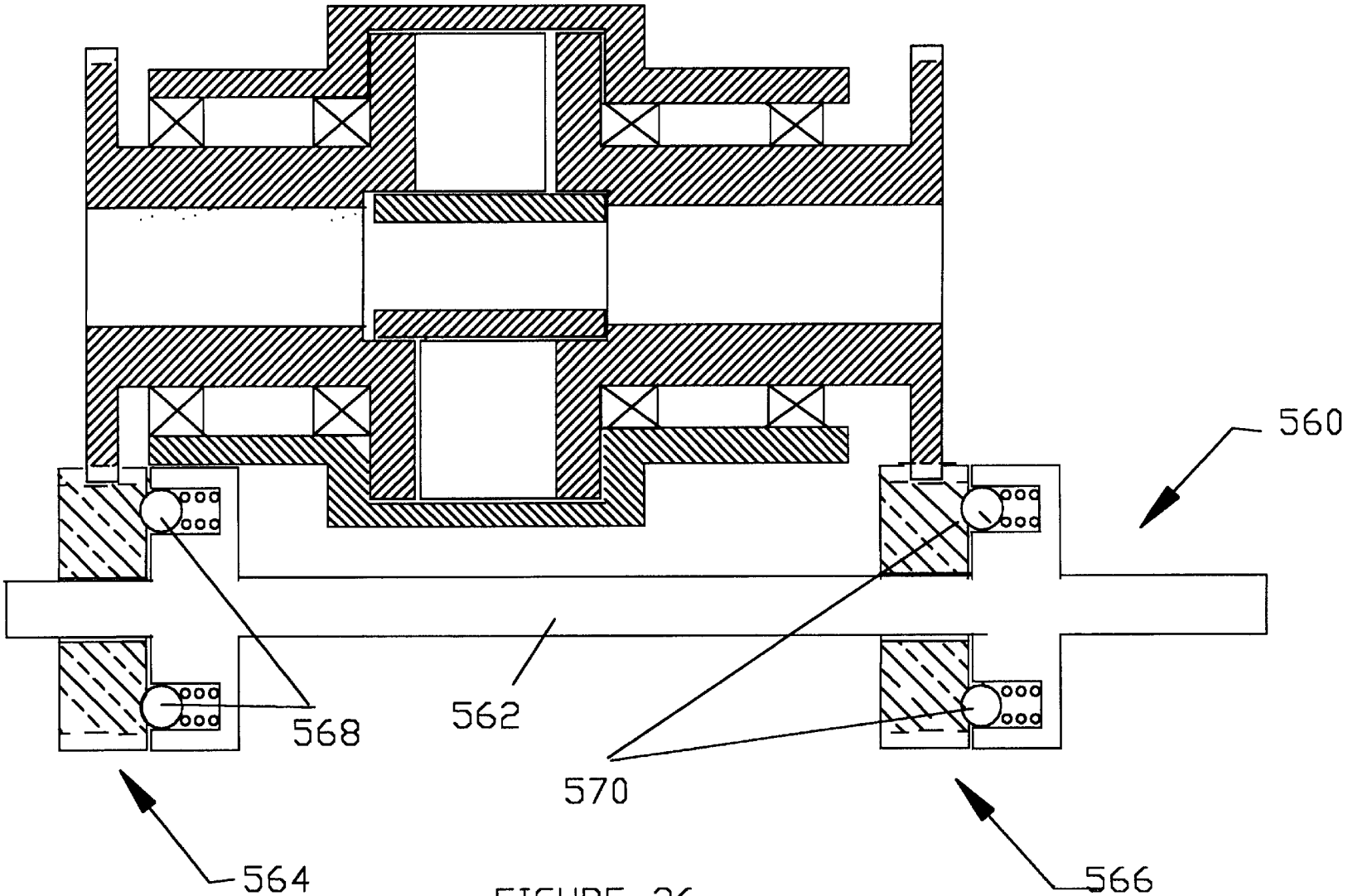
FIG. 36 illustrates in partial cross-section and schematic form a gear clutch starting mechanism for starting an expansible chamber internal combustion engine.

FIG. 36 shows another gear clutch starting mechanism 560 for starting the subject expansible chamber device when used as an internal combustion engine. A starter input shaft 562 is connected to the first and second piston assemblies through first and second slip 230 clutches 564, 566. Operationally, as the input shaft 562 is rotated, both piston assemblies are set in motion unless one of the piston assemblies is in the stopped orientation. That stationary piston assembly presents a resistance to further rotation which is sensed by first and second torque sensors 568, 570 disposed in the first and second slip clutches 564, 566, respectively. When one or the other slip clutch mechanisms sense that the first or second piston assemblies are stopped, the corresponding slip clutch assembly allows relative motion between the shafts and the piston assembly. The shaft continues to rotate and drive the free piston assembly. It is to be noted that the starting mechanism 560 illustrated in the figure can also be used to transfer energy from the first and second piston assemblies to the input shaft 562. In that mode, the input shaft would in effect function as an output shaft.

Figure 37:
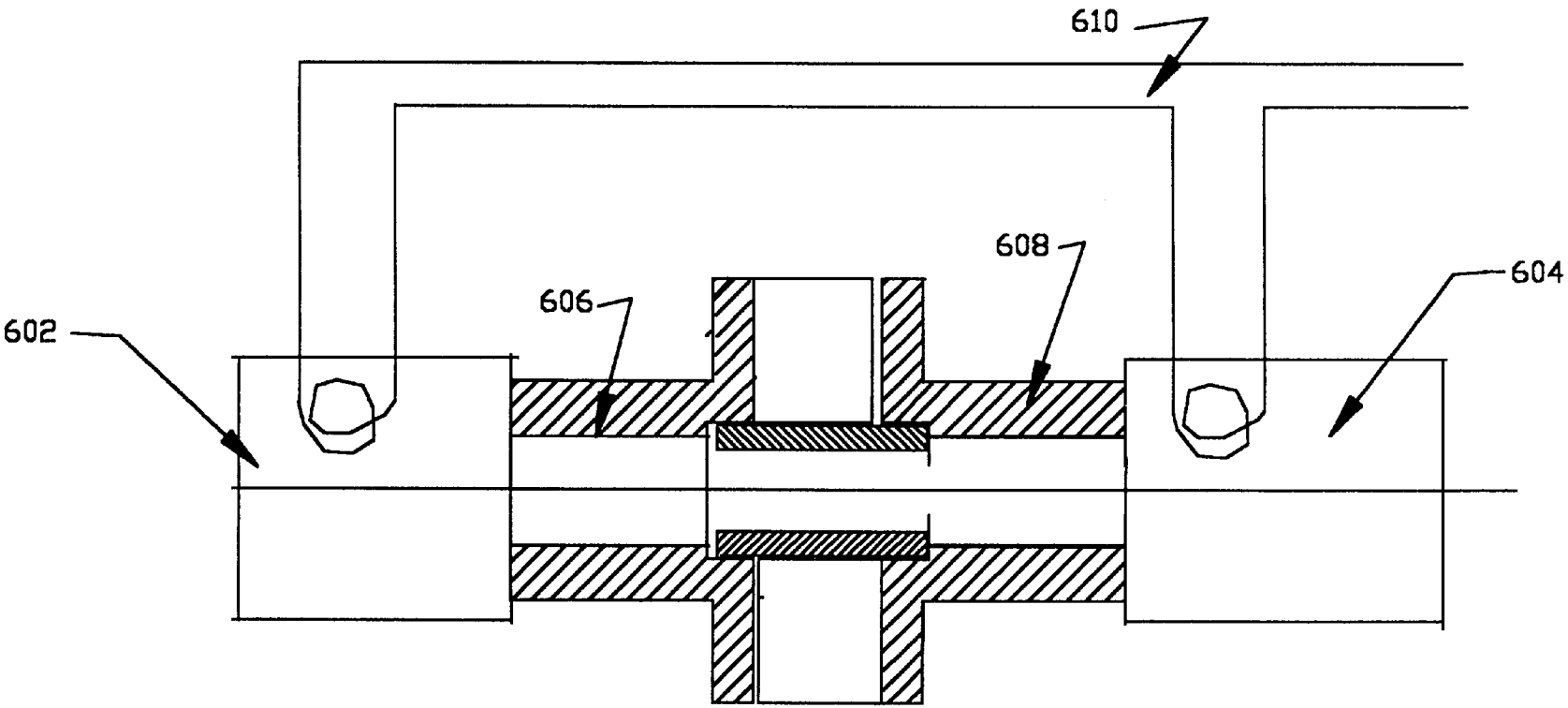
FIG. 37 illustrates in partial cross-section and schematic form an expansible chamber internal combustion engine configured to generate complimentary electric currents in a manner to develop continuous sustained electrical output.

FIG. 37 illustrates a pair of electric generators 602, 604 connected to the first and second pistons assemblies 606, 608 so that each of the piston assembly outputs can be used directly in their discontinuous operation. Each of the piston assemblies 606, 608 drives a corresponding electric generator 602, 604 to generate current through a continuous loop 610 as shown.

Figure 38:
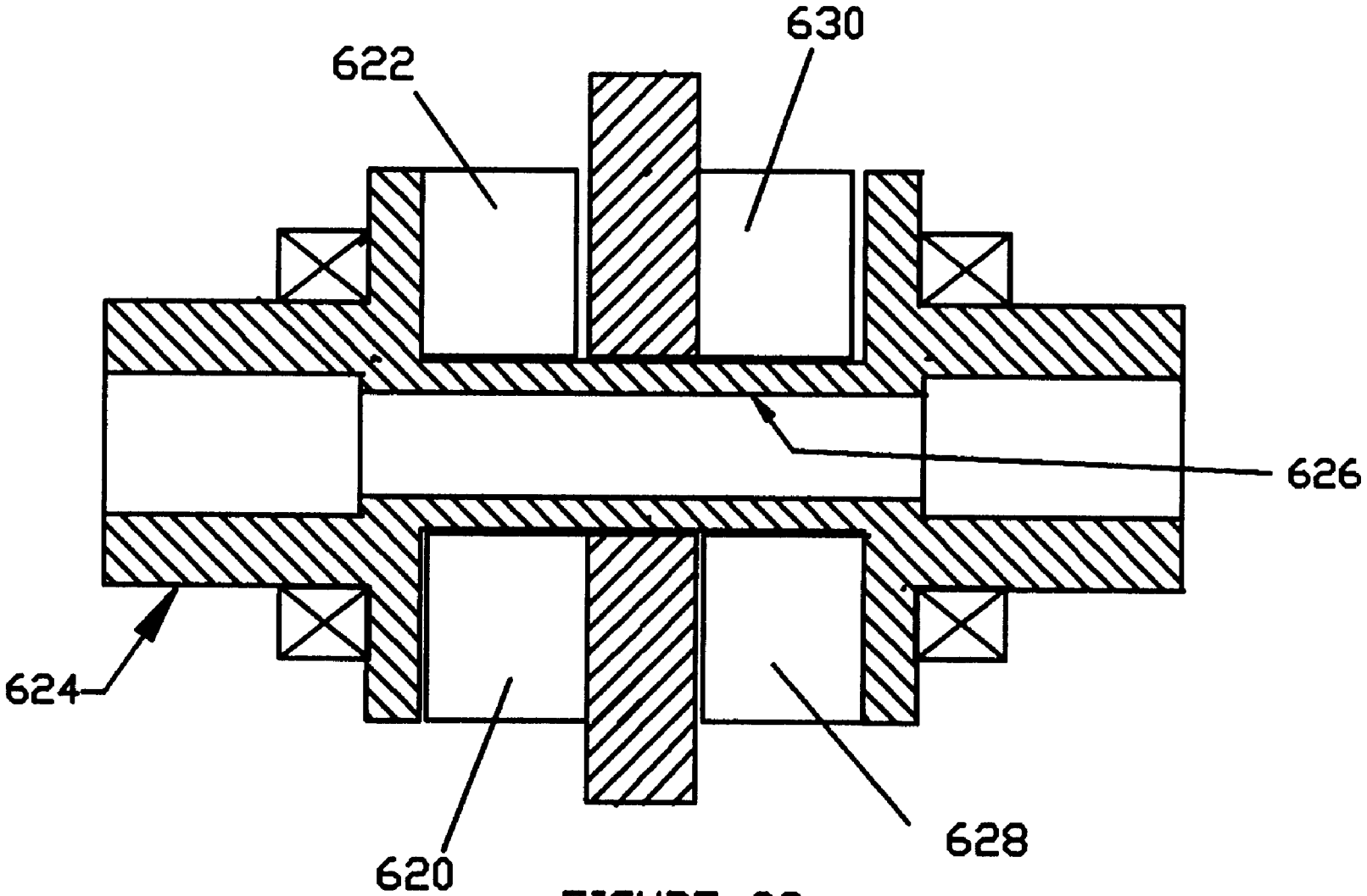
FIG. 38 illustrates an expansible chamber internal combustion engine in partial cross-section used to drive a pump.

FIG. 38 illustrates the use of the present invention to drive a pump such as, for example, a compressor. As shown there, the internal combustion engine is driven by first and second pistons 620, 622. The second piston is connected to an output shaft as illustrated. The output shaft, is in turn connected to an elongate hollow shaft 626 which passes through the center of the subject device. Further, the elongate hollow shaft is connected to a compressor pump piston 628 as shown. The first piston 620 of the internal combustion engine is associated with the same side plate as the second pump piston 630 as shown. The entire mechanism is supported by a set of bearings 632.

In the pump embodiment shown in the Figure, the internal combustion engine preferably includes four pistons so that a pressure balance is obtained. Preferably, the pump includes the same quantity of pistons. However, since the pump is pressure balanced with two pistons per side plate for a total of four pistons per pump, an unequal number of pump pistons as compared to the number of motor pistons is possible.

Operationally, as the first piston 620 rotates, its matching pump piston 630 also rotates and stops when the matching power piston 620 stops. Similarly, the other engine piston 622 rotates or stops as the matching pump piston 628 rotates and stops.

In this embodiment, the internal combustion engine has two power volumes, two exhaust volumes, two intake volumes, and two compression volumes. The pump has two intake and two compression volumes such as shown generally in FIG. 3 above. When a four piston per side pump is used, there are four pump intake and four pump compression volumes are formed. Thus, in this implementation, an internal combustion engine directly drives a pump or compressor without the need for the continuous rotation commonly found in traditional motors and internal combustion engines.

It is common in the internal combustion engine art that pistons develop leakage paths which occur around the ends of the piston. Commonly, leakage paths are held in check by control of the clearance around the ends of the pistons. In some cases, it is advantageous to reduce the leakage by use of pressures generated within the device to move the side walls against the sides of the pistons thus reducing the side clearances to nearly zero.

Figure 39:
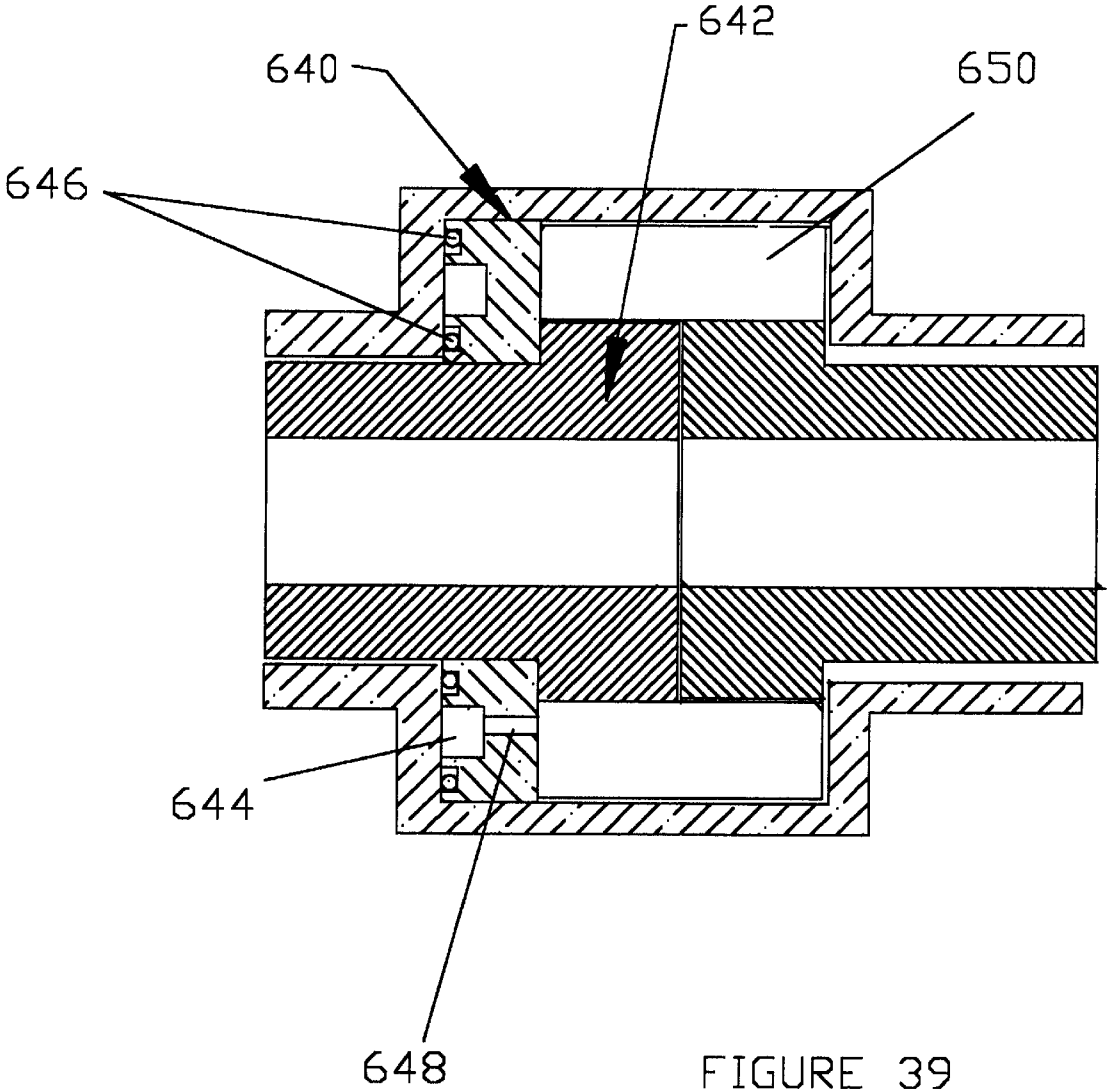
FIG. 39 illustrates in partial cross-section a device for limiting leakage paths so around pistons of an expansible chamber device.

One such method is shown in FIG. 39. The movable side plates 640 are comprised of plates that abut against one of the rotating piston assemblies 642. The movable side plate 640 is axially movable but does not rotate. A cavity 644 is formed in the movable side plate 640 as shown. In addition, seals 646 are provided on one side of the movable plate. Multiple cavities' are also possible. The one or more cavities 644 are adapted to be pressurized by means of a passage 648 formed in the movable side plate. The passage is connected to the appropriate chamber within the motor or pump. For an internal combustion engine, the passage provides pressure from the burning power chamber to pressurize the cavity 644. When properly sized, the resultant force within the cavity 644 biases the movable side plate 640 against the piston 650. Thus, the result is a minimal clearance around the ends of the pistons to produce leakage by this path. It is to be noted that the location, size, and shape of the cavities are determined by the time, displacement, pressure relationships and other factors within the various working cavities.

Figure 40:
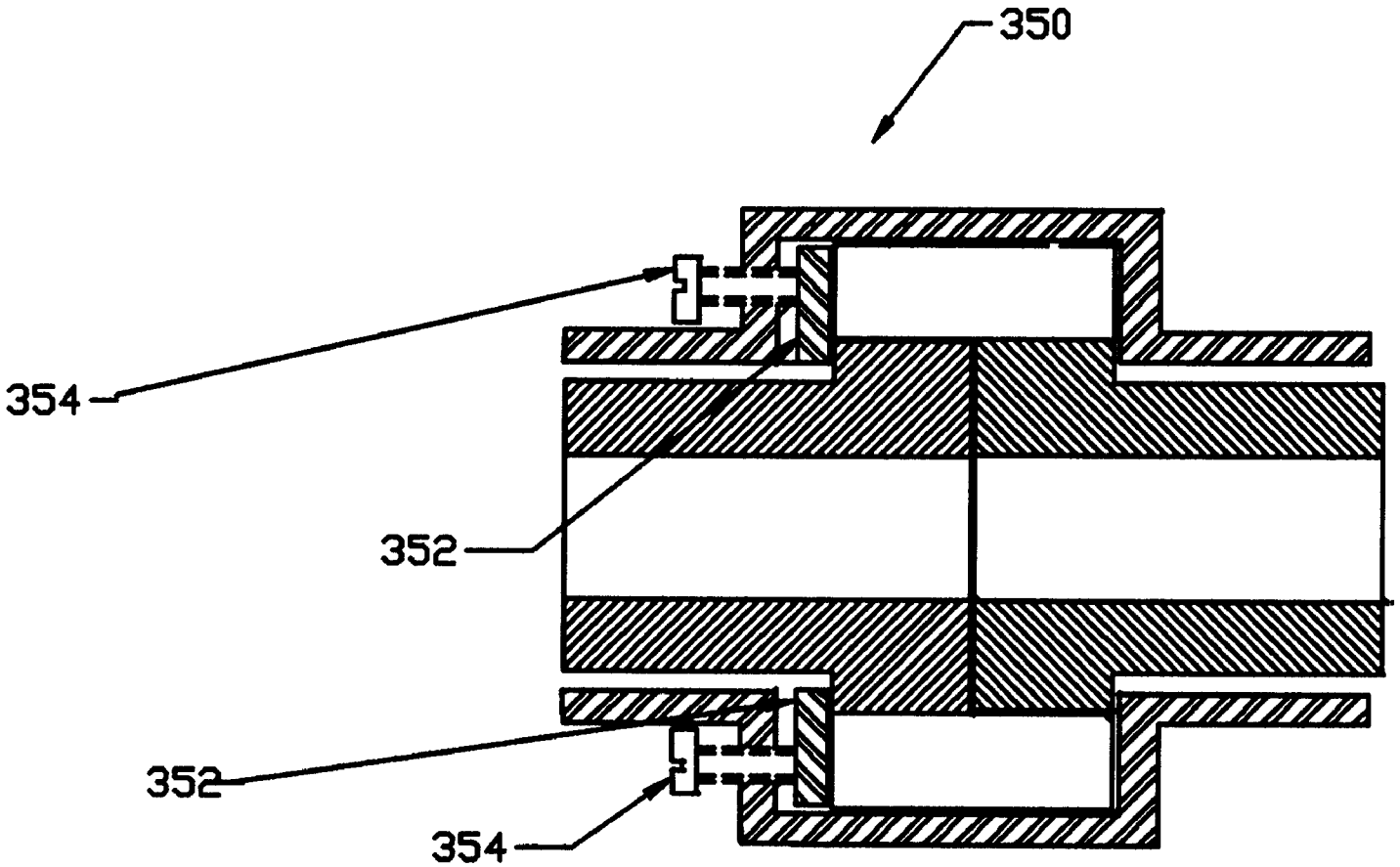
FIG. 40 shows in partial cross-section a piston wear compensation device useful in expansible chamber devices.

Compensation for piston wear and to provide for a reduction of leakage clearance can also be mechanically accomplished as shown in FIG. 40. As illustrated there, a wear compensation system 350 includes a wear plate 352 held in place by a set of adjustment screws 354 as shown. The wear plate is biased into engagement with the first and second piston assemblies so that the amount of leakage clearance can be precisely controlled. The screws 354 are selectively adjusted to tighten the wear plate into engagement with the piston assemblies to minimize the amount of piston side clearance and thereby reduce leakage.

Figure 41:
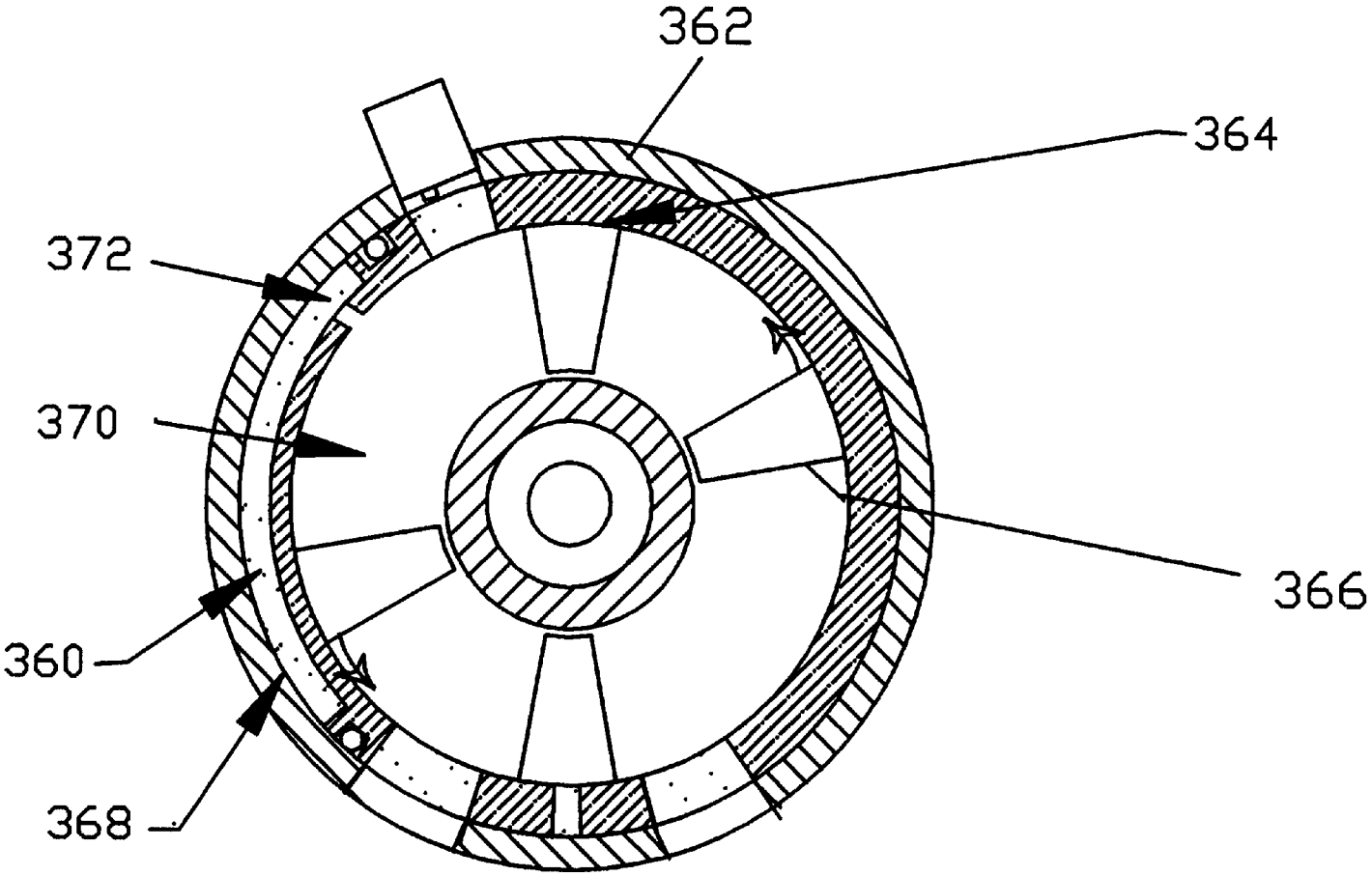
FIG. 41 is an end view of an expansible chamber device in partial cross-section showing a system for limiting loss of pressure in an internal combustion engine.

Leakage around the periphery of the pistons is controlled in a similar manner in the system illustrated in FIG. 41. As shown there, a ring member 360 is disposed between the housing 362 of the expansible chamber device and the rotating piston groups 364, 366. The ring member 360 is constructed from a material enabling it to be deformable in use such as may be required due to radial forces generated in the expansible chamber devices. The ring member is disposed in the expansible chamber device as illustrated in a manner such that it is free to move as necessary. Further as illustrated, a cavity 368 is connected to the combustion chamber 370 of the expansible chamber device through a passage 372. As shown, the cavity 368 is located between the ring member 360 and the housing 362. The cavity is pressurized through the passage 372.

Operationally, the internal pressure generated in the combustion chamber 370 is communicated to the cavity 368 through the passage 372 thus urging the ring member 360 to move in a radial direction against the periphery of the pistons, thus sealing them against leakage. The cavity is formed on the external side of the ring member and is sized appropriately so that the resultant force acting on the ring member causes the ring to move in a direction to effect a seal. The deformation of the ring member occurs because of the flexibility of the ring due to its size and, more particularly, owing to the materials used in the ring construction. The flexibility of the ring member can be increased by the use of a discontinuous ring having an opening suitably located to allow the deformation of the ring in a sealing manner. To that end, a discontinuity in the form of a split 374 is formed on the ring member so that it can expand, contract, and move between the housing and the rotating piston groups as necessary.

Figure 42:
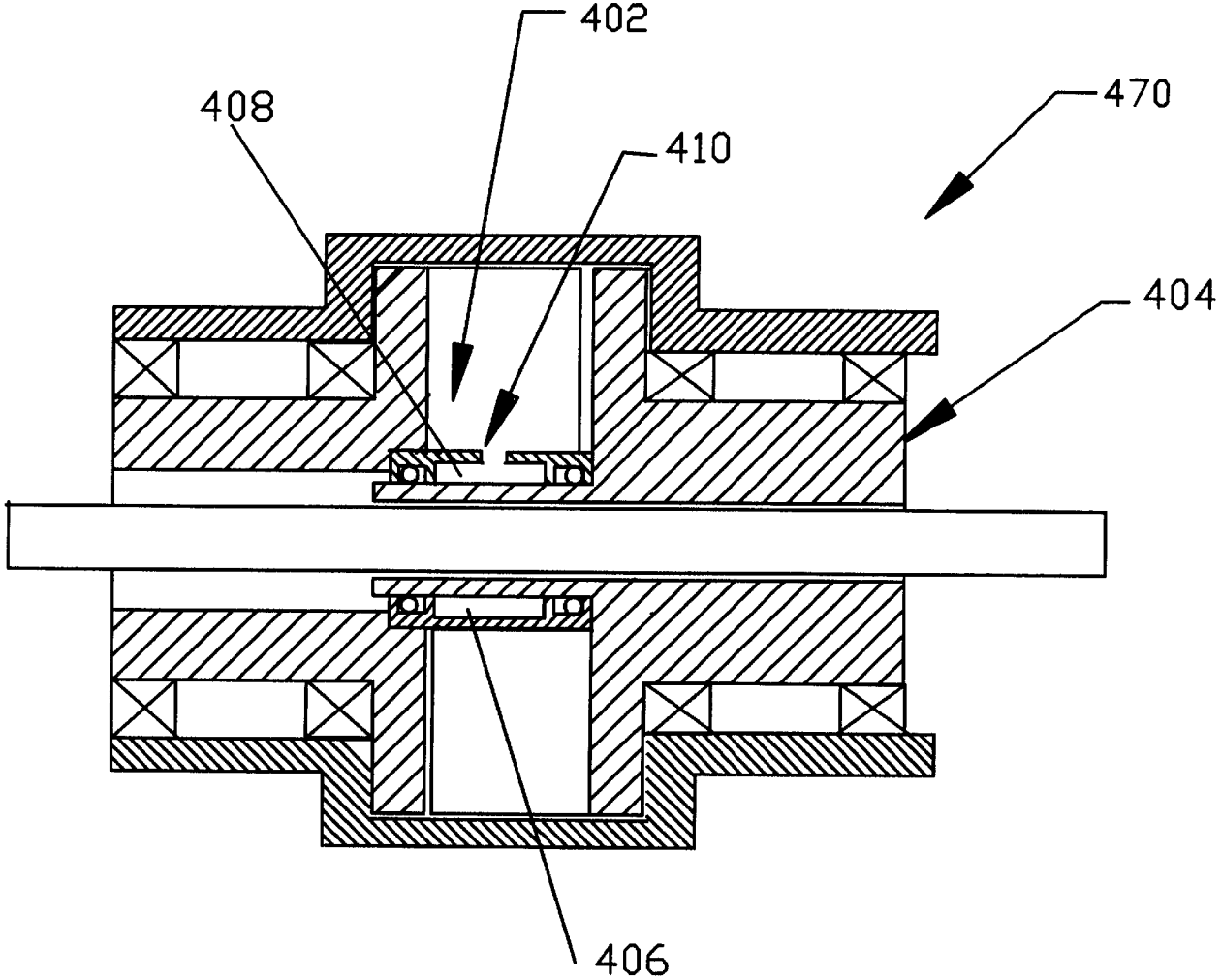
FIG. 42 shows a sealing system in cross-section using a deformable seal on the inside diameter of working volumes of an internal combustion engine.

FIG. 42 shows a sealing system 400 that uses a deformable seal 402 on the inside diameter of the working volumes. The deformable seal is made to rotate with one of the piston assemblies such as, for example, the second piston assembly 404. A pair of cavities 406, 408 are formed in the seal 402 as shown. The cavities are in fluid communication with the working volumes through a set of passage 410. The cavities and set of passages allow for the pressure to change within the deformable seal as the rotating piston assemblies move. Accordingly, the pressure around the periphery of the deformable seal fluctuates during operation of the system 400. Thus, by use of the number of cavities and passages, the deformation of the seal 402 is produced locally as needed. As in the discussion above in connection with the ring member 360, the deformable seal 402 of the embodiment illustrated in FIG. 42 can be made in sections and, further, can be formed in a discontinuous fashion or, further, can be made deformable through the select use of materials and the thickness and arrangements of the materials used.

Figure 43:
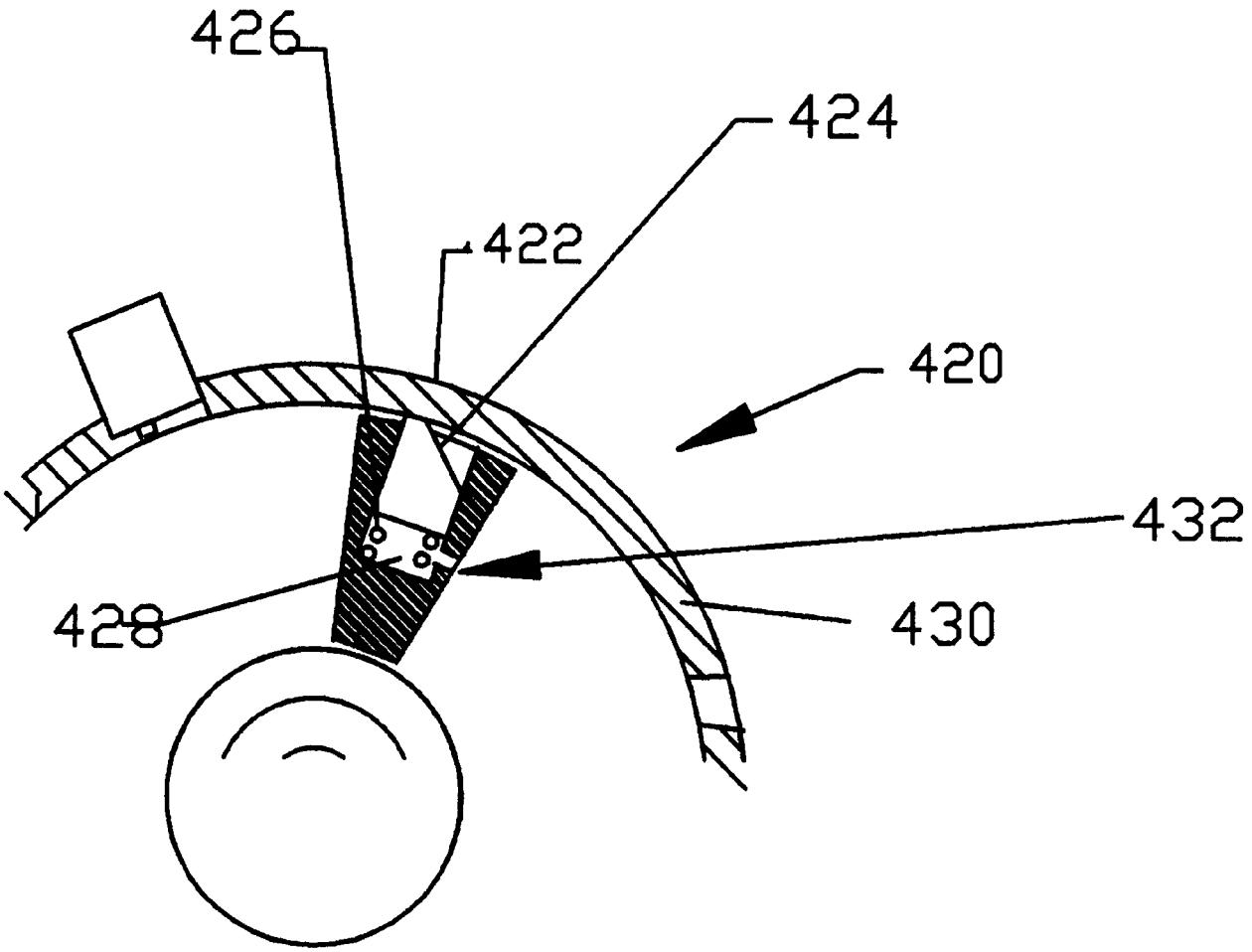
FIG. 43 illustrates in partial cross-section and schematic form a sealing system incorporating a sliding seal.

FIG. 43 illustrates a sealing system 420 that incorporates a sliding seal 422 in each piston to reduce the clearance around the piston ends. As shown there, a vane 424 extends along the axial length of the piston. A spring member 426 is disposed within a cavity 428 formed in the piston body and engages the vane 424 to urge the vane radially outwardly into engagement with the outer housing 430 of the expansible chamber device. Centrifugel force also moves the vane 424 outwardly to close leakage paths. The sealing of the vanes can further be aided by pressure which enters into the cavity 428 through a passage 432. The passage can be formed to lead to any source of pressurized fluid that may be appropriate based on application of the expansible chamber device. In addition, the vane 424 can be suitably contoured as necessary such as into the triangular shape illustrated in FIG. 43. Preferably, the contour of the vane is fashioned to result in optimal sealing and wear.

Figure 44:
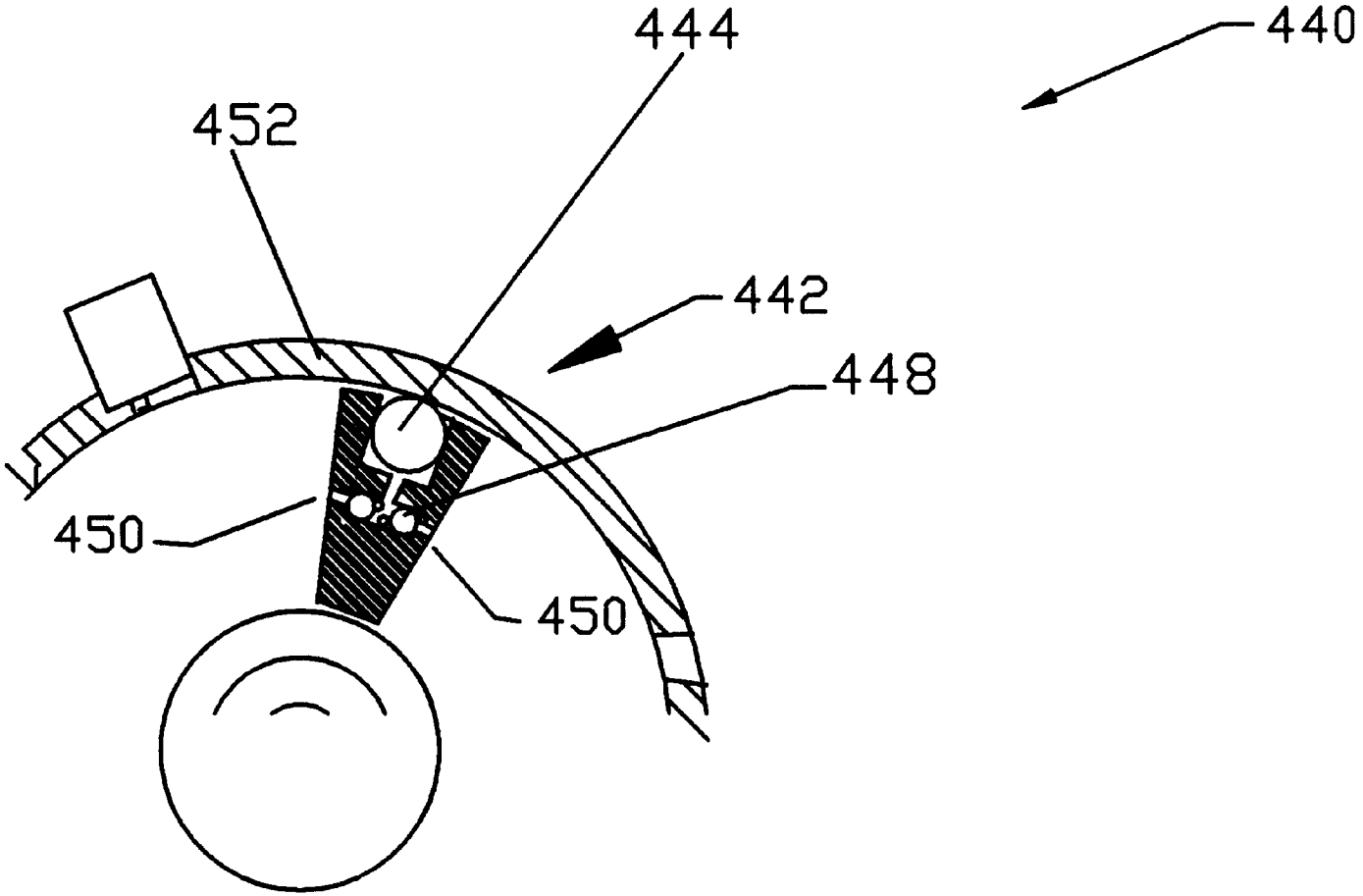
FIG. 44 illustrates in partial cross-section and schematic form a sealing system using a rolling cylinder seal.

As shown in FIG. 44, an alternative sealing system 440 includes a sliding seal 442 that includes a roller cylinder member 444 contained within a pocket 446 formed in the piston as illustrated. A check valve 448 permits the flow of pressurized fluid through a set of orifices 450 and into the pocket 446 to urge the roller cylinder member 444 into engagement with the outer housing 452 to effect a seal. It is to be noted that the check valve 448 and set of orifices 450 enable pressurized fluid from either the leading side or the trailing side of the piston assembly to enter into the pocket 446.

Figure 45:
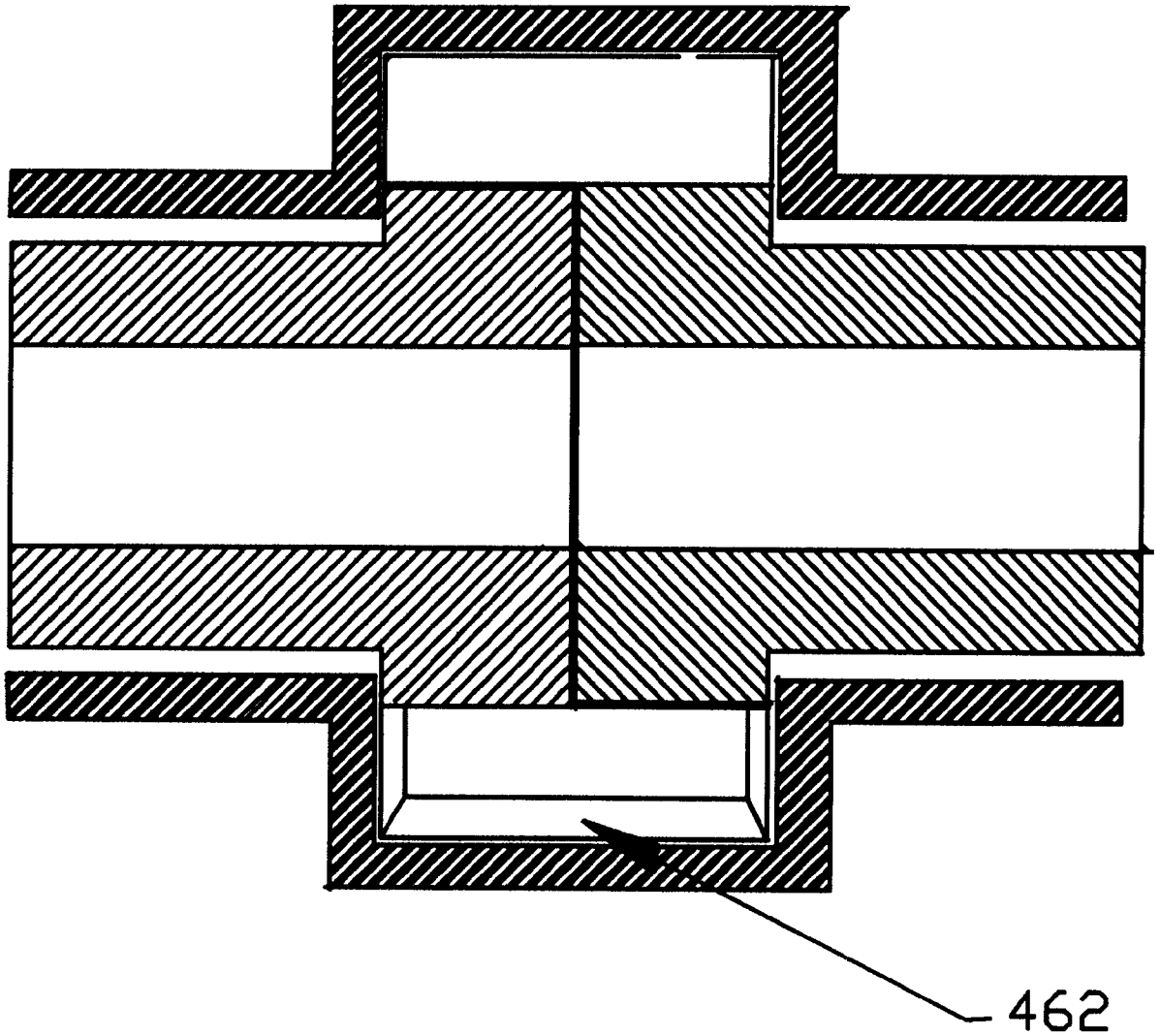
FIG. 45 shows in cross-section a 3-piece sealing vane.

FIG. 45 shows a three-piece sealing vane 460 having an outer portion 462 for sealing the outer periphery of a piston, and a left and right portion 464, 466 for sealing the respective left and right sides of the piston. In their preferred form, the left and right portions 464, 466 of the three-piece sealing vane are movable radially outwardly, but, because of the cam action of the contact planes, the left and right portions also move axially to seal the ends of the piston. These motions can further be assisted through use of springs, pressure passages, contours, and the like.

Figure 46:
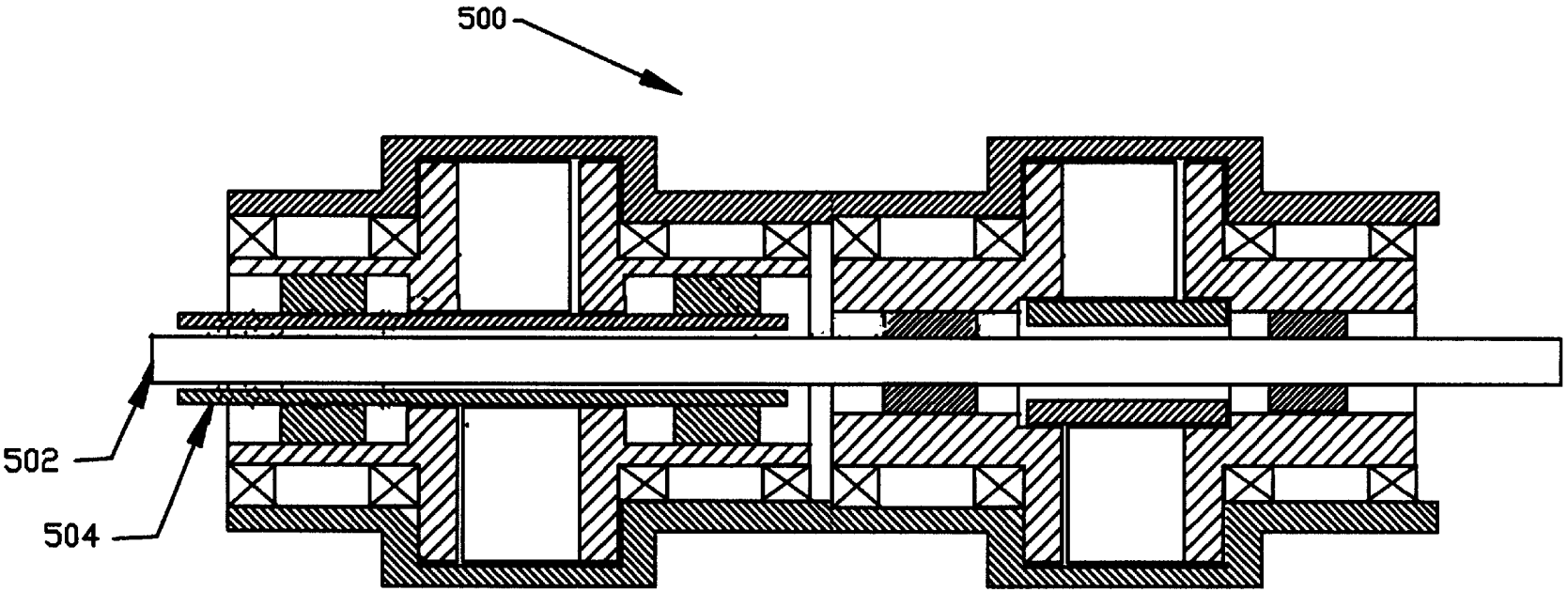
FIG. 46 shows the manner in which a pair of expansible chamber devices having different characteristics can be stacked together for cooperative operation.

As noted briefly above, expansible chamber devices having differing characteristics such as, for example, motors and pumps can be grouped together into a single housing. A preferred example indicated is the combination of an internal combustion engine that drives a pump or a compressor. These devices are preferably connected together either by using common elements such as bearings or side walls or, alternatively, can be connected together using a common shaft. In some applications, it is useful to group similar types of devices together such as two or more motors that are driven from a common output shaft. This arrangement has many advantages in terms of output power, redundancy for safety reasons, the ability to change power by large magnitudes by turning one unit on or off for efficiency reasons, package performance, cost reductions, and reduced tooling costs. In that case, it is preferred that both the housings and the output shafts are connected together, or, alternatively, formed integrally. Also, by combining pairs of units in a single housing in a device 500 having two output shafts 502, 504 such as shown in FIG. 46, the output shafts can rotate in the same direction or, rather, can be fashioned to counter rotate. The counter rotating case is useful in aerodynamics and marine applications where driven elements such as, for example, propeller blades or compressor blades can be optimized by the counter rotating motion provided by the pair of output shafts 502, 504. The output shafts can be driven from the pair of piston assemblies directly by either sprag clutches 506 such as shown in the figure or by other means and mechanisms as noted above.

Figure 47:
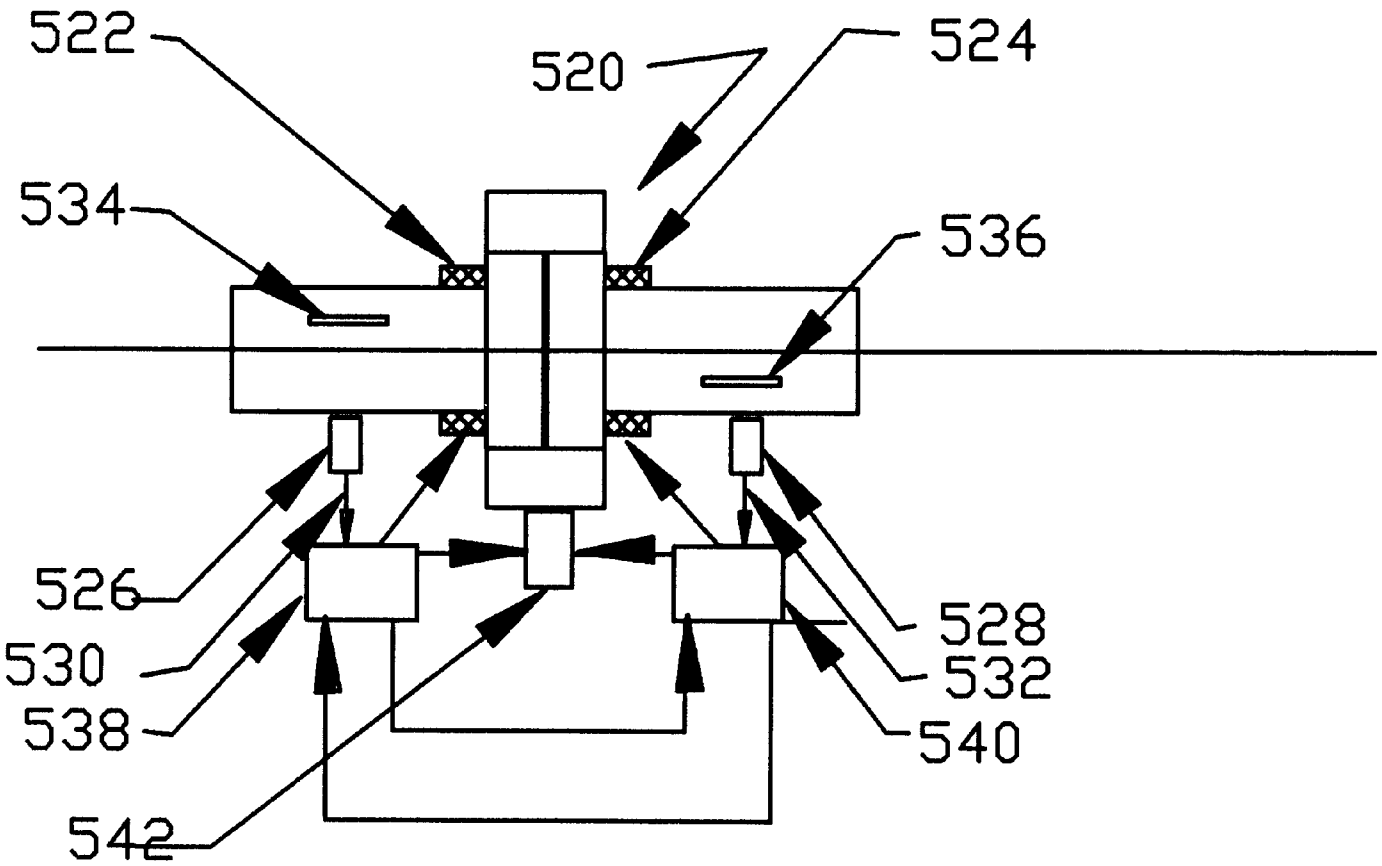
FIG. 47 illustrates an electronic piston position center useful in expansible chamber internal combustion engines.
Figure 48:
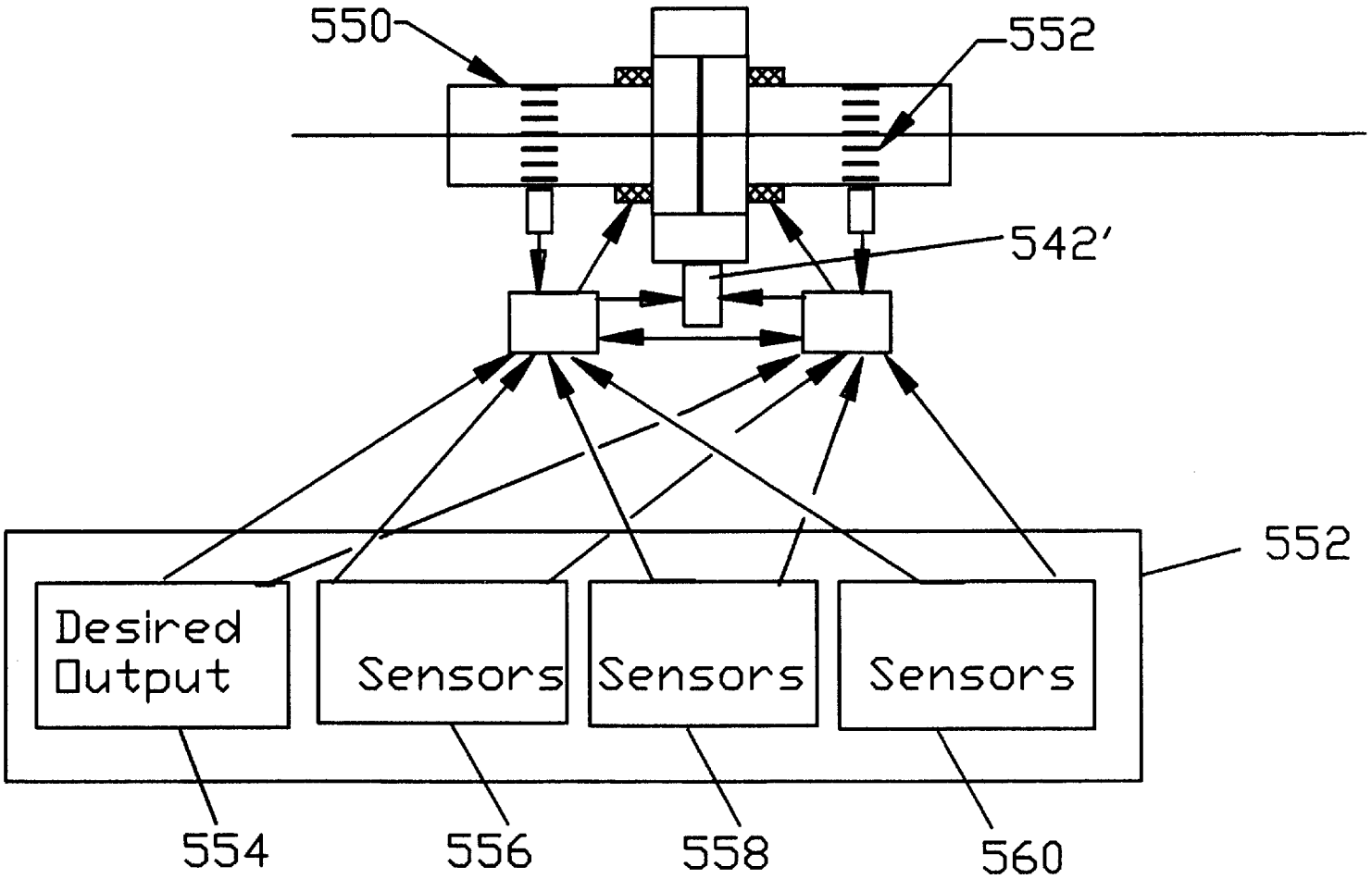
FIG. 48 illustrates an electronic control and ignition system useful in an expansible chamber internal combustion engine; and, FIG. 49 illustrates a bypass control valve in an expansible chamber device.

As noted above, mechanical braking mechanisms are used to alternately stop and hold the rotating piston assemblies to cause intermittent rotation of the first and second piston assemblies in the same direction during recurrent periods of rotating. It is further possible, however, to effect the timing of the motion of the piston assemblies using electronic means as shown in FIGS. 47 and 48 formed in accordance with the present invention. In general, the electronic means senses the position of each group of pistons electrically. A mechanical sensor such as a switch or set of switches are activated at a selected piston position for each group. Similarly, capacitance, magnetic, sonic, laser or resistance devices can all be used to indicate the rotational position of each group of piston assemblies. Further, sensors can be used either to sense the time when each group of pistons pass a particular position or, rather, can be used to measure the rotational position of the output shaft. Thus, there can be one discreet indication of the position of a piston assembly for each revolution of the piston assembly or, rather, there can be provided a discontinuous, or relatively continuous, indication of the position of each piston assembly. For continuous position indication, a digital scale such as a grey code scale, can be attached to each piston assembly group. Similarly, incremental digital encoders can be used to indicate small discreet increments of motion and, further, can be used to indicate the velocity and position of each piston assembly. All of the above described sensor variations and configurations can be used separately or in conjunction with each other or in conjunction with mechanical devices described above.

FIG. 47 illustrates an electronic piston position sensor 520 that is useful for indicating when a moving piston assembly or group is approaching its stop position. The signal generated by the electronic piston position sensor 520 is used to cause a brake mechanism to stop the rotating group and to also simultaneously release the stationary piston assembly group. The stopping of the rotating group and release of the stationary group is preferably effected using a pair of solenoids 522, 524 that are alternately energized and deenergized to brake and release the piston assemblies, respectively. The solenoids can be fast-acting or smooth-acting types wherein a braking action is initiated to commence the decelerating of the moving group before the final stop point is reached thus effecting a smooth piston assembly stop.

With continued reference to FIG. 47, a set of sensors 526, 528 generate a set of signals 530, 532 when marker devices 534, 536 on the piston assemblies pass under the sensor devices. The sensor signals 530, 532 are passed on to a set of controllers 538, 540 that are adapted to regulate the timing of the ignition pulses generated by the ignition device 542 and, further, are adapted to effect the braking of the first and second piston assemblies through actuation of the solenoid set 522, 524.

In FIG. 48, a series of markers 550, 552 are disposed on each of the first and second piston assemblies as shown. A processor device 552 includes computational means for determining a desired output 554, performing the calculation and control of load sensors 556, performing the supervision of the various motor sensors 558, and performing the computational control over ambient sensors 560. In FIG. 48, numerous variables are used to determine the optimum time, rate, and magnitude of braking, stopping, holding and releasing of the rotating piston assembly groups. For internal combustion engines, the timing of the ignition device 542' and the flow of fuel is optimally controlled. The variables which are used by the processing device 552 include the desired output of the device such as speed, torque, and flow, the actual output such as speed, position flow, motor condition variables and ambient condition variables. The motor condition variables include speed, rotating piston assembly positions, temperature, exhaust temperature, gear shift condition, and the like. The ambient condition variables include temperature and air density as examples.

Figure 49:
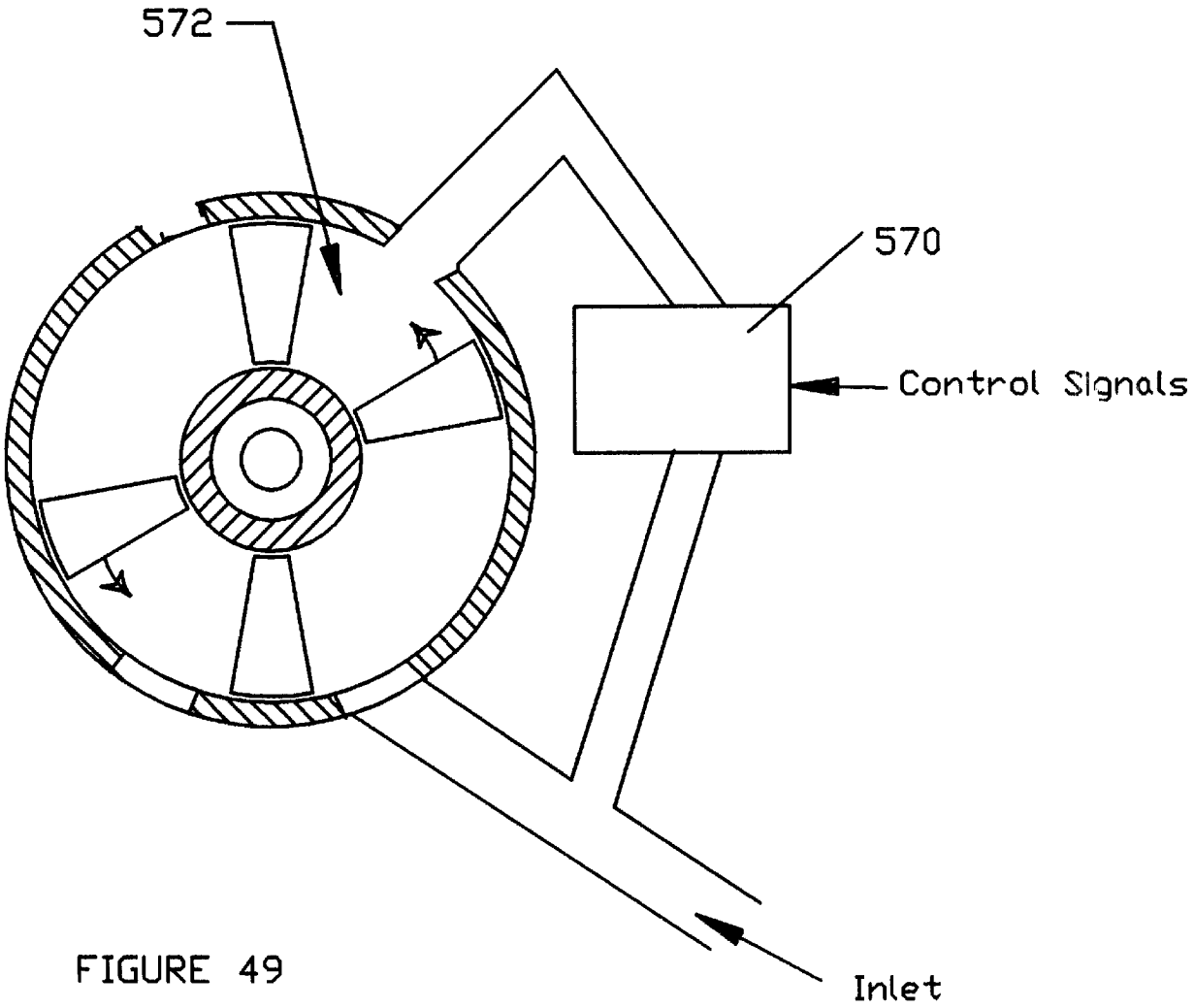

Turning lastly to FIG. 49, the controllers described in connection with FIGS. 47 and 48 are illustrated for controlling bypass valves 570 that are used to determine the working strokes of the devices. As shown in that Figure, the bypass valve 570 is used to control the amount of fluid that is compressed in the volume 572. The timing of the bypass valve being held open is used to control the displacement of the volume 572 that is compressed. For longer periods of the bypass valve held in the open state, a reduced amount of displacement of the volume is compressed. The controller described above is used to control the length of time that the bypass valve 570 is held in its open state. Although FIG. 49 illustrates only a single bypass valve, several bypass valves can be placed on any of the working volumes forming the expansible chamber device. In this manner, the displacement of pumps, compressors, and fluid motors are well controlled. In internal combustion engine applications, the bypass valves can be used to control motor power and efficiency.

The invention has been described with reference to the preferred embodiments. Obviously, modifications and alterations will occur to others upon a reading and understanding of this specification. It is intended to include all such modifications and alterations insofar as they come within the scope of the appended claims or the equivalence thereof.

Having thus described the invention, it is now claimed:

1. An internal combustion engine comprising:

a housing defining a cylindrical working chamber having inlet ports and exhaust ports; first and second interdigitated piston assemblies rotatably movable in said cylindrical working chamber, each of the piston assemblies including at least one pair of diametrically opposed radial vanes forming pistons in the working chamber and dividing the working chamber into a plurality of pairs of diametrically opposed compartments; and, a braking mechanism for controlling the motion of the piston assemblies to cause intermittent rotation of the first and second piston assemblies in the same direction during recurrent periods of rotation with each of said first and second piston assemblies being stopped between said periods of rotation, the braking mechanism including a first and second set of cam surfaces on the first and second piston assemblies respectively and a set of movable members adapted to alternately engage the first set of cam surfaces to stop the rotation of the first piston assembly while permitting the second piston assembly to rotate freely and then engage the second set of cam surfaces to stop the rotation of the second piston assembly while permitting the first piston assembly to rotate freely.

2. An internal combustion engine comprising:

a housing defining a cylindrical working chamber having inlet ports and exhaust ports;

first and second interdigitated piston assemblies rotatable movable in said cylindrical working chamber, each of the piston assemblies including at least one pair of diametrically opposed radial vanes forming pistons in the working chamber and dividing the working chamber into a plurality of pairs of diametrically opposed compartments; and, a braking mechanism for controlling the motion of the piston assemblies to cause intermittent rotation of the first and second piston assemblies in the same direction during recurrent periods of rotation with each of said first and second piston assemblies being stopped between said periods of rotation, the braking mechanism including:

a first and second set of cam surfaces on the first and second piston assemblies respectively and a set of movable members adapted to alternately engage the first set of cam surfaces to stop the rotation of the first piston assembly while permitting the second piston assembly to rotate freely and then engage the second set of cam surfaces to stop the rotation of the second piston assembly while permitting the first piston assembly to rotate freely;

a first elongate pivotable member having first and second ends, the first end of the first pivotable member being adapted to engage said first set of cam surfaces on the first piston assembly;

a second elongate pivotable member having first and second ends, the first end of the second pivotable member being adapted to engage said second set of cam surfaces on the second piston assembly; and, a slidable member disposed between the first pivotable member and the second pivotable member for transmitting motion between the second end of the first pivotable member and the second end of the second pivotable member.

3. The internal combustion engine according to claim 2 wherein: said first set of cam surfaces on the first piston assembly includes a first pair of ramp surfaces and a first pair of stop blocks; and, said second set of cam surfaces on the second piston assembly includes a second pair of ramp surfaces and a second pair of stop blocks.

4. The internal combustion engine according to claim 3 wherein:

said first pair of stop blocks are adapted to selectively engage first end of the first pivotable member when the first pivotable member is in a first position and stop said rotation of the first piston assembly when the first end of the first pivotable member is engaged with a one of said first pair of stop blocks; and, said second pair of stop blocks are adapted to selectively engage the first end of the second pivotable member when the second pivotable member is in a first position and stop said rotation of the second piston assembly when the first end of the second pivotable member is engaged with a one of said second pair of stop blocks.

5. The internal combustion engine according to claim 4 wherein:

the first pair of ramp surfaces are adapted to engage the first end of the first pivotable member when the first pivotable member is in a second position opposite said first position and simultaneously urge i) the first pivotable member from said second position to said first position; and, ii) together with said slidable member, said second pivotable member into said second position; and, the second pair of ramp surfaces are adapted to engage the first end of the second pivotable member when the second pivotable member is in a second position opposite said first position and simultaneously urge i) the second pivotable member from said second position to said first position; and, ii) together with said slidable member, said first pivotable member into said second position.

6. The internal combustion engine according to claim 5 wherein the slidable member includes first and second rod members extending between the second end of the first pivotable member and the second end of the second pivotable member, the first and second rod members being connected together by an intermediate damping spring member to permit relative slidable motion between the first and second rod members.

7. The internal combustion engine according to claim 6 wherein:

said first pair of ramp surfaces are formed on opposite sides of said first piston assembly;

said first pair of stop blocks are formed on opposite sides of said first piston assembly;

said second pair of ramp surfaces are formed on opposite sides of said second piston assembly; and, said second pair of stop blocks are formed on opposite sides of said second piston assembly.

8. An internal combustion engine comprising:

a housing defining a cylindrical working chamber having inlet ports and exhaust ports;

first and second interdigitated piston assemblies rotatable in said cylindrical working chamber about a longitudinal axis, each of the piston assemblies including at least one pair of diametrically opposed radial vanes forming pistons in the working chamber and dividing the working chamber into a plurality of pairs of diametrically opposed compartments;

a braking mechanism for controlling the motion of the piston assemblies to cause intermittent rotation of the first and second piston assemblies in the same direction during recurrent periods of rotation with each of said first and second piston assemblies being stopped between said periods of rotation;

an elongate output shaft connected to said first and second piston assemblies, the output shaft being disposed along said longitudinal axis and defining a set of connection areas arranged on said output shaft to extend in directions transverse to said longitudinal axis; and, a set of link elements engagable with said set of connection areas, each link element of said set of link elements being simultaneously slidably engagable with both of said first and second piston assemblies to transmit rotational motion from the first and second piston assemblies to said output shaft and to permit relative rotation between the first and second piston assemblies about said longitudinal axis within a predetermined range.

9. The internal combustion engine according to claim 8 wherein each link element of said set of link elements includes a first group of link areas adapted for slidable engagement with said first piston assembly and a second group of link areas adapted for slidable engagement with said second piston assembly to permit said relative rotation between the first and second piston assemblies about said longitudinal axis within said predetermined range.

10. The internal combustion engine according to claim 9 wherein each link element of said set of link elements are rotatably engaged with said set of connection areas.

11. The internal combustion engine according to claim 10 wherein:

said set of connection areas includes at least one connection axle-member extending from the output shaft in a direction substantially perpendicular to said longitudinal axis;

said set of link elements includes at least one link member rotatably carried on said at least one connection axle member;

said first group of link areas includes at least one first link pin adapted for slidable movement in an arcuate groove provided in said first piston assembly; and, said second group of link areas includes at least one second link pin adapted for slidable movement in an arcuate groove provided in said second piston assembly.

12. The internal combustion engine according to claim 11 wherein:

said at least one connection axle member includes a spherical bearing surface extending from the output shaft and a circular tab member extending from the spherical bearing surface; and, said at least one link member is rotatably carried on said circular tab member.

13. The internal combustion engine according to claim 12 wherein said predetermined range is substantially between 0 and 70 degrees.

14. The internal combustion engine according to claim 10 wherein:

said set of connection areas includes a pair of connection axle members extending in substantially diametrically opposite directions from the output shaft substantially perpendicular to said longitudinal axis;

said set of link elements includes first and second link members rotatably carried on said pair of connection axle members;

said first group of link areas includes a first link pin carried on a first connection axle member of said pair of connection axle members and a second link pin carried the second connection axle member of said pair of connection axle members, the first and second link pins being adapted for slidable movement in an arcuate groove provided in said first piston assembly; and, said second group of link areas includes a third link pin carried said first connection axle member and a fourth link pin carried the second connection axle member, the third and fourth link pins being adapted for slidable movement in an arcuate groove provided in said second piston assembly.

15. The internal combustion engine according to claim 14 wherein:

said first connection axle member includes a first spherical bearing surface extending from the output shaft and a first circular tab member extending from the first spherical bearing surface;

said second connection axle member includes a second spherical bearing surface extending from the output shaft and a second circular tab member extending from the second spherical bearing surface;

said first link member is rotatably carried on said first circular tab member; and, said second link member is rotatably carried on said second circular tab member.

16. The internal combustion engine according to claim 15 wherein said predetermined range is substantially between 0 and 70 degrees.

17. An internal combustion engine comprising:

a housing defining a cylindrical working chamber having inlet ports and exhaust ports;

first and second interdigitated piston assemblies rotatable in said cylindrical working chamber about a longitudinal axis, each of the piston assemblies including at least one pair of diametrically opposed radial vanes forming pistons in the working chamber and dividing the working chamber into a plurality of pairs of diametrically opposed compartments;

a braking mechanism for controlling the motion of the piston assemblies to cause intermittent rotation of the first and second piston assemblies in the same direction during recurrent periods of rotation with each of said first and second piston assemblies being stopped between said periods of rotation, the braking mechanism including a first and second set of cam surfaces on the first and second piston assemblies respectively and a set of-movable members adapted to alternately engage the first set of cam surfaces to stop the rotation of the first piston assembly while permitting the second piston assembly to rotate freely and then engage the second set of cam surfaces to stop the rotation of the second piston assembly while permitting the first piston assembly to rotate freely;

an elongate output shaft connected to said first and second piston assemblies, the output shaft being disposed along said longitudinal axis and defining a set of connection areas arranged on said output shaft to extend in directions transverse to said longitudinal axis; and, a set of link elements engagable with said set of connection areas, each link element of said set of link elements being simultaneously slidably engagable with both of said first and second piston assemblies to transmit rotational motion from the first and second piston assemblies to said output shaft and to permit relative rotation between the first and second piston assemblies about said longitudinal axis within a predetermined range.

18. The internal combustion engine according to claim 17 wherein said braking mechanism includes:

a first elongate pivotable member having first and second ends, the first end of the first pivotable member being adapted to engage said first set of cam surfaces on the first piston assembly;

a second elongate pivotable member having first and second ends, the first end of the second pivotable member being adapted to engage said second set of cam surfaces on the second piston assembly; and, a sidable member disposed between the first pivotable member and the second pivotable member for transmitting motion between the second end of the first pivotable member and the second end of the second pivotable member.

19. The internal combustion engine according to claim 18 wherein:

said first set of cam surfaces on the first piston assembly include a first pair of ramp surfaces and a first pair of stop blocks;

said second set of cam surfaces on the second piston assembly include a second pair of ramp surfaces and a second pair of stop blocks;

each link element of said set of link elements is rotatably engaged with said set of connection areas and includes a first group of link areas adapted for slidable engagement with said first piston assembly and a second group of link areas adapted for slidable engagement with said second piston assembly to permit said relative rotation between the first and second piston assemblies about said longitudinal axis within said predetermined range.

20. The internal combustion engine according to claim 19 wherein:

said first pair of stop blocks are adapted to selectively engage the first end of the first pivotable member when the first pivotable member is in a first position and stop said rotation of the first piston assembly when the first end of the first pivotable member is engaged with a one of said first pair of stop blocks;

said second pair of stop blocks are adapted to selectively engage the first end of the second pivotable member when the second pivotable member is in a first position and stop said rotation of the second piston assembly when the first end of the second pivotable member is engaged with a one of said second pair of stop blocks;

the first pair of ramp surfaces are adapted to engage the first end of the first pivotable member when the first pivotable member is in a second position opposite said first position and simultaneously urge i) the first pivotable member from said second position to said first position; and, ii) together with said slidable member, said second pivotable member into said first position;

the second pair of ramp surfaces are adapted to engage the first end of the second pivotable member when the second pivotable member is in a second position opposite said first position and simultaneously urge i) the second pivotable member from said second position to said first position; and, ii) together with said slidable member, said first pivotable member into said first position;

said set of connection areas includes a pair of connection axle members extending in substantially diametrically opposite directions from the output shaft substantially perpendicular to said longitudinal axis; said set of link elements includes first and second link members rotatably carried on said pair of connection axle members;

said first group of link areas includes a first link pin carried on a first connection axle member of said pair of connection axle members and a second link pin carried the second connection axle member of said pair of connection axle members, the first and second link pins being adapted for slidable movement in an arcuate groove provided in said first piston assembly;

said second group of link areas includes a third link pin carried said first connection axle member and a fourth link pin carried the second connection axle member, the third and fourth link pins being adapted for slidable movement in an arcuate groove provided in said second piston assembly; and, said predetermined range is substantially between 0 and 70 degrees.

21. An expansible chamber apparatus comprising:

a housing defining a cylindrical working chamber having inlet ports and exhaust ports; first and second interdigitated piston assemblies rotatably movable in said cylindrical working chamber, each of the piston assemblies including at least one radial vane forming pistons in the working chamber and dividing the working chamber into at least one pair of diametrically opposed compartments; and, a braking mechanism for controlling the motion of the piston assemblies to cause intermittent rotation of the first and second piston assemblies in the same direction during recurrent periods of rotation with each of said first and second piston assemblies being stopped between said periods of rotation, the braking mechanism including a first and second set of cam surfaces on the first and second piston assemblies respectively and a set of movable members adapted to alternately engage the first set of cam surfaces to stop the rotation of the first piston assembly while permitting the second piston assembly to rotate freely and then engage the second set of cam surfaces to stop the rotation of the second piston assembly while permitting the first piston assembly to rotate freely.

22. An expansible chamber apparatus comprising:

a housing defining a cylindrical working chamber having inlet ports and exhaust ports;

first and second interdigitated piston assemblies rotatable movable in said cylindrical working chamber, each of the piston assemblies including at least one radial vane forming pistons in the working chamber and dividing the working chamber into at least one pair of diametrically opposed compartments; and, a braking mechanism for controlling the motion of the piston assemblies to cause intermittent rotation of the first and second piston assemblies in the same direction during recurrent periods of rotation with each of said first and second piston assemblies being stopped between said periods of rotation, the braking mechanism including:

a first and second set of cam surfaces on the first and second piston assemblies respectively and a set of movable members adapted to alternately engage the first set of cam surfaces to stop the rotation of the first piston assembly while permitting the second piston assembly to rotate freely and then engage the second set of cam surfaces to stop the rotation of the second piston assembly while permitting the first piston assembly to rotate freely;

a first elongate pivotable member having first and second ends, the first end of the first pivotable member being adapted to engage said first set of cam surfaces on the first piston assembly;

a second elongate pivotable member having first and second ends, the first end of the second pivotable member being adapted to engage said second set of cam surfaces on the second piston assembly; and, a slidable member disposed between the first pivotable member and the second pivotable member for transmitting motion between the second end of the first pivotable member and the second end of the second pivotable member.

23. The expansible chamber apparatus according to claim 22 wherein:

said first set of cam surfaces on the first piston assembly includes a first pair of ramp surfaces and a first pair of stop blocks; and, said second set of cam surfaces on the second piston assembly includes a second pair of ramp surfaces and a second pair of stop blocks.

24. The expansible chamber apparatus according to claim 23 wherein:

said first pair of stop blocks are adapted to selectively engage the first end of the first pivotable member when the first pivotable member is in a first position and stop said rotation of the first piston assembly when the first end of the first pivotable member is engaged with a one of said first pair of stop blocks; and, said second pair of stop blocks are adapted to selectively engage the first end of the second pivotable member when the second pivotable member is in a first position and stop said rotation of the second piston assembly when the first end of the second pivotable member is engaged with a one of said second pair of stop blocks.

25. The expansible chamber apparatus according to claim 24 wherein:

the first pair of ramp surfaces are adapted to engage the first end of the first pivotable at member when the first pivotable member is in a second position opposite said first position and simultaneously urge i) the first pivotable member from said second position to said first position; and, ii) together with said slidable member, said second pivotable member into said second position; and, the second pair of ramp surfaces are adapted to engage the first end of the second pivotable member when the second pivotable member is in a second position opposite said first position and simultaneously urge i) the second pivotable member from said second position to said first position; and, ii) together with said slidable member, said first pivotable member into said second position.

26. The expansible chamber apparatus according to claim 25 wherein the slidable member includes first and second rod members extending between the second end of the first pivotable member and the second end of the second pivotable member, the first and second rod members being connected together by an intermediate damping spring member to permit relative slidable motion between the first and second rod members.

27. The expansible chamber apparatus according to claim 26 wherein:

said first pair of ramp surfaces are formed on opposite sides of said first piston assembly;

said first pair of stop blocks are formed on opposite sides of said first piston assembly;

said second pair of ramp surfaces are formed on opposite sides of said second piston assembly; and, said second pair of stop blocks are formed on opposite sides of said second piston assembly.

28. An expansible chamber apparatus comprising:

a housing defining a cylindrical working chamber having inlet ports and exhaust ports;

first and second interdigitated piston assemblies rotatable in said cylindrical working chamber about a longitudinal axis, each of the piston assemblies including at least one radial vane forming pistons in the working chamber and dividing the working chamber into at least one pair of diametrically opposed compartments;

a braking mechanism for controlling the motion of the piston assemblies to cause intermittent rotation of the first and second piston assemblies in the same direction during recurrent periods of rotation with each of said first and second piston assemblies being stopped between said periods of rotation;

an elongate output shaft connected to said first and second piston assemblies, the output shaft being disposed along said longitudinal axis; and, a piston synchronizing system including:

a set of connection areas arranged on said output shaft to extend in directions transverse to said longitudinal axis; and, a set of link elements engagable with said set of connection areas, each link element of said set of link elements being simultaneously slidably engagable with both of said first and second piston assemblies to transmit rotational motion from the first and second piston assemblies to said output shaft and to permit relative rotation between the first and second piston assemblies about said longitudinal axis within a predetermined range.

29. The expansible chamber apparatus according to claim 28 wherein each link element of said set of link elements includes a first group of link areas adapted for slidable engagement with said first piston assembly and a second group of link areas adapted for slidable engagement with said second piston assembly to permit said relative rotation between the first and second piston assemblies about said longitudinal axis within said predetermined range.

30. The expansible chamber apparatus according to claim 29 wherein each link element of said set of link elements are rotatably engaged with said set of connection areas.

31. The expansible chamber apparatus according to claim 30 wherein:

said set of connection areas includes at least one connection axle member extending from the output shaft in a direction substantially perpendicular to said longitudinal axis;

said set of link elements includes at least one link member rotatably carried on said at least one connection axle member;

said first group of link areas includes at least one first link pin adapted for slidable movement in an arcuate groove provided in said first piston assembly; and, said second group of link areas includes at least one second link pin adapted for slidable movement in an arcuate groove provided in said second piston assembly.

32. The expansible chamber apparatus according to claim 31 wherein:

said at least one connection axle member includes a spherical bearing surface extending from the output shaft and a circular tab member extending from the spherical bearing surface; and, said at least one link member is rotatably carried on said circular tab member.

33. The expansible chamber apparatus according to claim 30 wherein:

said set of connection areas includes a pair of connection axle members extending in substantially diametrically opposite directions from the output shaft substantially perpendicular to said longitudinal axis;

said set of link elements includes first and second link members rotatably carried on said pair of connection axle members;

said first group of link areas includes a first link pin carried on a first connection axle member of said pair of connection axle members and a second link pin carried the second connection axle member of said pair of connection axle members, the first and second link pins being adapted for sidable movement in an arcuate groove provided in said first piston assembly; and, said second group of link areas includes a third link pin carried said first connection axle member and a fourth link pin carried the second connection axle member, the third and fourth link pins being adapted for slidable movement in an arcuate groove provided in said second piston assembly.

34. The expansible chamber apparatus according to claim 33 wherein:

said first connection axle member includes a first spherical bearing surface extending from the output shaft and a first circular tab member extending from the first spherical bearing surface;

said second connection axle member includes a second spherical bearing surface extending from the output shaft and a second circular tab member extending from the second spherical bearing surface;

said first link member is rotatably carried on said first circular tab member; and, said second link member is rotatably carried on said second circular tab member.

35. An expansible chamber apparatus comprising:

a housing defining a cylindrical working chamber having inlet ports and exhaust ports;

first and second interdigitated piston assemblies rotatable in said cylindrical working chamber about a longitudinal axis, each of the piston assemblies including at least one at least one radial vane forming pistons in the working chamber and dividing the working chamber into a of pair of diametrically opposed compartments;

a braking mechanism for controlling the motion of the piston assemblies to cause intermittent rotation of the first and second piston assemblies in the same direction during recurrent periods of rotation with each of said first and second piston assemblies being stopped between said periods of rotation, the braking mechanism including a first and second set of cam surfaces on the first and second piston assemblies respectively and a set of movable members adapted to alternately engage the first set of cam surfaces to stop the rotation of the first piston assembly while permitting the second piston assembly to rotate freely and then engage the second set of cam surfaces to stop the rotation of the second piston assembly while permitting the first piston assembly to rotate freely;

an elongate output shaft connected to said first and second piston assemblies, the output shaft being disposed along said longitudinal axis; and, a piston synchronizing system including:

a set of connection areas arranged on said output shaft to extend in directions transverse to said longitudinal axis; and, a set of link elements engagable with said set of connection areas, each link element of said set of link elements being simultaneously slidably engagable with both of said first and second piston assemblies to transmit rotational motion from the first and second piston assemblies to said output shaft and to permit relative rotation between the first and second piston assemblies about said longitudinal axis within a predetermined range.

36. The expansible chamber apparatus according to claim 35 wherein said braking mechanism includes:

a first elongate pivotable member having first and second ends, the first end of the first pivotable member being adapted to engage said first set of cam surfaces on the first piston assembly;

a second elongate pivotable member having first and second ends, the first end of the second pivotable member being adapted to engage said second set of cam surfaces on the second piston assembly; and, a slidable member disposed between the first pivotable member and the second pivotable member for transmitting motion between the second end of the first pivotable member and the second end of the second pivotable member.

37. The expansible chamber apparatus according to claim 36 wherein:

said first set of cam surfaces on the first piston assembly include a first pair of ramp surfaces and a first pair of stop blocks;

said second set of cam surfaces on the second piston assembly include a second pair of ramp surfaces and a second pair of stop blocks;

each link element of said set of link elements is rotatably engaged with said set of connection areas and includes a first group of link areas adapted for slidable engagement with said first piston assembly and a second group of link areas adapted for slidable engagement with said second piston assembly to permit said relative rotation between the first and second piston assemblies about said longitudinal axis within said predetermined range.

38. The expansible chamber apparatus according to claim 37 wherein:

said first pair of stop blocks are adapted to selectively engage the first end of the first pivotable member when the first pivotable member is in a first position and stop said rotation of the first piston assembly when the first end of the first pivotable member is engaged with a one of said first pair of stop blocks;

said second pair of stop blocks are adapted to selectively engage the first end of the second pivotable member when the second pivotable member is in a first position and stop said rotation of the second piston assembly when the first end of the second pivotable member is engaged with a one of said second pair of stop blocks;

the first pair of ramp surfaces are adapted to engage the first end of the first pivotable member when the first pivotable member is in a second position opposite said first position and simultaneously urge i) the first pivotable member from said second position to said first position; and, ii) together with said slidable member, said second pivotable member into said first position;

the second pair of ramp surfaces are adapted to engage the first end of the second pivotable member when the second pivotable member is in a second position opposite said first position and simultaneously urge i) the second pivotable member from said second position to said first position; and, ii) together with said slidable member, said first pivotable member into said first position;

said set of connection areas includes a pair of connection axle members extending in substantially diametrically opposite directions from the output shaft substantially perpendicular to said longitudinal axis;

said set of link elements includes first and second link members rotatably carried on said pair of connection axle members;

said first group of link areas includes a first link pin carried on a first connection axle member of said pair of connection axle members and a second link pin carried the second connection axle member of said pair of connection axle members, the first and second link pins being adapted for slidable movement in an arcuate groove provided in said first piston assembly; and, said second group of link areas includes a third link pin carried said first connection axle member and a fourth link pin carried the second connection axle member, the third and fourth link pins being adapted for slidable movement in an arcuate groove provided in said second piston assembly.

* * * * *